US008004481B2

(12) United States Patent
Yamazaki et al.

(10) Patent No.: US 8,004,481 B2
(45) Date of Patent: Aug. 23, 2011

(54) DISPLAY DEVICE AND ELECTRONIC DEVICE

(75) Inventors: Shunpei Yamazaki, Tokyo (JP); Hajime Kimura, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 925 days.

(21) Appl. No.: 11/565,116

(22) Filed: Nov. 30, 2006

(65) Prior Publication Data

US 2007/0126666 A1 Jun. 7, 2007

(30) Foreign Application Priority Data

Dec. 2, 2005 (JP) ..... 2005-350006

(51) Int. Cl.
*G09G 3/32* (2006.01)

(52) U.S. Cl. ..... 345/82; 345/76

(58) Field of Classification Search ..... 345/76–83, 345/39, 44; 315/169.1, 169.3
See application file for complete search history.

(56) References Cited

U.S. PATENT DOCUMENTS

| | | | | |
|---|---|---|---|---|
| 7,460,095 | B2 * | 12/2008 | Osame et al. | 345/82 |
| 2005/0083270 | A1 | 4/2005 | Miyazawa | |
| 2005/0134189 | A1 | 6/2005 | Osame et al. | |

FOREIGN PATENT DOCUMENTS

| | | | |
|---|---|---|---|
| CN | 1591104 | A | 3/2005 |
| CN | 1638559 | A | 7/2005 |
| EP | 1517290 | A2 | 3/2005 |
| EP | 1 544 842 | A2 | 6/2005 |
| JP | 2005-202371 | | 7/2005 |

OTHER PUBLICATIONS

Office Action, Chinese Application No. 200610064158.0; mailed Mar. 30, 2010, 13 pages with English translation.

* cited by examiner

*Primary Examiner* — Kevin M Nguyen
*Assistant Examiner* — Kenneth B Lee, Jr.
(74) *Attorney, Agent, or Firm* — Fish & Richardson P.C.

(57) ABSTRACT

It is an object of the present invention to provide a display device in which a reverse current sufficient enough to insulate a short-circuited point flows and a transistor using amorphous silicon is used is applied. The display device includes a switching transistor that controls an input of a video signal, a driving transistor that controls a current flowing in a forward direction to a light emitting element, and an AC transistor that controls a current flowing in a reverse direction to the light emitting element; and a reverse bias current can be applied to the light emitting element. Furthermore, the above-described transistors are N-channel transistors.

4 Claims, 48 Drawing Sheets

DISPLAY DEVICE AND ELECTRONIC DEVICE

BACKGROUND OF THE INVENTION

1. Field of the Invention

The present invention relates to a display device using a light emitting element. In addition, the present invention relates to an electronic device including the display device in a display portion.

2. Description of the Related Art

In recent years, a technique of forming a transistor, such as a TFT (thin film transistor), over a substrate has been drastically developed, and development of an active matrix display device has been promoted.

In addition, a so-called self-luminous display device has been attracting attention, which has pixels each formed using a light emitting element such as a light emitting diode (LED). As a light emitting element used in such a self-luminous display device, there is an organic light emitting diode (also referred to as OLED), an organic EL element, an electroluminescence (EL) element, which have been attracting attention and started to be used for an organic EL display or the like. Since the light emitting element is a self-luminous type, it does not require a light source such as a backlight, unlike a liquid crystal display device. Accordingly, such a light emitting element is expected to realize more lightweight and thinner display devices. In recent years, development of a wide-screen EL display has been promoted, following a liquid crystal TV.

When putting an EL display into practical use, a short life of a light emitting element because of deterioration of an EL layer has been a problem. As factors affecting the length of the EL layer life, a structure of a device that drives the EL display, a characteristic of an organic EL material constituting the EL layer, a material of an electrode, conditions of the manufacturing steps, and the like can be given.

In addition to the factors given above, a driving method of the EL display has been attracting attention as one of the factors affecting the length of the EL layer life. In order to make an EL layer emit light, a method in which direct-current electricity is supplied to an anode and a cathode sandwiching an EL layer has been conventionally used. In other words, the EL display is driven with a direct current, and the direction of an EL driver voltage applied to the EL layer is always the same.

However, a driving method in which a forward driver voltage and a reverse driver voltage are applied to the light emitting element, and a current sufficient enough to insulate a short-circuited point can be supplied to the short-circuited point when a reverse driver voltage is applied to the light emitting element, so that the life of the light emitting element can be extended is proposed (see Patent Document 1: Japanese Published Patent Application No. 2005-202371).

Furthermore, there is an initial failure in which a pixel electrode and a counter electrode are short-circuited and a region where light is not emitted is formed in a pixel region. Short-circuiting occurs in the following cases: a foreign substance (dust) attaches before formation of a light emitting element; a minute projection is generated in an anode when the anode is formed, and a pinhole is generated in an electroluminescent layer; an electroluminescent layer is not formed uniformly and a pinhole is generated since a film thickness of the electroluminescent layer is thin; and the like. In a pixel where such an initial failure occurs, lighting and non-lighting in accordance with a signal are not performed, and almost all the current flows in the short-circuited point and a phenomenon that the element as a whole stops lighting occurs, or a phenomenon that a particular pixel lights or stops lighting occurs; therefore, display of an image is not performed well.

Other than the above-described initial failure, a progressive failure (also referred to as time degradation) that is caused by newly generated short-circuiting of an anode and a cathode over time sometimes occurs. The short-circuiting of the anode and the cathode that is newly generated over time occurs due to a minute projection that is generated when the anode is formed. In other words, a potential short-circuited point exists in a stacked body in which an electroluminescent layer is sandwiched between a pair of electrodes, and the short-circuited point comes out over time. Furthermore, other than short-circuiting of the anode and the cathode, the progressive failure is said to be generated when a minute space between the electroluminescent layer and the cathode expands over time, and a connection failure between the electroluminescent layer and the cathode is caused.

By applying a reverse driver voltage, the short-circuited point is carbonized or oxidized; thereby insulated, so that an initial failure can be prevented from developing further. A progressive failure can also be prevented from being generated or developing, by insulating the short-circuited point by carbonization or oxidation, or by suppressing the expansion of the space between the electroluminescent layer and the cathode.

In order to suppress development of a failure, a light emitting element needs to be driven with an alternating current. Driving a light emitting element with an alternating current means that voltages with different polarities are applied to the light emitting element alternately. In other words, a reverse voltage is applied to the light emitting element, in addition to a forward voltage which is required for light emission. Intensity and applying time are not necessarily the same between the forward voltage and the reverse voltage. Even the case where the amount of a reverse voltage to be applied is very small is referred to as an alternating current. In the present invention, a reverse voltage is applied to a light emitting element, and the light emitting element is AC-driven by applying a reverse bias current; thereby suppressing a failure of the light emitting element.

In order to insulate a short-circuited point, a large enough current to insulate the short-circuited point needs to be applied. Usually, the value of a large enough current to insulate a short-circuited point is desired to be much larger than the value of a current flowing in a forward direction to let a light emitting element emit light.

On the other hand, in an already established inexpensive manufacturing technique, a display device using amorphous silicon and a driving method have been issues. In the case where poly-silicon is used for a semiconductor film, for example, a process of crystallization is required. However, it is difficult to uniformly irradiate a large-area substrate with laser light; therefore, it is difficult to obtain uniform crystals over a large area. Accordingly, manufacture of a high-quality display device using amorphous silicon which enables enlargement of the area and does not require crystallization, and of which manufacturing process is simple, and a driving method thereof have been developed. However, in the case where amorphous silicon is used, the display device needs to be constituted by an N-channel transistor, since a P-channel transistor cannot realize sufficient operating characteristics and function.

SUMMARY OF THE INVENTION

In view of the foregoing problem, it is an object of the present invention to apply a pixel constituted by N-channel transistors to a display device and its driving method. Furthermore, it is another object of the present invention to provide a display device in which a reverse voltage can be applied to a light emitting element so as to extend the life of the light emitting element, as well as to provide a favorable light emitting characteristic.

One feature of a structure of the present invention is to include, in a pixel, a first wiring, a second wiring, a third wiring, and a fourth wiring; a light emitting element including a pixel electrode and a counter electrode; a first transistor that contols an input of a video signal; a second transistor that controls a current flowing in a forward direction to the light emitting element; and a third transistor that controls a current flowing in a reverse direction to the light emitting element. A gate electrode of the first transistor is electrically connected to the first wiring; and one of a source electrode or drain electrode of the first transistor is electrically connected to the second wiring in which a video signal is transmitted, and the other one is electrically connected to a gate electrode of the second transistor. One of a source electrode or drain electrode of the second transistor is electrically connected to the third wiring, and the other one is electrically connected to the pixel electrode. One of a source electrode or drain electrode of the third transistor is electrically connected to the pixel electrode and a gate electrode of the third transistor, and the other one is electrically connected to the fourth wiring. In addition, another feature is that each of the first transistor, the second transistor, and the third transistor is an N-channel transistor. The first transistor, the second transistor, and the third transistor may operate in a linear region.

In other words, the above-described structure includes, in a pixel, a scanning line, a signal line, a power line, and a potential control line; a light emitting element including a pixel electrode and a counter electrode; a switching transistor that contols an input of a video signal; a driving transistor that controls a current flowing in a forward direction to the light emitting element; and an AC transistor that controls a current flowing in a reverse direction to the light emitting element. A gate electrode of the switching transistor is electrically connected to the scanning line; and one of a source electrode or drain electrode of the switching transistor is electrically connected to the signal line in which a video signal is transmitted, and the other one is electrically connected to a gate electrode of the driving transistor. One of a source electrode or drain electrode of the driving transistor is electrically connected to the power line, and the other one is electrically connected to the pixel electrode. One of a source electrode or drain electrode of the AC transistor is electrically connected to the pixel electrode and a gate electrode of the AC transistor, and the other one is electrically connected to the potential control line. In addition, another feature is that each of the switching transistor, the driving transistor, and the AC transistor is an N-channel transistor. The switching transistor, the driving transistor, and the AC transistor may operate in a linear region.

Another feature of a structure of the present invention is to include, in a pixel, a first wiring, a second wiring, a third wiring, and a fourth wiring; a light emitting element including a pixel electrode and a counter electrode; a first transistor that contols an input of a video signal; a second transistor that controls a current flowing in a forward direction to the light emitting element; and a third transistor that controls a current flowing in a reverse direction to the light emitting element. A gate electrode of the first transistor is electrically connected to the first wiring; and one of a source electrode or drain electrode of the first transistor is electrically connected to the second wiring in which a video signal is transmitted, and the other one is electrically connected to a gate electrode of the second transistor. One of a source electrode or drain electrode of the second transistor is electrically connected to the third wiring, and the other one is electrically connected to the pixel electrode. One of a source electrode or drain electrode of the third transistor is electrically connected to the pixel electrode, and the other one is electrically connected to the third wiring. A gate electrode of the third transistor is electrically connected to the fourth wiring. In addition, another feature is that each of the first transistor, the second transistor, and the third transistor is an N-channel transistor. The first transistor, the second transistor, and the third transistor may operate in a linear region. Furthermore, the fourth wiring and the counter electrode may be connected to each other.

In other words, the above-described structure includes, in a pixel, a scanning line, a signal line, a power line, and a wiring; a light emitting element including a pixel electrode and a counter electrode; a switching transistor that contols an input of a video signal; a driving transistor that controls a current flowing in a forward direction to the light emitting element; and an AC transistor that controls a current flowing in a reverse direction to the light emitting element. A gate electrode of the switching transistor is electrically connected to the scanning line; and one of a source electrode or drain electrode of the switching transistor is electrically connected to the signal line in which a video signal is transmitted, and the other one is electrically connected to a gate electrode of the driving transistor. One of a source electrode or drain electrode of the driving transistor is electrically connected to the power line, and the other one is electrically connected to the pixel electrode. One of a source electrode or drain electrode of the AC transistor is electrically connected to the pixel electrode, and the other one is electrically connected to the power line. A gate electrode of the AC transistor is electrically connected to the wiring. In addition, another feature is that each of the switching transistor, the driving transistor, and the AC transistor is an N-channel transistor. The switching transistor, the driving transistor, and the AC transistor may operate in a linear region. Furthermore, the wiring and the counter electrode may be connected to each other.

In the above-described structure, a ratio of channel length L1 to channel width W1 of the second transistor (L1/W1) is preferably larger than a ratio of channel length L2 to channel width W2 of the third transistor (L2/W2). More specifically, it is preferable that the channel length of the third transistor be shorter than or equal to the channel width thereof.

Another feature of a structure of the present invention is to include, in a pixel, a first wiring, a second wiring, a third wiring, a fourth wiring, and a fifth wiring; a light emitting element including a pixel electrode and a counter electrode; a first transistor that contols an input of a video signal; a second transistor that controls a current flowing in a forward direction to the light emitting element; and a third transistor and a fourth transistor that control a current flowing in a reverse direction to the light emitting element. A gate electrode of the first transistor is electrically connected to the first wiring; and one of a source electrode or drain electrode of the first transistor is electrically connected to the second wiring in which a video signal is transmitted, and the other one is electrically connected to a gate electrode of the second transistor. One of a source electrode or drain electrode of the second transistor is electrically connected to the third wiring, and the other one is electrically connected to the pixel electrode. One of a source electrode or drain electrode of the third transistor is electrically connected to the gate electrode of the second transistor, and the other one is electrically connected to the pixel electrode. A gate electrode of the third transistor is connected to the fourth wiring. One of a source electrode or drain electrode of the fourth transistor is electrically connected to the pixel electrode and a gate electrode of the fourth transistor, and the other one is electrically connected to the fifth wiring. In addition, another feature is that each of the first transistor, the second transistor, the third transistor, and the fourth transistor is an N-channel transistor. The first transistor, the second transistor, the third transistor, and the fourth transistor may operate in a linear region.

In other words, the above-described structure includes, in a pixel, a scanning line, a signal line, a power line, a first potential control line, and a second potential control line; a light emitting element including a pixel electrode and a counter electrode; a switching transistor that contols an input of a video signal; a driving transistor that controls a current flowing in a forward direction to the light emitting element; and a first AC transistor and a second AC transistor that control a current flowing in a reverse direction to the light emitting element. A gate electrode of the switching transistor is electrically connected to the scanning line; and one of a source electrode or drain electrode of the switching transistor is electrically connected to the signal line in which a video signal is transmitted, and the other one is electrically connected to a gate electrode of the driving transistor. One of a source electrode or drain electrode of the driving transistor is electrically connected to the power line, and the other one is electrically connected to the pixel electrode. One of a source electrode or drain electrode of the first AC transistor is connected to the gate electrode of the driving transistor, and the other one is connected to the pixel electrode. A gate electrode of the first AC transistor is connected to the first potential control line. One of a source electrode or drain electrode of the second AC transistor is electrically connected to the pixel electrode and a gate electrode of the second AC transistor, and the other one is electrically connected to the second potential control line. In addition, another feature is that each of the switching transistor, the driving transistor, the first AC transistor, and the second AC transistor is an N-channel transistor. The switching transistor, the driving transistor, the first AC transistor, and the second AC transistor may operate in a linear region.

In the above-described structure, a ratio of channel length L1 to channel width W1 of the second transistor (L1/W1) is preferably larger than a ratio of channel length L2 to channel width W2 of the fourth transistor (L2/W2). More specifically, it is preferable that the channel length of the fourth transistor be shorter than or equal to the channel width thereof.

In addition, in the above-described structure, it is preferable that the ratio of the channel length to the channel width of the second transistor be 5 or more.

Another feature of a structure of the present invention is to include, in a pixel, a first wiring, a second wiring, and a third wiring; a light emitting element including a pixel electrode and a counter electrode; a capacitor element including two electrodes; a first transistor and a second transistor that control input of a video signal; a third transistor that controls a current flowing in a forward direction to the light emitting element; and a fourth transistor that controls a current flowing in a reverse direction to the light emitting element. Gate electrodes of the first transistor and the second transistor are electrically connected to the first wiring. One of a source electrode or drain electrode of the first transistor is electrically connected to the second wiring in which a video signal is transmitted, and the other one is electrically connected to the pixel electrode. One of a source electrode or drain electrode of the second transistor is electrically connected to the third wiring, and the other one is electrically connected to a gate electrode of the third transistor and one of the electrodes included in the capacitor element. One of a source electrode or drain electrode of the third transistor is electrically connected to the third wiring, and the other one is electrically connected to the pixel electrode and the other one of the electrodes included in the capacitor element. One of a source electrode or drain electrode of the fourth transistor is electrically connected to the third wiring, and the other one is electrically connected to the pixel electrode and a gate electrode of the fourth transistor. In addition, another feature is that each of the first transistor, the second transistor, the third transistor, and the fourth transistor is an N-channel transistor. The third transistor may operate in a saturation region, and the first transistor, the second transistor, and the fourth transistor may operate in a linear region.

In other words, the above-described structure includes, in a pixel, a scanning line, a signal line, and a power line; a light emitting element including a pixel electrode and a counter electrode; a capacitor element including two electrodes; a first switching transistor and a second switching transistor that control input of a video signal; a driving transistor that controls a current flowing in a forward direction to the light emitting element; and an AC transistor that controls a current flowing in a reverse direction to the light emitting element. Gate electrodes of the first switching transistor and the second switching transistor are electrically connected to the scanning line. One of a source electrode or drain electrode of the first switching transistor is electrically connected to the signal line in which a video signal is transmitted, and the other one is electrically connected to the pixel electrode. One of a source electrode or drain electrode of the second switching transistor is electrically connected to the power line, and the other one is electrically connected to a gate electrode of the driving transistor and one of the electrodes included in the capacitor element. One of a source electrode or drain electrode of the driving transistor is electrically connected to the power line, and the other one is electrically connected to the pixel electrode and the other one of the electrodes included in the capacitor element. One of a source electrode or drain electrode of the AC transistor is electrically connected to the power line, and the other one is electrically connected to the pixel electrode and a gate electrode of the AC transistor. In addition, another feature is that each of the first switching transistor, the second switching transistor, the driving transistor, and the AC transistor is an N-channel transistor. The driving transistor may operate in a saturation region, and the first switching transistor, the second switching transistor, and the AC transistor may operate in a linear region.

Another feature of a structure of the present invention is to include, in a pixel, a first wiring, a second wiring, a third wiring, and a fourth wiring; a light emitting element including a pixel electrode and a counter electrode; a capacitor element including two electrodes; a first transistor and a second transistor that control input of a video signal; a third transistor that controls a current flowing in a forward direction to the light emitting element; and a fourth transistor that controls a current flowing in a reverse direction to the light emitting element. Gate electrodes of the first transistor and the second transistor are electrically connected to the first wiring. One of a source electrode or drain electrode of the first transistor is electrically connected to the second wiring in which a video signal is transmitted, and the other one is electrically connected to the pixel electrode. One of a source electrode or drain electrode of the second transistor is electrically connected to the third wiring, and the other one is electrically connected to a gate electrode of the third transistor and one of the electrodes included in the capacitor element. One of a source electrode or drain electrode of the third transistor is electrically connected to the third wiring, and the other one is electrically connected to the pixel electrode and the other one of the electrodes included in the capacitor element. One of a source electrode or drain electrode of the fourth transistor is electrically connected to the fourth wiring, and the other one is electrically connected to the pixel electrode and a gate electrode of the fourth transistor. In addition, another feature is that each of the first transistor, the second transistor, the third transistor, and the fourth transistor is an N-channel transistor. The third transistor may operate in a saturation region, and the first transistor, the second transistor, and the fourth transistor may operate in a linear region.

In other words, the above-described structure includes, in a pixel, a scanning line, a signal line, a power line, and a potential control line; a light emitting element including a pixel electrode and a counter electrode; a capacitor element including two electrodes; a first switching transistor and a second switching transistor that control input of a video signal; a driving transistor that controls a current flowing in a forward direction to the light emitting element; and an AC transistor that controls a current flowing in a reverse direction to the light emitting element. Gate electrodes of the first switching transistor and the second switching transistor are electrically connected to the scanning line. One of a source electrode or drain electrode of the first switching transistor is electrically connected to the signal line in which a video signal is transmitted, and the other one is electrically connected to the pixel electrode. One of a source electrode or drain electrode of the second switching transistor is electrically connected to the power line, and the other one is electrically connected to a gate electrode of the driving transistor and one of the electrodes included in the capacitor element. One of a source electrode or drain electrode of the driving transistor is electrically connected to the power line, and the other one is electrically connected to the pixel electrode and the other one of the electrodes included in the capacitor element. One of a source electrode or drain electrode of the AC transistor is electrically connected to the potential control line, and the other one is electrically connected to the pixel electrode and a gate electrode of the AC transistor. In addition, another feature is that each of the first switching transistor, the second switching transistor, the driving transistor, and the AC transistor is an N-channel transistor. The driving transistor may operate in a saturation region, and the first switching transistor, the second switching transistor, and the AC transistor may operate in a linear region.

In the above-described structure, a ratio of channel length L1 to channel width W1 of the third transistor (L1/W1) is preferably larger than a ratio of channel length L2 to channel width W2 of the fourth transistor (L2/W2). More specifically, it is preferable that the channel length of the fourth transistor be shorter than or equal to the channel width thereof, and it is preferable that the ratio of the channel length to the channel width of the third transistor be 5 or more.

In addition, in the above-described structure, it is preferable that the current flowing in the reverse direction to the light emitting element be larger than the current flowing in the forward direction to the light emitting element. A potential of the counter electrode may be a fixed potential, and a potential of the third wiring may be changed depending on a direction in which the current flows to the light emitting element.

In addition, in the above-described structure, the N-channel transistor may be a transistor using amorphous silicon.

In addition, the above-described structure may be applied to an electronic device using a display device.

One feature of the present invention is that a light emitting element is formed over a large-area substrate provided with a pixel portion (or a driving circuit) including an N-channel TFT using amorphous silicon as an active layer.

With the above-described structure, a constant current can flow to a light emitting element when a forward voltage is applied to the light emitting element, and a current sufficient enough to insulate a short-circuited point can flow to the short-circuited point when a reverse voltage is applied to the light emitting element; therefore, the life of the light emitting element can be extended. That is, by applying a reverse voltage to the light emitting element, an initial failure or a progressive failure of the light emitting element can be suppressed, and a decrease in luminance caused by deterioration of an electroluminescent layer can be prevented.

Furthermore, since a driving method using an N-channel transistor is used in the present invention, amorphous silicon can be used. By using amorphous silicon, which is suitable for a mass production process, for an active layer of the transistor, the transistor can be formed over a large-area substrate, and a process of crystallizing a semiconductor film after film formation can be omitted; therefore, manufacturing costs can be reduced. Furthermore, when amorphous silicon is used for an active layer of a transistor, a transistor substrate of amorphous silicon can be manufactured using an existing conventional production line; therefore, an equipment cost can also be reduced.

Furthermore, using N-channel transistors enables a circuit configuration to be constituted by transistors having the same conductivity type. In this way, the manufacturing process can be simplified, the manufacturing costs can be reduced, and a yield can be improved.

DETAILED DESCRIPTION OF THE INVENTION

Hereinafter, embodiment modes of the present invention will be explained with reference to the accompanying drawings. However, the present invention can be carried out in various modes, and it is easily understood by those skilled in the art that the modes and details can be changed in various ways without departing from the spirit and scope of the present invention. Therefore, the present invention is not interpreted as being limited to the following description of the embodiment modes. It is to be noted that, in the structure of the present invention described below, the same numerals denoting the same objects may be used in common in different drawings, and the repeated description may be omitted.

Embodiment Mode 1

(Circuit Configuration 1)

Figure 1:
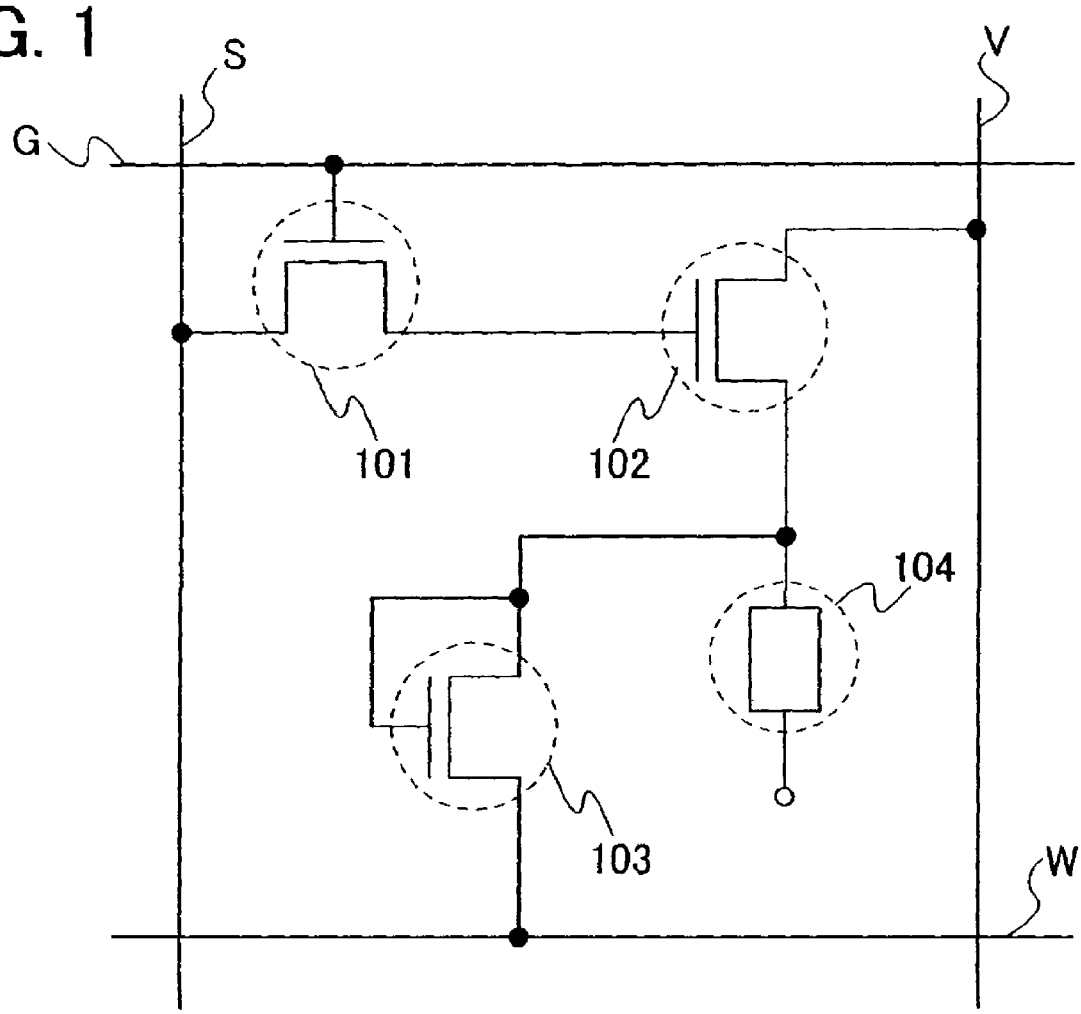
FIG. 1 is a circuit diagram of a pixel used in a display device of the present invention.

In FIG. 1, an embodiment mode of a circuit constituting a pixel is shown as a circuit configuration (also referred to as a pixel configuration) diagram of the present invention.

A circuit constituting a pixel shown in FIG. 1 includes a light emitting element 104, a transistor used as a switching element for controlling the input of a video signal to the pixel (a switching transistor 101), a transistor that controls the value of a current flowing to the light emitting element 104 (a driving transistor 102), and a transistor that applies a reverse bias current to the light emitting element 104 when a reverse voltage is applied to the light emitting element 104 (an AC transistor 103). The switching transistor 101, the driving transistor 102, and the AC transistor 103 have the same conductivity type, and an N-type transistor is used for each of these transistors, which is a characteristic of the present invention. Although a capacitor element is not provided in this embodiment mode, a capacitor element for maintaining a potential of a video signal may be provided.

As shown in FIG. 1, a gate electrode of the switching transistor 101 is connected to a scanning line G. One of a source electrode or drain electrode of the switching transistor 101 is connected to a signal line S, and the other one is connected to a gate electrode of the driving transistor 102. One of a source electrode or drain electrode of the driving transistor 102 is connected to a power line V, and the other one is connected to a pixel electrode of the light emitting element 104.

In addition, in this embodiment mode, one of a source electrode or drain electrode of the AC transistor 103 is connected to a potential control line W, and the other one is connected to the pixel electrode of the light emitting element 104. A gate electrode of the AC transistor 103 is connected to the source electrode or drain electrode of the AC transistor 103, which is connected to the pixel electrode of the light emitting element 104.

It is to be noted that, in this specification, "be connected" means "be electrically connected", unless otherwise specified.

In addition, in this specification, a potential control line is a wiring that changes a potential in order to control an AC transistor.

When the switching transistor 101 is in a non-select state (an off state), a gate potential of the driving transistor 102 is maintained by a gate capacitance of the driving transistor 102. It is to be noted that, although a configuration in which the gate potential is maintained by the gate capacitance of the driving transistor 102 without a capacitor element being provided is shown in FIG. 1, the present invention is not limited to this configuration, and a configuration in which the capacitor element is provided may also be employed.

Furthermore, in this embodiment mode, L/W, a ratio of channel length L to channel width W, of the driving transistor 102 is larger than L/W of the AC transistor 103. Specifically, as for the driving transistor 102, L is larger than W, and more preferably, the ratio is 5/1 or more. As for the AC transistor 103, L is shorter than or equal to W. In this way, the value of a current flowing in a reverse direction when a reverse voltage is applied to the light emitting element 104 in the pixel can be larger than the value of a current flowing in a forward direction when a forward voltage is applied to the light emitting element 104.

The light emitting element 104 includes an anode and a cathode. In this specification, the cathode is referred to as a counter electrode in the case where the anode is used as a pixel electrode, and the anode is referred to as a counter electrode in the case where the cathode is used as a pixel electrode.

Here, it can be said that the switching transistor preferably has a structure with a smaller leakage current (an off-state current and a gate leakage current). It is to be noted that an off-state current is a current that flows between a source and a drain when a transistor is off, and a gate leakage current is a current that flows between a gate and a source or between a gate and a drain via a gate insulating film.

Accordingly, an N-channel transistor used as the switching transistor 101 preferably has a structure provided with a low concentration impurity region (also referred to as a Lightly Doped Drain: LDD region), because a transistor having a structure provided with an LDD region can reduce an off-state current. In addition, because the switching transistor 101 needs to increase an on-state current when applying a current to the light emitting element 104.

As an even more preferable mode, an LDD region is provided in the switching transistor 101, and the LDD region includes a region overlapping a gate electrode. Then, the switching transistor 101 can increase an on-state current, and decrease generation of a hot electron. Accordingly, reliability of the switching transistor 101 improves.

In addition, reliability of the driving transistor 102 also improves by providing the driving transistor 102 with an LDD region overlapping a gate electrode.

Furthermore, an off-state current can be reduced by decreasing a film thickness of a gate insulating film. Accordingly, the film thickness of the switching transistor 101 may be made thinner than the film thickness of the driving transistor 102.

Furthermore, by forming the switching transistor 101 as a transistor with a multi-gate structure such as a double-gate structure, a gate leakage current can be reduced. Also in the driving transistor 102, by employing a multi-gate structure such as a double-gate structure, a gate leakage current can be reduced, and the reliability can be improved.

In particular, if an off-state current flows to the switching transistor 101, gate capacitance of the driving transistor 102 cannot maintain a voltage which is written during a writing period. Therefore, it is preferable that an off-state current be reduced by providing an LDD region, thinning a gate insulating film, or employing a multi-gate structure in the switching transistor 101.

It is to be noted that, throughout this specification, a light emitting element (an EL element) means an element having a structure in which an electroluminescent layer (an EL layer) which emits light when an electric field is generated is interposed between an anode and a cathode, however, the present invention is not limited thereto.

In addition, in this specification, the light emitting element means both an element that utilizes light (fluorescence) emitted when a singlet exciton returns to a ground state, and an element that utilizes light (phosphorescence) emitted when a triplet exciton returns to a ground state.

As an electroluminescent layer, a hole injecting layer, a hole transporting layer, a light emitting layer, an electron transporting layer, an electron injecting layer, or the like can be given. The basic structure of a light emitting element is a stack of an anode, a light emitting layer, and a cathode in this order. In addition to this, there are a structure of stacking an anode, a hole injecting layer, a light emitting layer, an electron injecting layer, and a cathode in this order, a structure of stacking an anode, a hole injecting layer, a hole transporting layer, a light emitting layer, an electron transporting layer, an electron injecting layer, and a cathode in this order, and the like.

It is to be noted that the electroluminescent layer is not limited to a layer having a stacked-layer structure in which the hole injecting layer, the hole transporting layer, the light emitting layer, the electron transporting layer, the electron injecting layer, and the like are clearly distinguished. That is, the electroluminescent layer may have a structure including a layer in which respective materials for forming the hole injecting layer, the hole transporting layer, the light emitting layer, the electron transporting layer, the electron injecting layer, and the like are mixed. Furthermore, an inorganic material may be mixed as well.

Furthermore, any material of a low molecular material, a high molecular material, and a medium molecular material can be used for the electroluminescent layer of a light emitting element.

It is to be noted that, in this specification, a medium molecular material does not have the subliming property, and the number of molecules thereof is 20 or less or a molecular chain length thereof is 10 μm or less.

Next, an operation of the circuit configuration in FIG. 1 will be described with reference to FIGS. 2A to 2C.

Figure 2A:
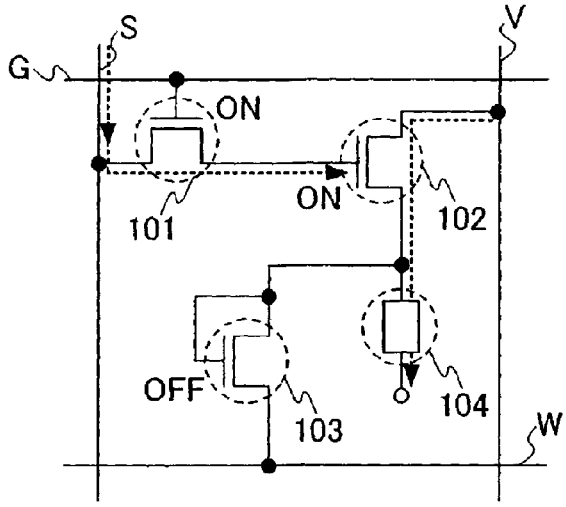
FIGS. 2A to 2C are circuit diagrams of a pixel used in a display device of the present invention.

First, during a writing period of FIG. 2A, the switching transistor 101 having the gate electrode connected to the scanning line G is turned on when the scanning line G is selected. Then, a potential Vsig of a video signal input to the signal line S is input to the gate electrode of the driving transistor 102 via the switching transistor 101, and a gate potential of the driving transistor 102 is maintained by a gate capacitance of the driving transistor 102. In addition, the driving transistor 102 is turned on by the potential Vsig of the video signal, so that a forward bias current flows to the light emitting element 104 and the light emitting element 104 emits light.

Specifically, a potential Vdd is supplied to the power line V, and a potential Vss is supplied to the counter electrode of the light emitting element 104, then the light emitting element 104 emits light. At this time, the potential Vss and the potential Vdd applied to the power line V satisfy Vss<Vdd, and GND (a ground potential), 0 V, or the like may be applied as the potential Vss, for example.

On the other hand, during this writing period, a potential Vdd2 of the potential control line W is set to be higher than the potential Vss of the counter electrode of the light emitting element 104 (that is, Vdd2>Vss is satisfied). Therefore, the electrode of the AC transistor 103, connected to the potential control line W, becomes the drain electrode, and the electrode of the AC transistor 103, connected to the pixel electrode of the light emitting element 104, becomes the source electrode. Furthermore, since the source electrode is connected to the gate electrode of the AC transistor 103, the AC transistor 103 is off.

It is to be noted that, although the description is made for the case where the driving transistor 102 is turned on by the potential Vsig of the video signal during the writing period, in the case where the driving transistor 102 is turned off by the potential Vsig of the video signal, no current is supplied to the light emitting element 104 and the light emitting element 104 does not emit light.

In this specification, "a transistor is on" means that a source electrode and a drain electrode thereof are electrically conducted by the gate voltage. In addition, "a transistor is off" means that a source electrode and a drain electrode thereof are not electrically conducted by the gate voltage.

Furthermore, in this specification, "applying a reverse voltage to a light emitting element" means that a reverse voltage with respect to a forward voltage is applied, and a reverse bias current flows to the light emitting element, and light is not emitted.

Figure 2B:
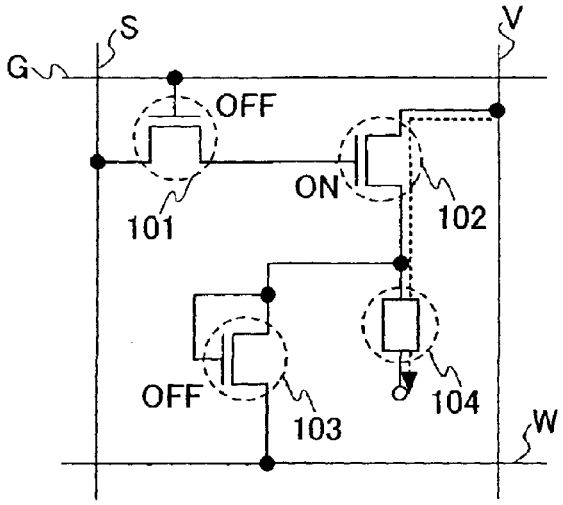

Next, during a display period of FIG. 2B, the switching transistor 101 is turned off by controlling a potential of the scanning line G. Since the potential Vsig of the video signal which is written during the writing period is maintained by the gate capacitance of the driving transistor 102, the driving transistor 102 is on. Accordingly, a forward bias current flows to the light emitting element 104, and the light emitting element 104 emits light.

Specifically, in the same way as the writing period, the potential Vdd is supplied to the power line V, and the potential Vss is supplied to the counter electrode of the light emitting element 104, then the light emitting element 104 emits light. At this time, the potential Vss and the potential Vdd applied to the power line V satisfy Vss<Vdd, and GND (a ground potential), 0 V, or the like may be applied as the potential Vss, for example.

On the other hand, in the same way as the writing period, the potential Vdd2 of the potential control line W is set to be higher than the potential Vss of the counter electrode of the light emitting element 104 (that is, Vdd2>Vss is satisfied). Therefore, the AC transistor 103 is off.

It is to be noted that, although the description is made for the case where the driving transistor 102 is turned on by the potential Vsig of the video signal during the writing period, in the case where the driving transistor 102 is turned off by the potential Vsig of the video signal, no current is supplied to the light emitting element 104. Therefore, no current is supplied to the light emitting element 104 even during the display period, in this case.

Figure 2C:
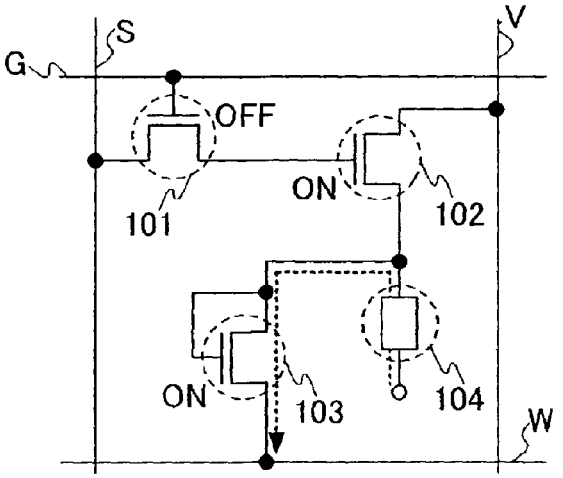

Next, during a reverse bias period (non-lighting period) of FIG. 2C, a potential of the scanning line G is controlled so that the switching transistor 101 is off.

On the other hand, by setting a potential Vss2 of the potential control line W to be lower than the potential Vss of the counter electrode of the light emitting element 104 (that is, Vss>Vss2 is satisfied), the electrode of the AC transistor 103, connected to the potential control line W, becomes the source electrode, and the electrode connected to the pixel electrode of the light emitting element 104 becomes the drain electrode. Furthermore, since the drain electrode is connected to the gate electrode of the AC transistor 103, the AC transistor 103 is turned on. Accordingly, a reverse voltage is applied to the light emitting element 104, and a reverse bias current flows in the light emitting element 104 and the AC transistor 103.

In the case where the driving transistor 102 is on due to the potential Vsig of the video signal during the writing period and the display period, the gate capacitance maintains the potential of the video signal, so that the driving transistor is on also during a reverse bias period. Accordingly, a forward bias current flows (not shown in the diagram) to the driving transistor 102, but most of the current flows into the AC transistor 103; therefore, the operation is not particularly affected. In addition, as described above, in the case where L/W of the driving transistor 102 is larger than L/W of the AC transistor 103, the channel width W of the AC transistor 103 becomes wide, and a bias current flowing to the driving transistor 102 in a forward direction easily flows to the AC transistor 103. Of course, in the case where the driving transistor 102 is in off during the writing period and the display period, no current is supplied to the driving transistor 102.

It is to be noted that, as described above, a current flowing to the AC transistor 103 can be made larger than a current flowing to the driving transistor 102 by making L/W of the driving transistor 102 larger than L/W of the AC transistor 103. In other words, the value of a reverse bias current becomes larger than the value of a forward bias current, and a large current can flow to the light emitting element 104 during a reverse bias period.

In addition, a potential difference between Vss2 and Vss during the reverse bias period may be larger than a potential difference between Vdd and Vss during the display period. In this way, the value of a reverse bias current becomes larger than the value of a forward bias current, and an even larger current can flow to the light emitting element 104 during the reverse bias period.

It is to be noted that, although a potential of the counter electrode of the light emitting element 104 and a potential of the power line V each are a fixed potential in this embodiment mode, the present invention is not limited thereto. For example, just the potential of the counter electrode of the light emitting element 104 may be changed, or both the potential of the power line V and the potential of the counter electrode of the light emitting element 104 may be changed.

Next, a method for expressing a gray scale in a pixel having such a structure will be described.

The method for expressing a gray scale can be mainly divided into an analog method and a digital method. Compared to the analog method, the digital method has advantages in that it is not easily affected by variation in transistors and it is suitable for increasing gray scales. Although the analog method is limited by the variation in transistors, the digital method is capable of extremely homogeneous gray scale display even with some variation in TFTs.

As an example of a digital gray scale expressing method, a time gray scale method is known. This driving method expresses a gray scale by controlling a period in which each pixel of a display device emits light.

When a period of displaying an image is set as one frame period, the one frame period can be divided into a plurality of subframe periods.

For every subframe period, by keeping a light emitting element in each pixel lighting or non-lighting, that is, by making a light emitting element in each pixel emit light or not emit light, a period in which the light emitting element emits light per one frame period is controlled; thereby expressing a gray scale of each pixel.

Figure 3:
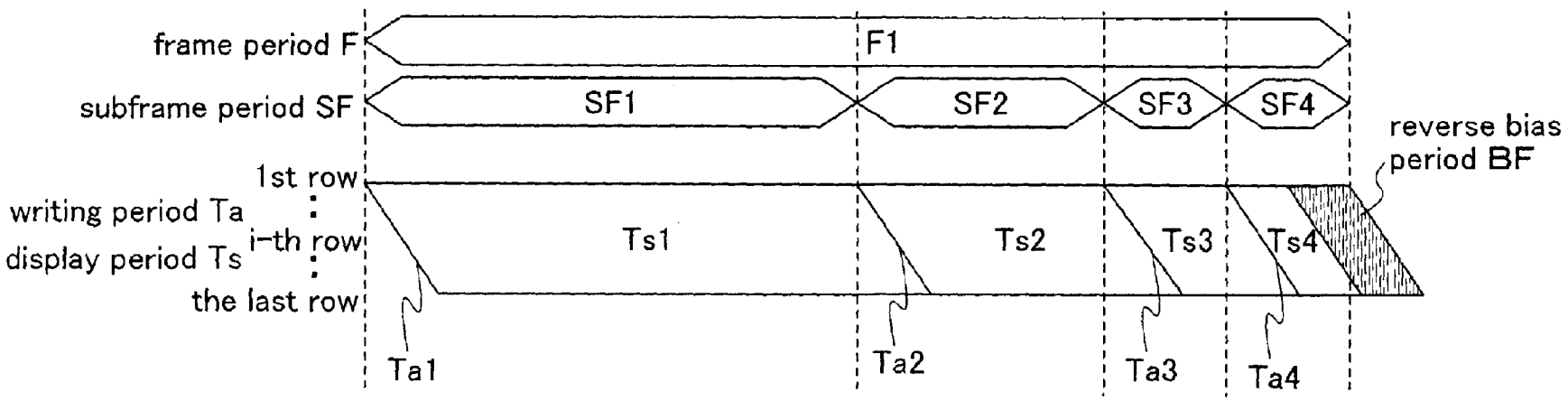
FIG. 3 is a diagram showing a timing chart of the case where a digital time gray scale method is performed in a display device of the present invention.

A driving method of a digital time gray scale method using the pixel shown in FIG. 1 will be described with reference to a timing chart in FIG. 3. In FIG. 3, a reverse voltage is applied to the light emitting element 104 in the fourth bit, as a reverse bias period (a non-lighting period) BF.

When image display is performed using a display device of the present invention, a rewriting operation and a displaying operation of a screen are carried out repeatedly during a display period. The number of rewriting operations is not particularly limited; however, the rewriting operations are preferably performed at least approximately sixty times per second so that a person who watches the image does not find flickering. Here, a period of carrying out the rewriting operation and displaying operation of one screen (one frame) is referred to as one frame period F1 including a reverse bias period.

One frame period F1 is time-divided into four subframe periods SF1, SF2, SF3, and SF4 including writing periods Ta1, Ta2, Ta3, and Ta4, display periods Ts1, Ts2, Ts3, and Ts4, and the reverse bias period BF, as shown in FIG. 3. A light emitting element which receives a signal for light emission is in a light emitting state during the display period. The length ratio of the display period of each subframe period is, the first subframe period Ta1:the second subframe period Ta2:the third subframe period Ta3:the fourth subframe period Ta4=$2^3$:$2^2$:$2^1$:$2^0$=8:4:2:1. Accordingly, a 4-bit gray scale can be realized. The number of bits and gray scale levels are not limited thereto. For example, an 8-bit gray scale can be offered by providing eight subframe periods.

The above-described operations of the writing period and the display period are repeated for all the subframe periods SF1 to SF4, and the reverse bias period BF is added in the SF4; whereby the one frame period F1 is completed. Here, lengths of the display periods Ts1 to Ts4 in the subframe periods SF1 to SF4 are appropriately set, and the gray scale is expressed by an accumulated total of the display periods in the subframe periods SF1 to SF4 in which the light emitting element 104 emits light per one frame period F1. In other words, the gray scale is expressed by a sum total of the lighting time in the one frame period F1.

It is to be noted that each of the subframe periods SF1 to SF4 may be placed in one frame unconsecutively. In addition, one subframe period may further include a plurality of subframe periods, and the plurality of the subframe periods may be placed in one frame unconsecutively. In the case where a gray scale is expressed using a time gray scale method, the number of subframes is not particularly limited. Furthermore, the length of a lighting period in each subframe period, or in which subframe light is emitted is not particularly limited. That is, a method for selecting a subframe is not particularly limited.

Figure 4:
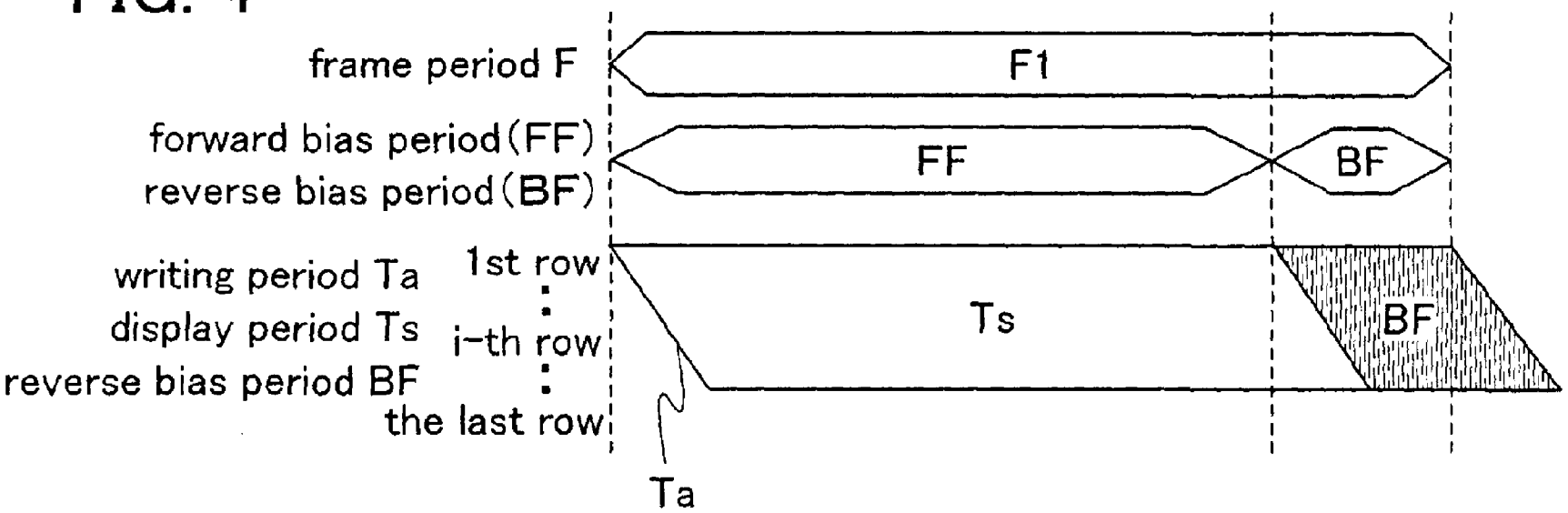
FIG. 4 is a diagram showing a timing chart of the case where gray scale display is performed using an analog method in a display device of the present invention.

Furthermore, in the case where the pixel in FIG. 1 is driven by an analog method, a period in which a forward voltage is applied to the light emitting element, which is a forward bias period FF, and a period in which a reverse voltage is applied, which is a reverse bias period BF may be provided in one frame period F1, as shown in FIG. 4. In the forward bias period FF, an analog video signal is written to each pixel (Ta: a writing period), so that the light emitting element 104 emits or does not emit light (Ts: a display period).

As described above, with the configuration of the present invention, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

Embodiment Mode 2

In this embodiment mode, a structure of a display, constituting the display device which is manufactured using Embodiment Mode 1 described above, will be described.

The display device includes a display and a peripheral circuit which inputs a signal to the display.

Figure 5:
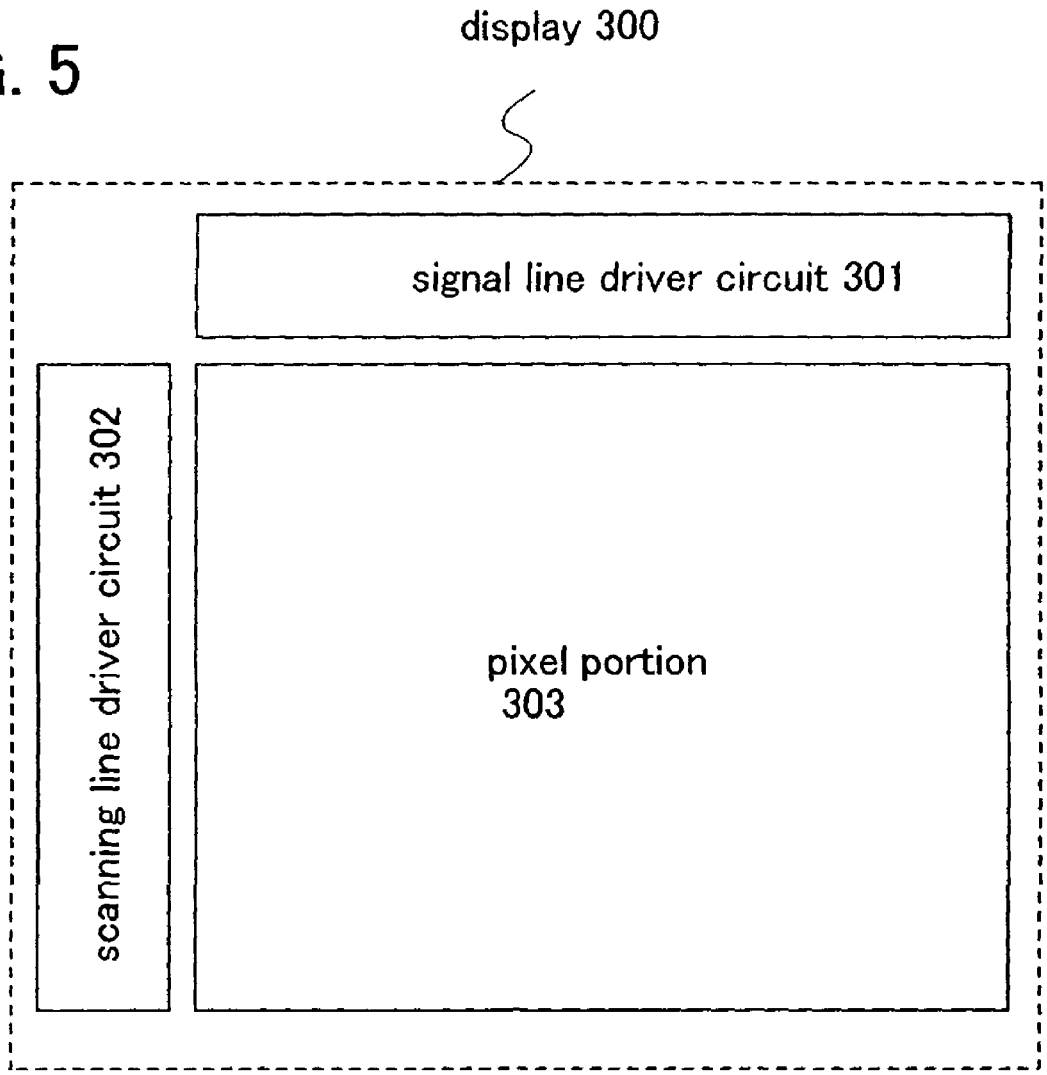
FIG. 5 is a view describing a display of the present invention.

A block diagram of a display structure is shown in FIG. 5. In FIG. 5, a display 300 includes a signal line driver circuit 301, a scanning line driver circuit 302, and a pixel portion 303. The pixel portion 303 has a structure in which pixels are arranged in a matrix.

A thin film transistor (hereinafter referred to as a TFT) is placed in each pixel in the pixel portion 303. Here, a description will be made of a display in which three TFTs are arranged for each pixel, using the circuit configuration described in Embodiment Mode 1 above, and in which a light emitting element is provided in each pixel.

Figure 6:
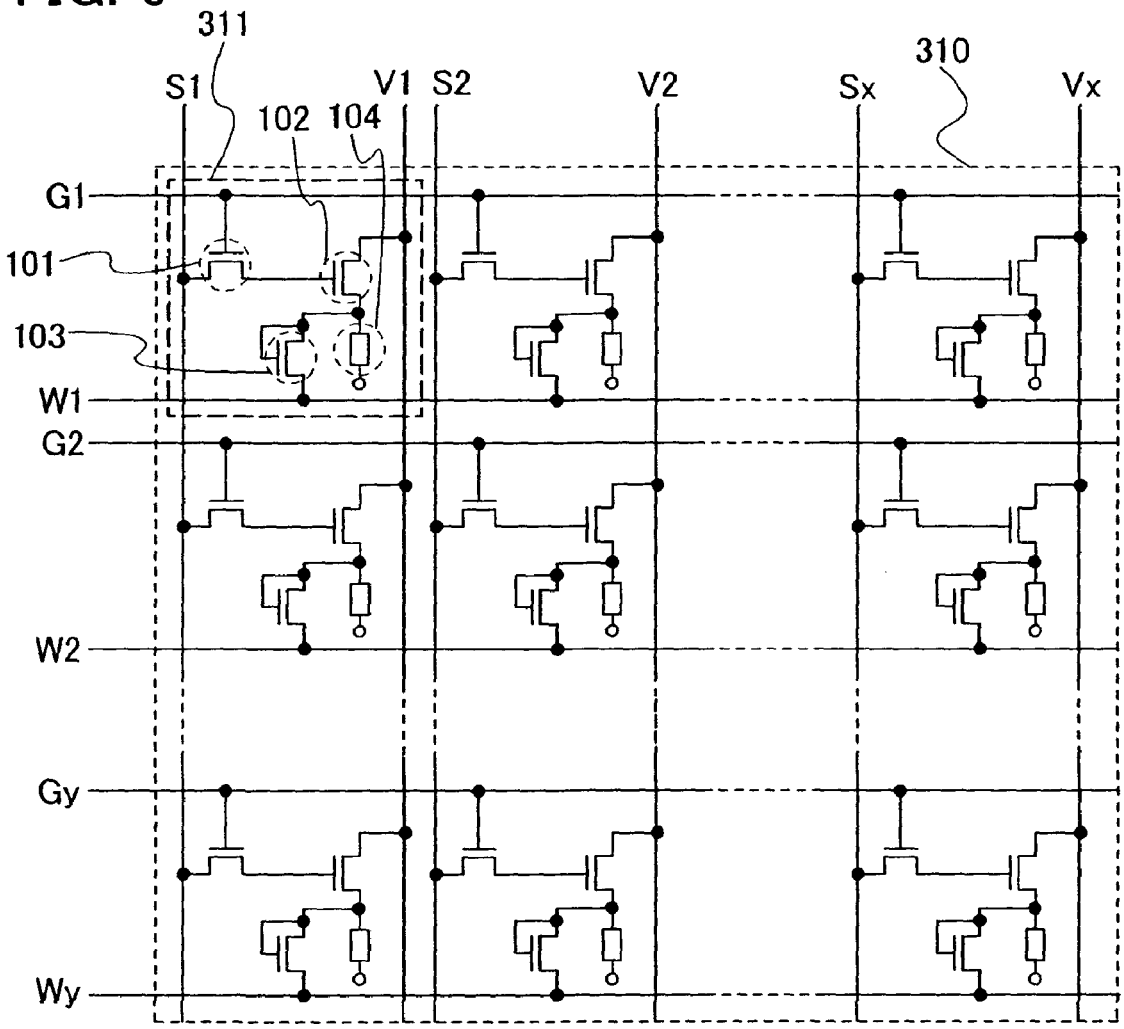
FIG. 6 is a diagram showing a configuration of a pixel portion of a display of the present invention.

A structure of the pixel portion in the display is shown in FIG. 6. In the pixel portion 310, signal lines S1 to Sx, scanning lines G1 to Gy, power lines V1 to Vx, and potential control lines W1 to Wy are arranged, and pixels for x (x is a natural number) columns and y (y is a natural number) rows are arranged. Each pixel 311 includes a switching transistor 101, a driving transistor 102, an AC transistor 103, and a light emitting element 104.

The pixel 311 shown in FIG. 6 corresponds to FIG. 1, and includes one signal line S1 out of the signal lines S1 to Sx, one scanning line G1 out of the scanning lines G1 to Gy, one power line V1 out of the power lines V1 to Vx, one potential control line W1 out of the potential control lines W1 to Wx, the switching transistor 101, the driving transistor 102, the AC transistor 103, and the light emitting element 104.

By combining the above-described structure with the present invention, the life of the light emitting element can be extended. Furthermore, by using a pixel constituted by N-type transistors, a display device and a display which are inexpensive can be manufactured.

It is to be noted that, although the circuit configuration of FIG. 1 described in Embodiment Mode 1 is used in this embodiment mode, the present invention is not limited thereto, and this embodiment mode can be carried out in combination with the other embodiment modes and embodiments.

Embodiment Mode 3

(Circuit Configuration 2)

In this embodiment mode, a configuration different from the circuit configuration of FIG. 1 described in Embodiment Mode 1 will be described.

Figure 7:
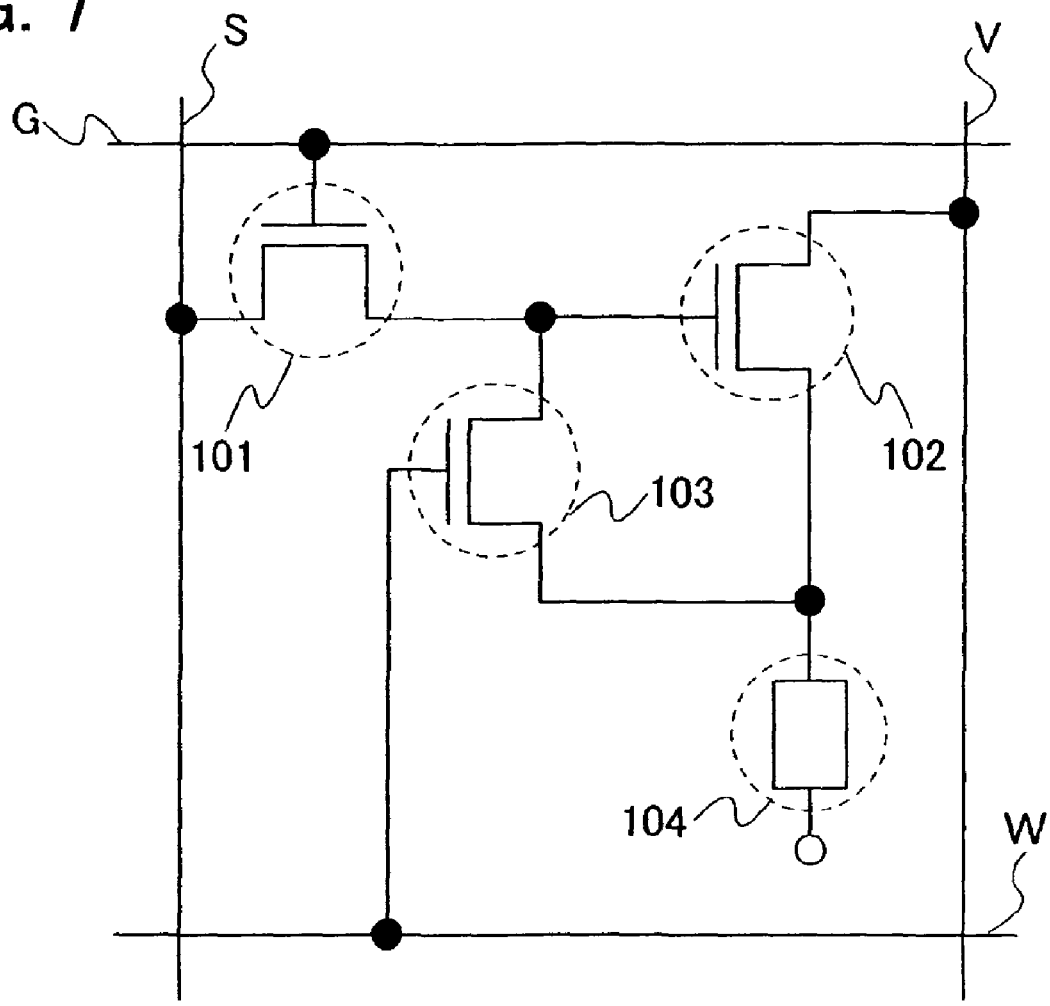
FIG. 7 is a circuit diagram of a pixel used in a display device of the present invention.

A circuit constituting a pixel shown in FIG. 7 includes a light emitting element 104, a transistor used as a switching element for controlling the input of a video signal to a pixel (a switching transistor 101), a transistor that controls the value of a current flowing to the light emitting element 104 (a driving transistor 102), and a transistor that applies a reverse bias current to the light emitting element 104 when a reverse voltage is applied to the light emitting element 104 (an AC transistor 103). The switching transistor 101, the driving transistor 102, and the AC transistor 103 have the same conductivity type, and an N-type transistor is used for each of these transistors, which is a characteristic of the present invention. Although a capacitor element is not provided in this embodiment mode, a capacitor element for maintaining a potential of a video signal may be provided.

As shown in FIG. 7, a gate electrode of the switching transistor 101 is connected to a scanning line G. One of a source electrode or drain electrode of the switching transistor 101 is connected to a signal line S, and the other one is connected to a gate electrode of the driving transistor 102. One of a source electrode or drain electrode of the driving transistor 102 is connected to a power line V, and the other one is connected to a pixel electrode of the light emitting element 104.

Furthermore, in this embodiment mode, one of a source electrode or drain electrode of the AC transistor 103 is connected to the gate electrode of the driving transistor 102, and the other one is connected to the pixel electrode of the light emitting element 104 and one of the source electrode or drain electrode of the driving transistor 102. A gate electrode of the AC transistor 103 is connected to a potential control line W.

When the switching transistor 101 is in a non-select state (an off state), a gate potential of the driving transistor 102 is maintained by a gate capacitance of the driving transistor 102. It is to be noted that, although a configuration in which the gate potential is maintained by the gate capacitance of the driving transistor 102 without a capacitor element being provided is shown in FIG. 7, the present invention is not limited to this configuration, and a configuration in which the capacitor element is provided may also be employed.

Here, it can be said that the switching transistor preferably has a structure with a smaller leakage current (an off-state current and a gate leakage current). It is to be noted that an off-state current is a current that flows between a source and a drain when a transistor is off, and a gate leakage current is a current that flows between a gate and a source or between a gate and a drain via a gate insulating film.

Accordingly, an N-channel transistor used as the switching transistor 101 is preferably has a structure with a low concentration impurity region (also referred to as a Lightly Doped Drain: LDD region), because a transistor having a structure with an LDD region can reduce an off-state current. In addition, the switching transistor 101 needs to increase an on-state current when applying a current to the light emitting element 104.

As an even more preferable mode, an LDD region is provided in the switching transistor 101, and the LDD region includes a region overlapping a gate electrode. Then, the switching transistor 101 can increase an on-state current, and decrease generation of a hot electron. Accordingly, reliability of the switching transistor 101 improves.

In addition, reliability of the driving transistor 102 also improves by providing the driving transistor 102 with an LDD region overlapping a gate electrode.

Furthermore, an off-state current can be reduced by decreasing a film thickness of a gate insulating film. Accordingly, the film thickness of the switching transistor 101 may be made thinner than the film thickness of the driving transistor 102.

Furthermore, by forming the switching transistor 101 as a transistor with a multi-gate structure such as a double-gate structure, a gate leakage current can be reduced. Also in the driving transistor 102, by employing a multi-gate structure such as a double-gate structure, a gate leakage current can be reduced, and the reliability can be improved.

In particular, if an off-state current flows to the switching transistor 101, gate capacitance of the driving transistor 102 cannot maintain a voltage which is written during a writing period. Therefore, it is preferable that an off-state current be reduced by providing an LDD region, thinning a gate insulating film, or employing a multi-gate structure in the switching transistor 101.

Next, an operation of the circuit configuration in FIG. 7 will be described with reference to FIGS. 8A to 8C.

Figure 8A:
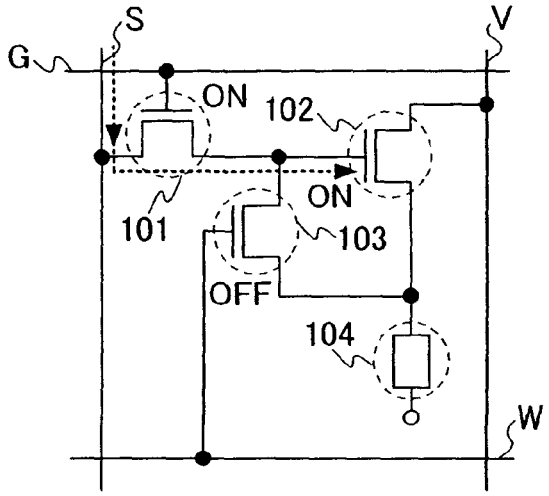
FIGS. 8A to 8C are circuit diagrams of a pixel used in a display device of the present invention.

First, during a writing period of FIG. 8A, the switching transistor 101 having the gate electrode connected to the scanning line G is turned on when the scanning line G is selected. Then, a potential Vsig of a video signal input to the signal line S is input to the gate electrode of the driving transistor 102 via the switching transistor 101, and a gate potential is maintained by a gate capacitance of the driving transistor 102.

A potential Vss1 of the power line V is set to be lower than or equal to a potential Vss of a counter electrode of the light emitting element 104 (that is, Vss≧Vss1 is satisfied), so that the light emitting element 104 does not emit light. As the potential Vss, GND (a ground potential), 0 V, or the like may be applied, for example. In addition, a reverse bias current flows to the light emitting element 104 by a potential difference between the set Vss1 and Vss (however, when Vss1 and Vss are the same potential, the reverse bias current does not flow).

On the other hand, during this writing period, a potential Vss2 of the potential control line W is set to be low enough to make the AC transistor 103 be off.

It is to be noted that, although the description is made for the case where the driving transistor 102 is turned on by the potential Vsig of the video signal during the writing period, also in the case where the driving transistor 102 is turned off by the potential Vsig of the video signal, no current is supplied to the light emitting element 104 and the light emitting element 104 does not emit light.

Figure 8B:
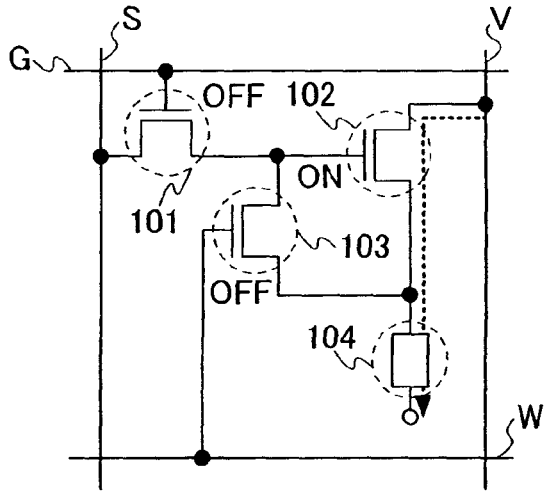

Next, during a display period of FIG. 8B, the switching transistor 101 is turned off by controlling a potential of the scanning line G Since the potential Vsig of the video signal which is written during the writing period is maintained by the gate capacitance of the driving transistor 102, the driving transistor 102 is on.

In addition, a potential Vdd1 of the power line V is set to be higher than the potential Vss of the counter electrode of the light emitting element 104 (that is, Vdd1>Vss is satisfied), so that a forward bias current flows to the light emitting element 104, and the light emitting element 104 emits light.

On the other hand, in the same way as the writing period, a potential Vss2 of the potential control line W is set to be low enough to make the AC transistor 103 be off.

Although the description is made for the case where the driving transistor 102 is turned on by the potential Vsig of the video signal during the writing period, in the case where the driving transistor 102 is turned off by the potential Vsig of the video signal, no current is supplied to the light emitting element 104. Therefore, no current is supplied to the light emitting element 104 even during the display period, in this case.

Figure 8C:
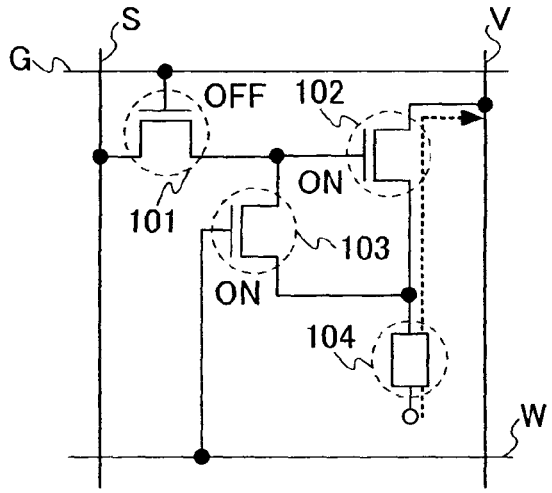

Next, during a reverse bias period (non-lighting period) of FIG. 8C, the potential of the scanning line G is controlled so that the switching transistor 101 is off.

In addition, a potential Vss3 of the power line V is set to be lower than the potential Vss of the counter electrode of the light emitting element 104. That is, in the case where the driving transistor 102 is turned on by setting the potential to satisfy Vss>Vss3, the electrode of the driving transistor 102, connected to the power line V, becomes the source electrode, and the electrode of the driving transistor 102, connected to the pixel electrode of the light emitting element 104, becomes the drain electrode.

In order that the value of the reverse bias current during the reverse bias period becomes larger than the value of a forward bias current during the display period, a potential difference between Vss3 and Vss is preferably larger than a potential difference between Vdd1 and Vss during the display period. In this way, the value of a reverse bias current can be large, and a large current can flow to the light emitting element 104 during the reverse bias period.

Furthermore, a potential Vdd2 of the potential control line W is set to be high enough to turn on the AC transistor 103. In this way, the gate electrode and the drain electrode of the driving transistor 102 have the same potential, and the driving transistor 102 is turned on. Accordingly, a reverse bias current flows to the driving transistor 102, and a reverse bias current also flows to the light emitting element 104. That is, a reverse voltage is applied to the light emitting element 104.

It is to be noted that, although the potential of the counter electrode of the light emitting element 104 is a fixed potential in this embodiment mode, the present invention is not limited thereto. For example, just the potential of the counter electrode of the light emitting element 104 may be changed, or both the potential of the power line V and the potential of the counter electrode of the light emitting element 104 may be changed.

Next, a driving method of a digital time gray scale method using the pixel shown in FIG. 7 will be described with reference to timing charts in FIGS. 9A and 9B.

Figure 9A:
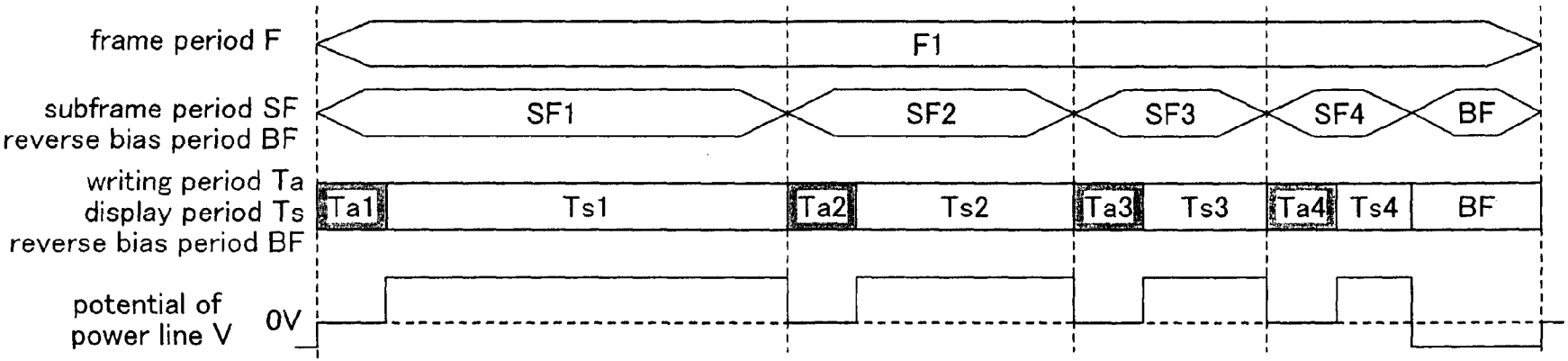
FIGS. 9A and 9B are diagrams each showing a timing chart of the case where a digital time gray scale method is performed in a display device of the present invention.
Figure 9B:
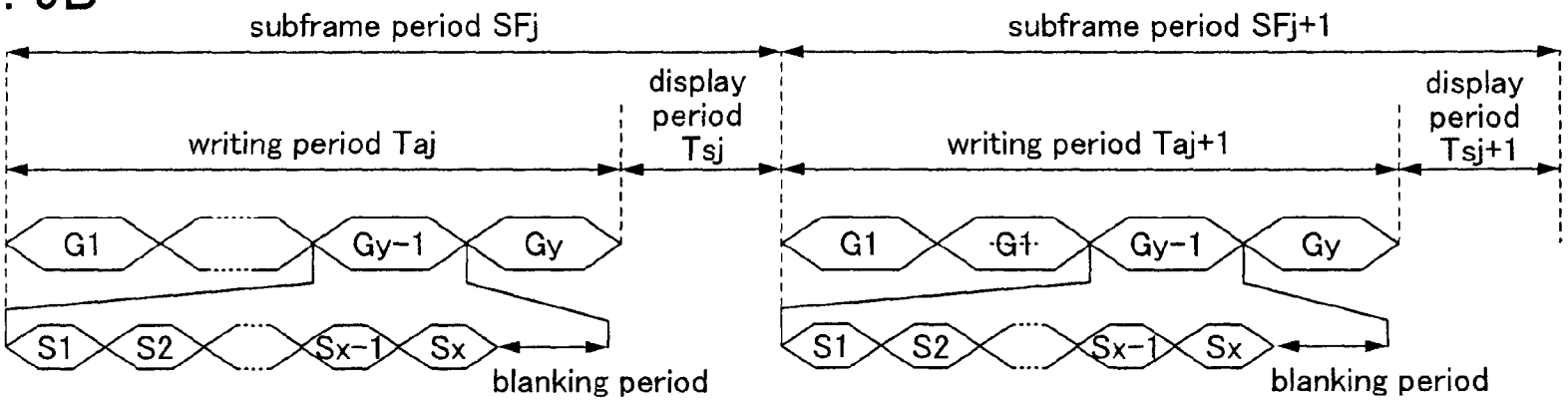

One frame period F1 is time-divided into four subframe periods SF1, SF2, SF3, and SF4 including writing periods Ta1, Ta2, Ta3, and Ta4, and display periods Ts1, Ts2, Ts3, and Ts4; and a reverse bias period (non-lighting period) BF, as shown in FIG. 9A. A light emitting element which receives a signal for light emission is in a light emitting state during the display period. The length ratio of the display period of each subframe period is, the first subframe period Ta1:the second subframe period Ta2:the third subframe period Ta3:the fourth subframe period Ta4$=2^3:2^2:2^1:2^0=8:4:2:1$. Accordingly, a 4-bit gray scale can be realized. The number of bits and gray scale levels is not limited thereto. For example, an 8-bit gray scale can be offered by providing eight subframe periods.

The above-described operations of the writing period and the display period are repeated for all the subframe periods SF1 to SF4, and the period in which a reverse voltage is applied (the reverse bias period BF) is provided; whereby the one frame period F1 is completed. Here, lengths of the display periods Ts1 to Ts4 in the subframe periods SF1 to SF4 are appropriately set, and the gray scale is expressed by an accumulated total of the display periods in the subframe periods SF1 to SF4 in which the light emitting element 104 emits light per one frame period F1. In other words, the gray scale is expressed by a sum total of the lighting time in the one frame period F1.

It is to be noted that each of the subframe periods SF1 to SF4 may be placed in one frame unconsecutively. In addition, one subframe period may further include a plurality of subframe periods, and the plurality of the subframe periods may be placed in one frame unconsecutively. In the case where a gray scale is expressed using a time gray scale method, the number of subframes is not particularly limited. Furthermore, the length of a lighting period in each subframe period, or in which subframe light is emitted is not particularly limited. That is, a method for selecting a subframe is not particularly limited.

Figure 23A:
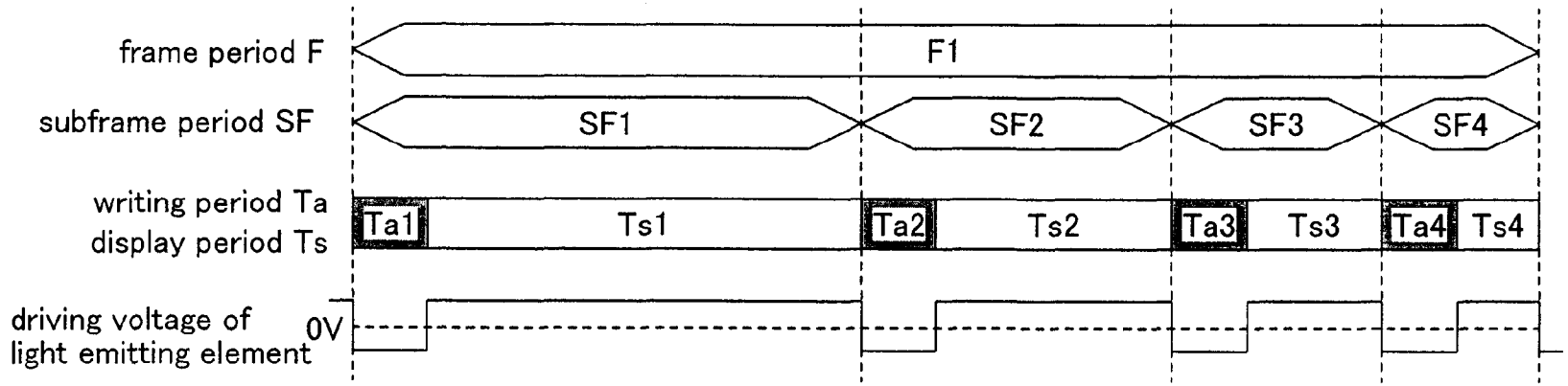
FIGS. 23A and 23B are diagrams each showing a timing chart of the case where a digital time gray scale method is performed in a display device of the present invention.
Figure 23B:
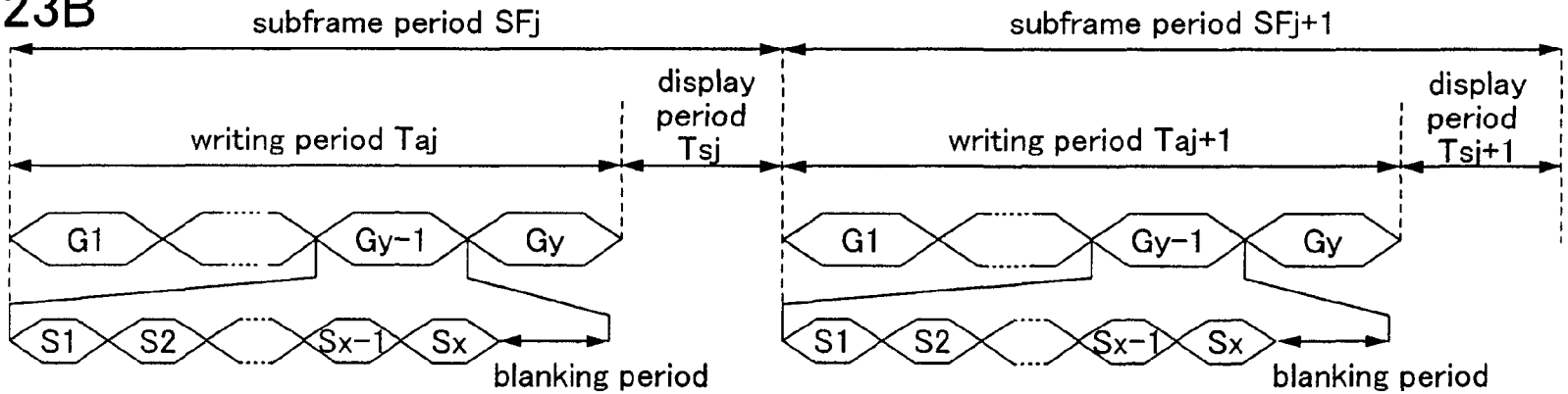

In addition, as shown in FIGS. 23A and 23B, an operation of applying a reverse voltage may be performed concurrently with respective writing periods Ta1 to Ta4, in subframe periods SF1 to SF4 in one frame period F1. That is, in FIGS. 23A and 23B, the writing periods Ta1 to Ta4 are also reverse bias periods in which a reverse voltage is applied, concurrently with performing the writing operation. It is to be noted that the case where a gray scale is expressed using a 4-bit digital video signal is shown in FIGS. 23A and 23B.

Figure 10A:
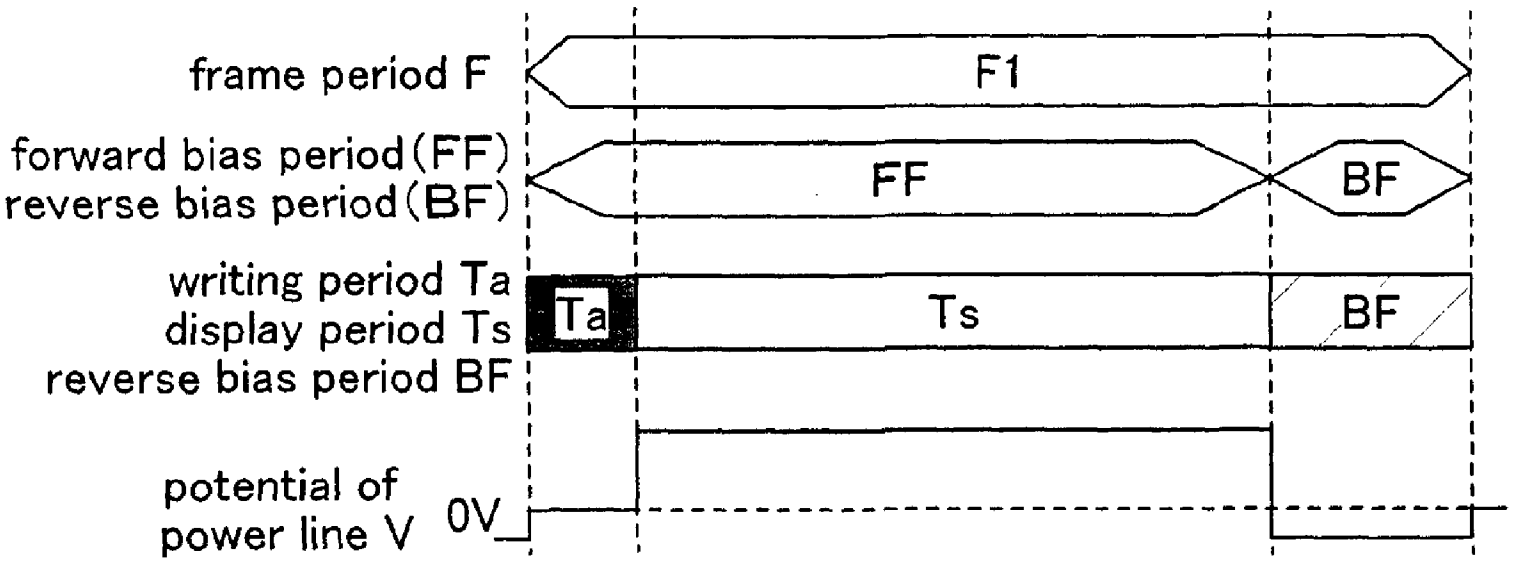
FIGS. 10A and 10B are diagrams each showing a timing chart of the case where gray scale display is performed using an analog method in a display device of the present invention.
Figure 10B:
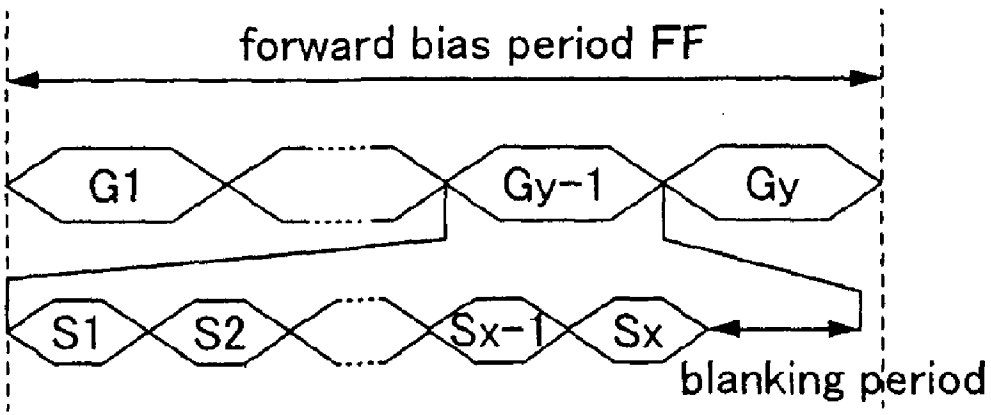

Furthermore, in the case where the pixel in FIG. 7 is driven by an analog method, a period in which a forward voltage is applied to the light emitting element, which is a forward bias period FF, and a period in which a reverse voltage is applied, which is a reverse bias period BF may be provided in one frame period F1, as shown in FIG. 10. The forward bias period FF is time-divided into the writing period Ta and the display period Ts. In the forward bias period FF, an analog video signal may be written to each pixel, so that the light emitting element 104 emits or does not emit light.

As described above, with the configuration of the present invention, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

Embodiment Mode 4

(Circuit Configuration 3)

In this embodiment mode, a configuration different from the circuit configuration of FIG. 1 described in Embodiment Mode 1 will be described.

Figure 11:
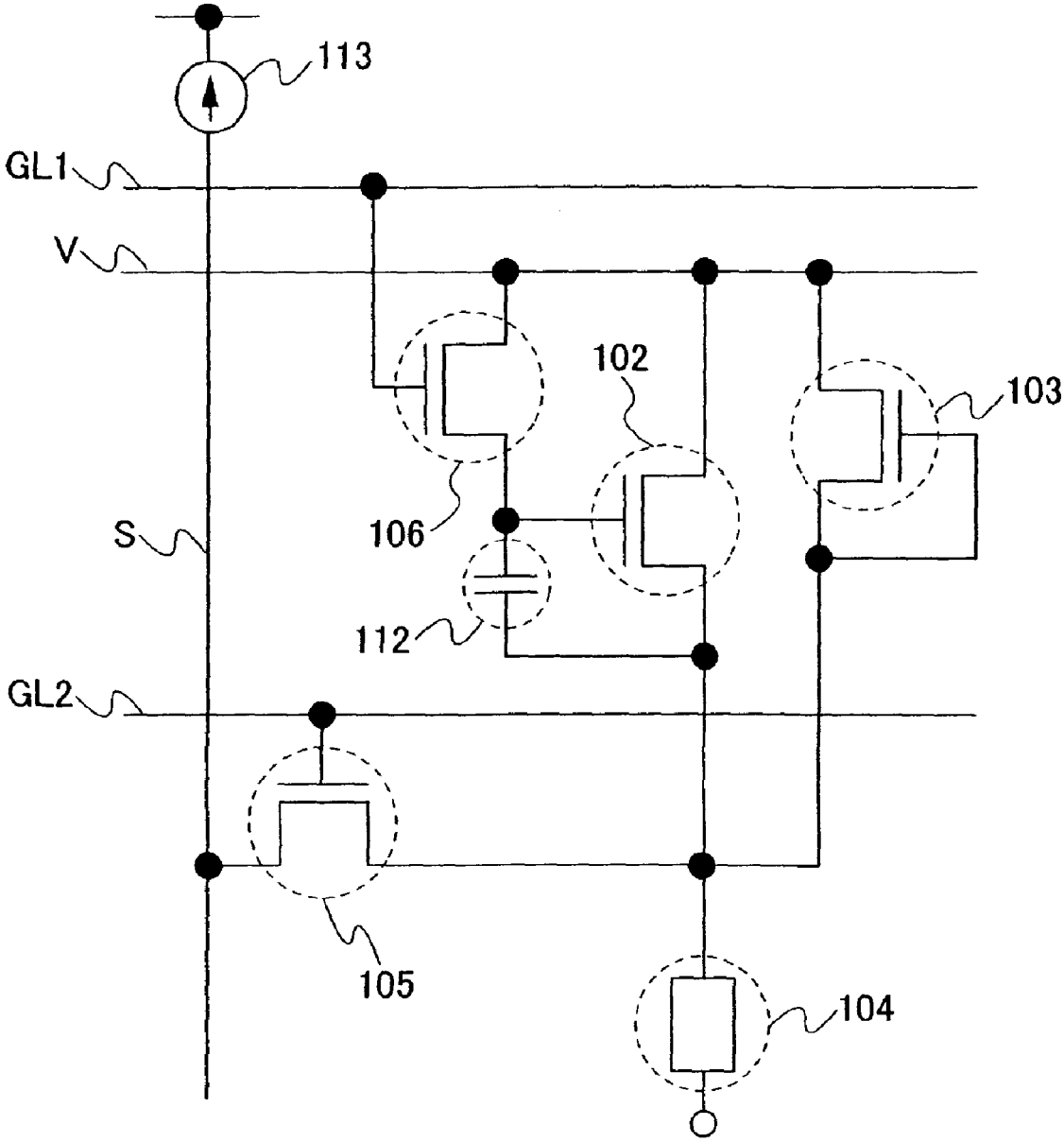
FIG. 11 is a circuit diagram of a pixel used in a display device of the present invention.

A circuit constituting a pixel shown in FIG 11 includes a light emitting element 104, transistors used as switching elements for controlling the input of a video signal to a pixel (a first switching transistor 105 and a second switching transistor 106), a transistor that controls the value of a current flowing to the light emitting element 104 (a driving transistor 102), and a transistor that applies a reverse bias current to the light emitting element 104 when a reverse voltage is applied to the light emitting element 104 (an AC transistor 103). In this embodiment mode, a capacitor element 112 which has two electrodes is provided for maintaining a potential of a video signal. However, when a gate potential of the driving transistor 102 can be maintained by using a gate capacitance of the driving transistor 102 or the like, the capacitor element 112 may be omitted. The first switching transistor 105, the second switching transistor 106, the driving transistor 102, and the AC transistor 103 have the same conductivity type, and an N-type transistor is used for each of these transistors, which is a characteristic of the present invention.

As shown in FIG. 11, a gate electrode of the first switching transistor 105 is connected to a second scanning line GL2. One of a source electrode or drain electrode of the first switching transistor 105 is connected to a signal line S, and the other one is connected to a source electrode or drain electrode of the driving transistor 102. A gate electrode of the second switching transistor 106 is connected to a first scanning line GL1. One of a source electrode or drain electrode of the second switching transistor 106 is connected to a power line V, and the other one is connected to a gate electrode of the driving transistor 102 and to the capacitor element 112. A signal line S is connected to a current source 113.

Furthermore, one of the source electrode or drain electrode of the driving transistor 102 is connected to the power line V, and the other one is connected to a pixel electrode of the light emitting element 104 and to the capacitor element 112. One of the two electrodes of the capacitor element 112 is connected to the gate electrode of the driving transistor 102, and the other one is connected to the source electrode or drain electrode of the driving transistor 102, which is connected to the pixel electrode of the light emitting element 104. The driving transistor 102 is set to operate in a saturation region.

Furthermore, in this embodiment mode, one of a source electrode or drain electrode of the AC transistor 103 is connected to the power line V, and the other one is connected to the pixel electrode of the light emitting element 104. A gate electrode of the AC transistor 103 is connected to the source electrode or drain electrode of the AC transistor 103, which is connected to the pixel electrode of the light emitting element 104.

When the first switching transistor 105 and the second switching transistor 106 are in a non-select state (an off state), the capacitor element 112 is provided in order to maintain a potential difference between the electrodes of the capacitor element 112. It is to be noted that, although a structure in which the capacitor element 112 is provided is shown in FIG. 11, the present invention is not limited to this structure in the case where a gate potential can be maintained by a gate capacitance of the driving transistor 102, and a structure in which the capacitor element 112 is omitted may be employed.

Furthermore, in this embodiment mode, L/W, a ratio of channel length L to channel width W, of the driving transistor 102 is larger than L/W of the AC transistor 103. Specifically, as for the driving transistor 102, L is larger than W, and more preferably, the ratio is 5/1 or more. As for the AC transistor 103, L is shorter than or equal to W. In this way, the value of a current flowing in a reverse direction when a reverse voltage is applied to the light emitting element 104 in the pixel can be larger than the value of a current flowing in a forward direction when a forward voltage is applied to the light emitting element 104.

Here, it can be said that the first switching transistor 105 and the second switching transistor 106 preferably have a structure with a smaller leakage current (an off-state current and a gate leakage current). It is to be noted that an off-state current is a current that flows between a source and a drain when a transistor is off, and a gate leakage current is a current that flows between a gate and a source or between a gate and a drain via a gate insulating film.

Accordingly, N-channel transistors used as the first switching transistor 105 and the second switching transistor 106 preferably have a structure with a low concentration impurity region (also referred to as a Lightly Doped Drain: LDD region), because a transistor having a structure with an LDD region can reduce an off-state current. In addition, the first switching transistor 105 and the second switching transistor 106 need to increase an on-state current when applying a current to the light emitting element 104.

As an even more preferable mode, an LDD region is provided in each of the first switching transistor 105 and the second switching transistor 106, and the LDD region includes a region overlapping a gate electrode. Then, the first switching transistor 105 and the second switching transistor 106 can increase an on-state current, and decrease generation of a hot electron. Accordingly, reliability of the first switching transistor 105 and the second switching transistor 106 improves.

In addition, reliability of the driving transistor 102 also improves by providing the driving transistor 102 with an LDD region overlapping a gate electrode.

Furthermore, an off-state current can be reduced by decreasing a film thickness of a gate insulating film. Accordingly, the film thickness of the first switching transistor 105 and the second switching transistor 106 may be thinner than the film thickness of the driving transistor 102.

Furthermore, by forming each of the first switching transistor 105 and the second switching transistor 106 as a transistor with a multi-gate structure such as a double-gate structure, a gate leakage current can be reduced. Also in the driving transistor 102, by employing a multi-gate structure such as a double-gate structure, a gate leakage current can be reduced, and the reliability can be improved.

In particular, if an off-state current flows to the second switching transistor 106, the capacitor element 112 cannot maintain a voltage which is written during a writing period. Therefore, it is preferable that an off-state current be reduced by providing an LDD region, thinning a gate insulating film, or employing a multi-gate structure in the second switching transistor 106.

Next, an operation of the circuit configuration in FIG. 11 will be described with reference to FIGS. 12A to 12C.

Figure 12A:
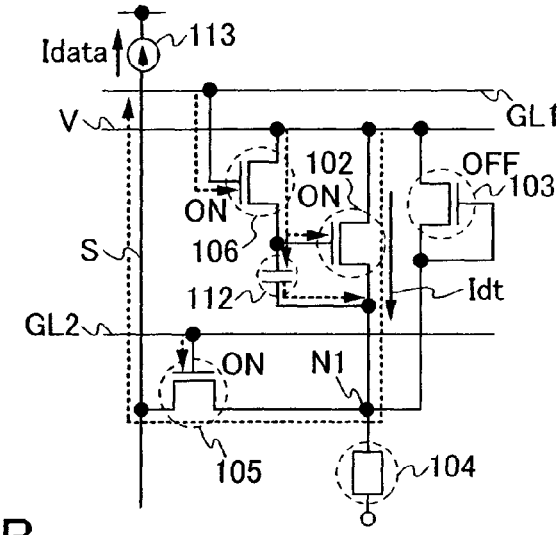
FIGS. 12A to 12C are circuit diagrams of a pixel used in a display device of the present invention.

First, during a writing period of FIG. 12A, the first switching transistor 105 having the gate electrode connected to the second scanning line GL2 and the second switching transistor 106 having the gate electrode connected to the first scanning line GL1 are turned on when the first scanning line GL1 and the second scanning line GL2 are selected. At this time, a predetermined gray scale current Idata required to make the light emitting element 104 emit light with a predetermined luminance gray scale is supplied from the current source 113 to the signal line S. Here, the current source 113 sets a gray scale potential Vdata for supplying the gray scale current Idata to the signal line S lower than a potential Vss of the counter electrode of the light emitting element 104 and a potential Vss1 of the power line V (that is, Vss, Vss1>Vdata). As the potential Vss, GND (a ground potential), 0 V, or the like may be applied, for example.

The potential Vss1 of the power line V is set to be lower than or equal to the potential Vss of the counter electrode of the light emitting element 104 (that is, Vss≧Vss1), and the potential Vss1 of the power line V is input to the capacitor element 112 and the gate electrode of the driving transistor 102 via the second switching transistor 106. In this way, charge is accumulated in the capacitor element 112. When the capacitor element 112 is charged, a voltage component (a holding voltage) is maintained, and the driving transistor 102 is turned on. In addition, the electrode of the driving transistor 102, connected to the power line V, becomes the drain electrode, and the other electrode becomes the source electrode. Accordingly, a writing current Idt based on the gray scale current Idata is supplied via the driving transistor 102.

As described above, based on the gray scale current Idata set by the current source 113, Idt flows as a drain current of the driving transistor 102 and the first switching transistor 105, a charge corresponding to a potential difference between the electrodes is accumulated in the capacitor element 112, and a voltage component (a holding voltage) is maintained. At this time, the writing current Idt flows based on the gray scale potential Vdata which is lower than the potential Vss of the counter electrode of the light emitting element 104, and the potential of a node N1 becomes low, so that a reverse bias current flows to the light emitting element 104. Accordingly, the light emitting element 104 does not emit light during the writing period.

In addition, during this writing period, the potential of the node N1 is lowered by the above-described writing current Idt, and the potential Vss1 of the power line V becomes higher than a potential applied to the node N1. Therefore, the electrode of the AC transistor 103, connected to the power line V, becomes the drain electrode, and the other electrode becomes the source electrode. The source electrode is connected to the gate electrode of the AC transistor 103, so that the AC transistor 103 is off.

It is to be noted that, although the description is made for the case where the driving transistor 102 is turned on by the gray scale potential Vdata, also in the case where the driving transistor 102 is turned off by the gray scale potential Vdata, no forward bias current is supplied to the light emitting element 104. Therefore, the light emitting element 104 does not emit light, in this case.

Figure 12B:
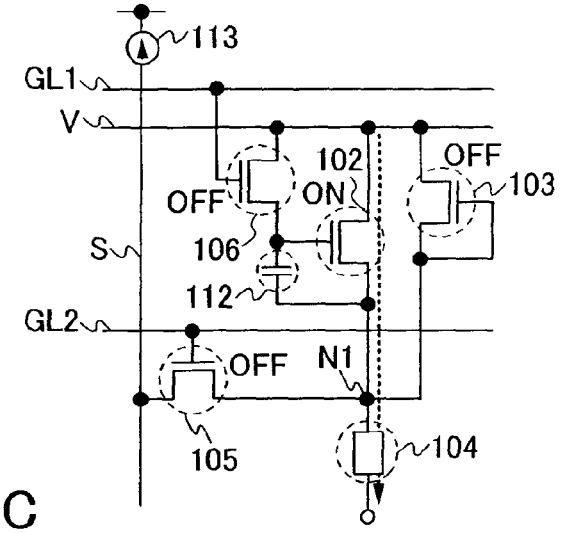

Next, during a display period of FIG. 12B, the first switching transistor 105 and the second switching transistor 106 are turned off by controlling potentials of the first scanning line GL1 and the second scanning line GL2, and a charge (a holding voltage) accumulated during the writing period, that is, a potential difference between the electrodes of the capacitor element 112, is maintained, so that the driving transistor 102 is on. In addition, a potential Vdd1 of the power line V is set to be higher than the potential Vss of the counter electrode of the light emitting element 104 (Vdd1>Vss), so that a forward bias current flows to the light emitting element 104 and the light emitting element 104 emits light.

On the other hand, since the potential Vdd1 of the power line V is set to be higher than the potential Vss of the counter electrode of the light emitting element 104, the electrode of the AC transistor 103, connected to the power line V, becomes the drain electrode, and the other electrode becomes the source electrode. The source electrode is connected to the gate electrode of the AC transistor 103, and the AC transistor 103 is off.

Although the description is made for the case where the driving transistor 102 is turned on by the gray scale potential Vdata during the writing period, in the case where the driving transistor 102 is turned off by the gray scale potential Vdata, no forward bias current is supplied to the light emitting element 104. Therefore, no current is supplied to the light emitting element 104, not even during the display period, in this case.

Figure 12C:
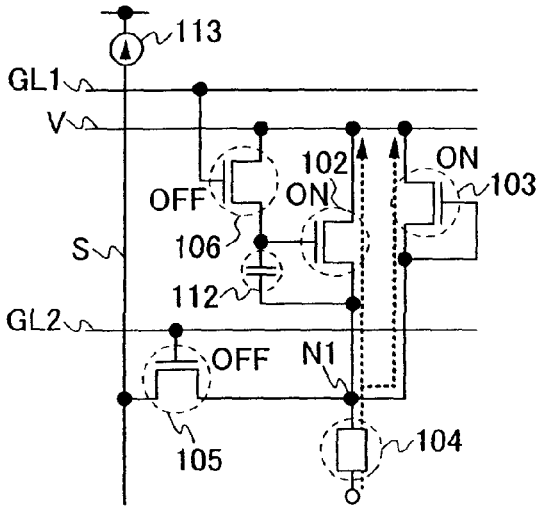

Next, during a reverse bias period (non-lighting period) of FIG. 12C, the potentials of the first scanning line GL1 and the second scanning line GL2 are controlled so that the first switching transistor 105 and the second switching transistor 106 are off.

By setting a potential Vss2 of the power line V to be lower than the potential Vss of the counter electrode of the light emitting element 104 (that is, Vss>Vss2), the electrode of the AC transistor 103, connected to the power line V, becomes the source electrode, and the other electrode becomes the drain electrode. Accordingly, the drain electrode is connected to the gate electrode of the AC transistor 103, and the AC transistor 103 is turned on. Therefore, a reverse voltage is applied to the light emitting element 104, and a reverse bias current flows in the light emitting element 104 and the AC transistor 103.

In the case where the driving transistor 102 is on during the writing period and the display period, the potential difference between the electrodes of the capacitor element 112 is maintained based on the writing current Idt, so that the driving transistor is on during a reverse bias period, as well. Accordingly, a reverse bias current flows to the driving transistor 102. However, as described above, by setting L/W of the driving transistor 102 larger than L/W of the AC transistor 103, the value of a current flowing to the driving transistor 102 becomes smaller than the value of a current flowing to the AC transistor 103. Of course, in the case where the driving transistor 102 is turned off during the writing period and the display period, no current is supplied to the driving transistor 102.

In addition, a potential difference between Vss2 and Vss during a reverse bias period may be larger than a potential difference between Vdd1 and Vss during a display period. In this way, the value of a reverse bias current becomes larger than the value of a forward bias current, and an even larger current can flow to the light emitting element 104 during a reverse bias period.

Figure 13:
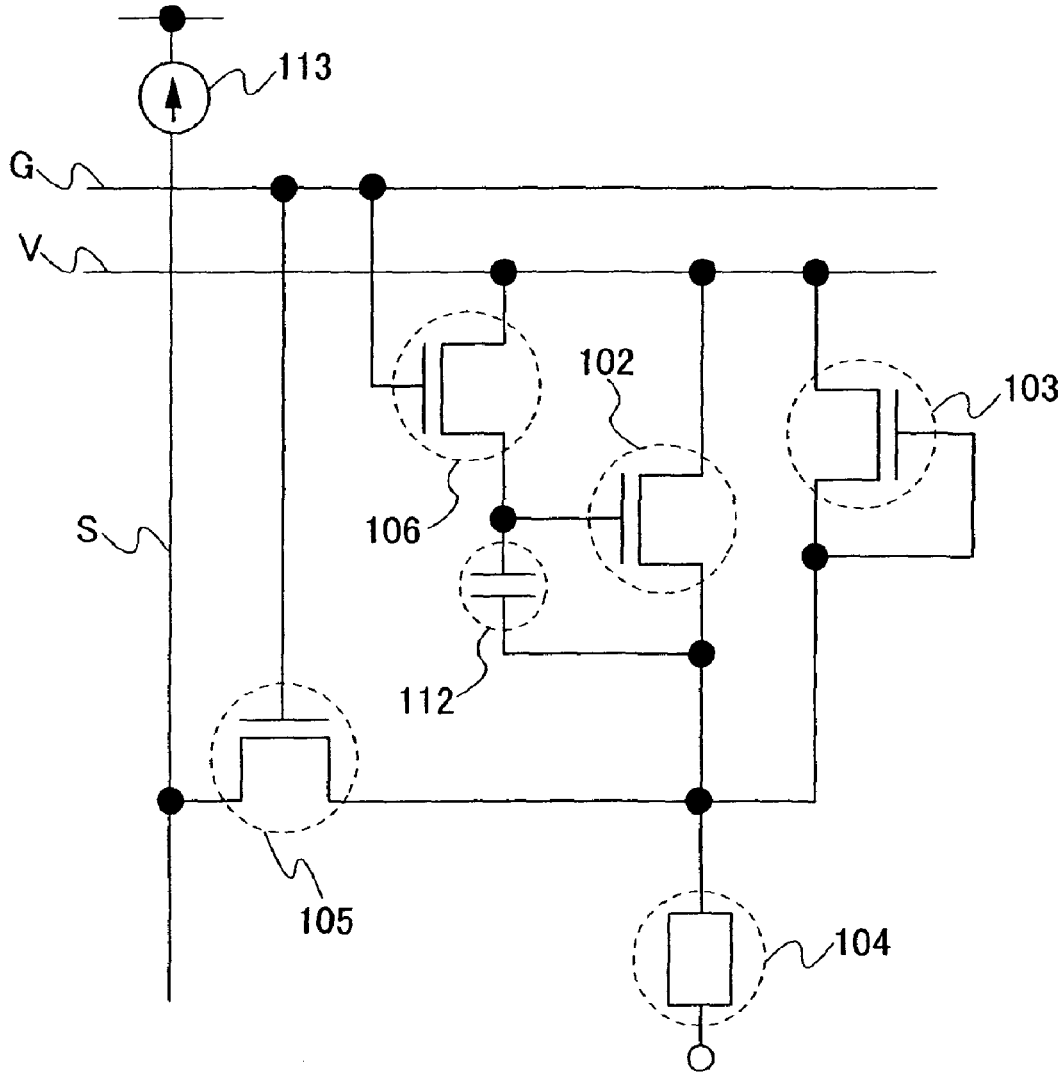
FIG. 13 is a circuit diagram of a pixel used in a display device of the present invention.

In addition to the above-described circuit configuration, a configuration in which the second scanning line GL2 is not provided and the gate electrodes of the first switching transistor 105 and the second switching transistor 106 are connected to the scanning line G may be employed. That configuration is shown in FIG. 13. By forming one scanning line G1, the number of wirings can be reduced, and an aperture ratio of the pixel can be increased. The operations are the same except that the operations of the first scanning line GL1 and the second scanning line GL2 in the above-described circuit configuration are performed by the one scanning line G, so the explanation is omitted here.

Next, a gray scale method of driving a circuit with an analog time gray scale method using a pixel shown in FIG. 11 will be described with reference to timing charts in FIGS. 14A and 14B.

Figure 14A:
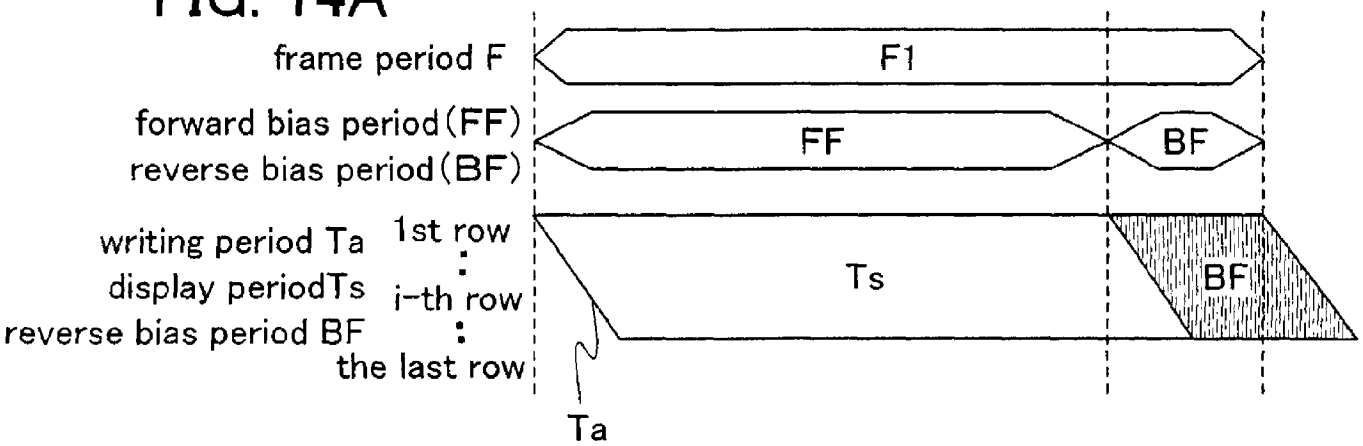
FIGS. 14A and 14B are diagrams each showing a timing chart of the case where a digital time gray scale method is performed in a display device of the present invention.

As shown in FIG. 14A, a period in which a forward voltage is applied to the light emitting element, which is a forward bias period FF, and a period in which a reverse voltage is applied, which is a reverse bias period BF, are included in one frame period F1. The forward bias period FF is time-divided into a writing period Ta and a display period Ts, and an analog video signal is written to each pixel during the forward bias period FF, so that the light emitting element 104 either emits or does not emit light.

Figure 14B:
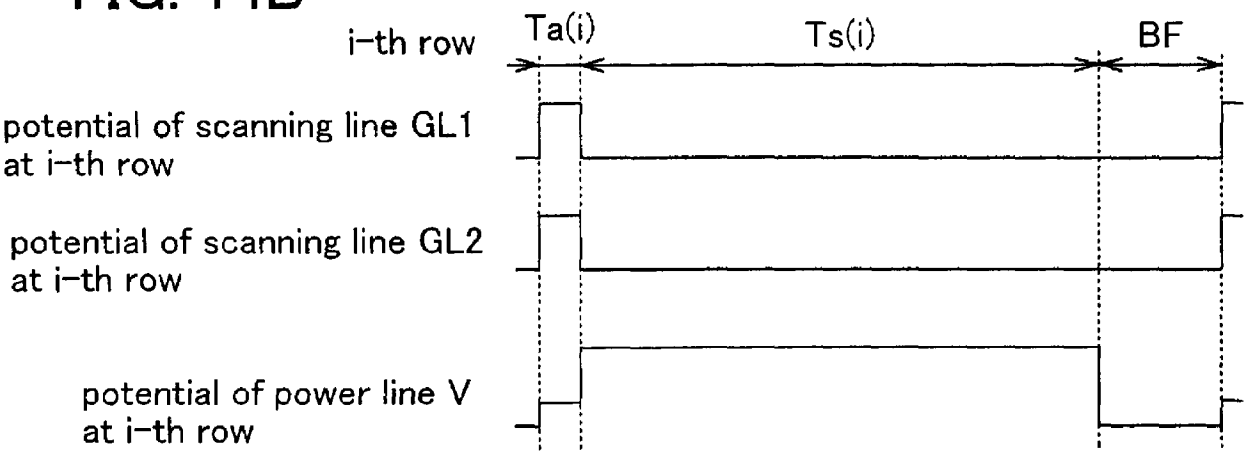

FIG. 14B shows a timing chart of an arbitrary row (i-th row).

During a writing period Ta (i) in which a signal is written to a pixel, a potential of an analog signal, which is a gray scale potential Vdata, is set in the current source 113 connected to the signal line S. This gray scale potential Vdata corresponds to a video signal. When the video signal is written to the pixel, a high-level potential is applied to the first scanning line GL1 and the second scanning line GL2, and the second switching transistor 106 and the first switching transistor 105 are turned on. In addition, a low-level potential Vss1 is applied to a potential of the power line V. Here, the potential Vss1 of the power line V is set to be lower than or equal to the potential Vss of the counter electrode of the light emitting element 104 (that is, Vss>Vss1).

Next, during a display period Ts (i), a low-level potential is applied to the first scanning line GL1 and the second scanning line GL2, and a high-level potential Vdd1 is applied to the potential of the power line V. Here, the potential Vdd1 of the power line V is set to be higher than the potential Vss of the counter electrode of the light emitting element 104 (that is, Vdd1>Vss), and the light emitting element 104 emits light.

During the reverse bias period BF, a low-level potential is maintained in the first scanning line GL1 and the second scanning line GL2, and a low-level potential Vss2 is applied to a potential of the power line V. Here, the potential Vss2 of the power line V is set to be lower than the potential Vss of the counter electrode of the light emitting element 104 (that is, Vss>Vss2). Through provision of such a reverse bias period, a reverse voltage is applied to the light emitting element so that an initial failure or a progressive failure of the light emitting element is suppressed and a decrease in luminance due to deterioration of the electroluminescent layer can be prevented.

Figure 15A:
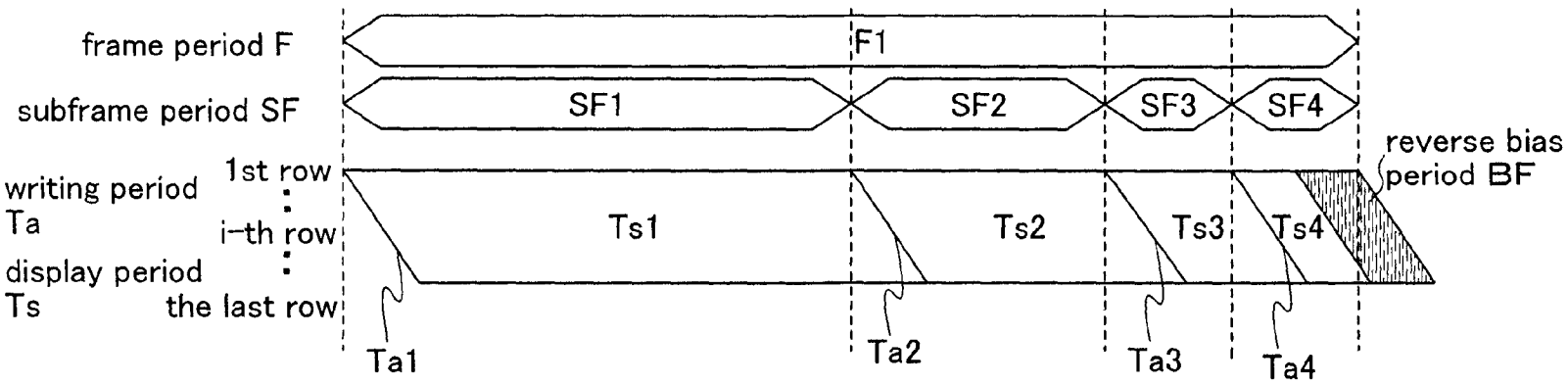
FIGS. 15A and 15B are diagrams each showing a timing chart of the case where gray scale display is performed using an analog method in a display device of the present invention.
Figure 15B:
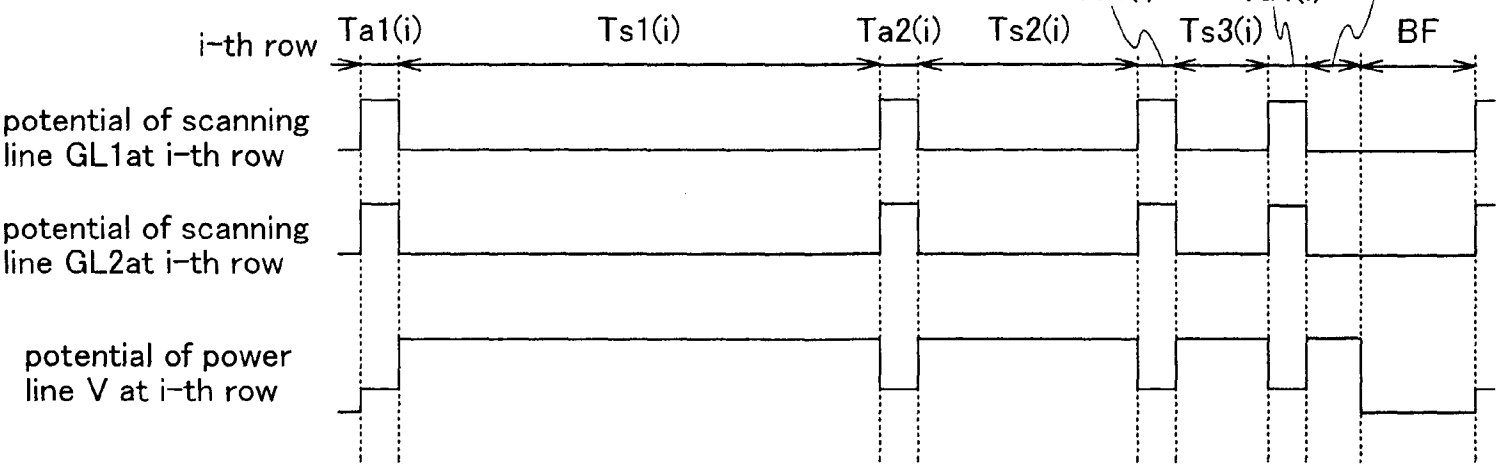

In the case where the pixel in FIG. 11 is driven by a digital time gray scale method, one frame period F1 is time-divided into four subframe periods SF1, SF2, SF3, and SF4, including writing periods Ta1, Ta2, Ta3, and Ta4, and display periods Ts1, Ts2, Ts3, and Ts4, and the reverse bias period (non-lighting period) BF, as shown in FIG. 15A. During the writing period, a light emitting element which receives a signal for light emission changes to a light emitting state during the display period. After the writing period and the display period are performed alternately, the reverse bias period is performed.

Although a 4-bit gray scale is expressed in this embodiment mode, the number of bits and gray scale levels is not limited thereto. For example, an 8-bit gray scale can be offered by providing eight subframe periods. Furthermore, each of the subframe periods SF1 to SF4 may be placed in one frame unconsecutively. In addition, one subframe period may further include a plurality of subframe periods, and the plurality of the subframe periods may be placed in one frame unconsecutively. In the case where a gray scale is expressed using a time gray scale method, the number of subframes is not particularly limited. Furthermore, the length of a lighting period in each subframe period, or in which subframe light is emitted, is not particularly limited. That is, a method for selecting a subframe is not particularly limited.

As described above, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

Embodiment Mode 5

(Circuit Configuration 4)

In this embodiment mode, a configuration different from the circuit configuration of FIG. 1 described in Embodiment Mode 1 will be described.

Figure 16:
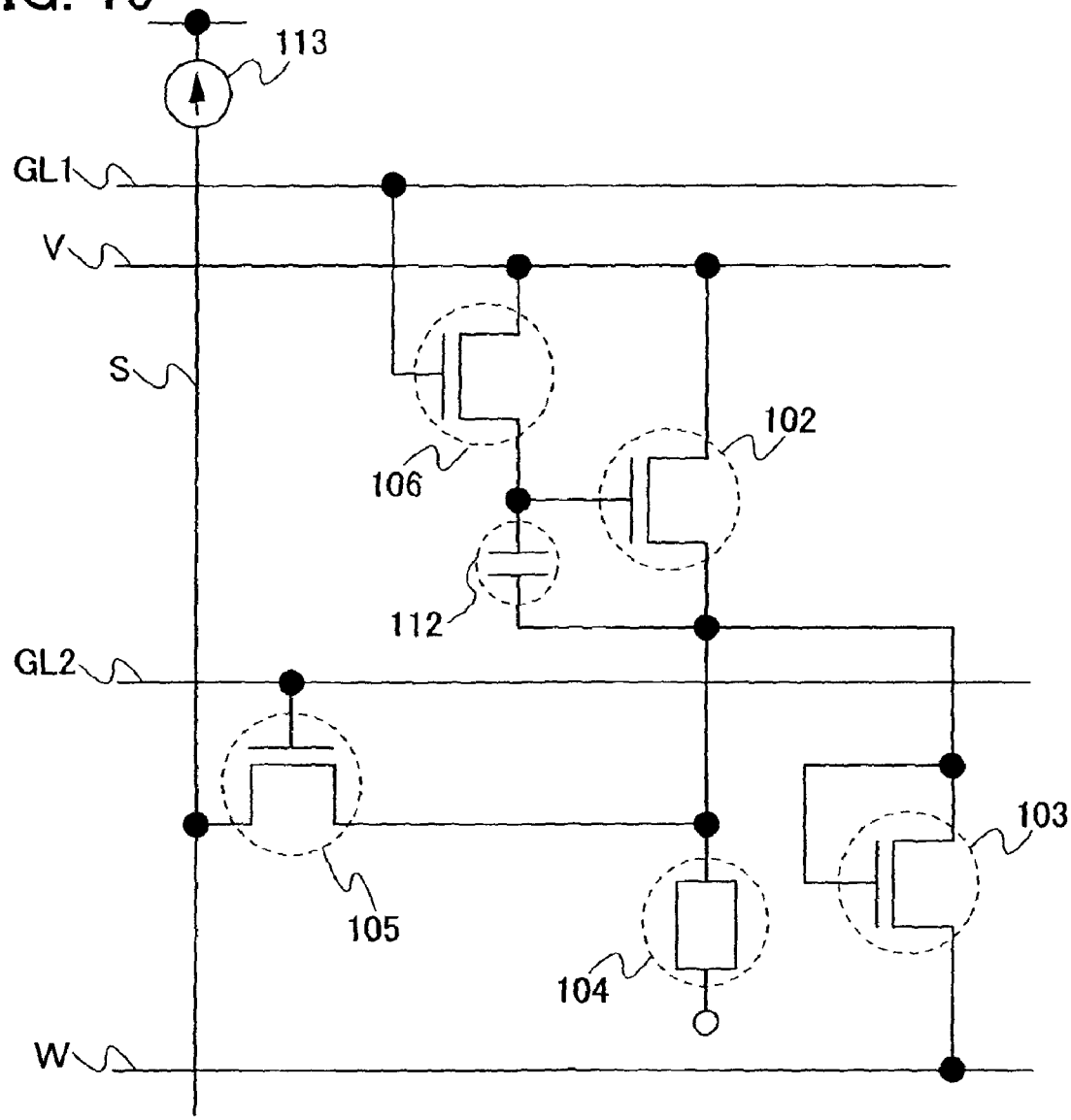
FIG. 16 is a circuit diagram of a pixel used in a display device of the present invention.

A circuit constituting a pixel shown in FIG. 16 includes a light emitting element 104, transistors used as switching elements for controlling the input of a video signal to a pixel (a first switching transistor 105 and a second switching transistor 106), a transistor that controls the value of a current flowing to the light emitting element 104 (a driving transistor 102), and a transistor that applies a reverse bias current to the light emitting element 104 when a reverse voltage is applied to the light emitting element 104 (an AC transistor 103). In this embodiment mode, a capacitor element 112 which has two electrodes is provided for maintaining a potential of a video signal. However, in the case where a gate potential of the driving transistor 102 can be maintained by using a gate capacitance of the driving transistor 102 or the like, the capacitor element 112 may be omitted. The first switching transistor 105, the second switching transistor 106, the driving transistor 102, and the AC transistor 103 have the same conductivity type, and an N-type transistor is used for each of these transistors, which is a characteristic of the present invention.

As shown in FIG. 16, a gate electrode of the first switching transistor 105 is connected to a second scanning line GL2. One of a source electrode or drain electrode of the first switching transistor 105 is connected to a signal line S, and the other one is connected to a source electrode or drain electrode of the driving transistor 102. A gate electrode of the second switching transistor 106 is connected to a first scanning line GL1. One of a source electrode or drain electrode of the second switching transistor 106 is connected to a power line V, and the other one is connected to a gate electrode of the driving transistor 102 and to the capacitor element 112. A signal line S is connected to a current source 113.

Furthermore, one of the source electrode or drain electrode of the driving transistor 102 is connected to the power line V, and the other one is connected to a pixel electrode of the light emitting element 104 and to the capacitor element 112. One of the two electrodes of the capacitor element 112 is connected to the gate electrode of the driving transistor 102, and the other one is connected to the source electrode or drain electrode of the driving transistor 102, which is connected to the pixel electrode of the light emitting element 104. The driving transistor 102 is set to operate in a saturation region.

Furthermore, in this embodiment mode, one of a source electrode or drain electrode of the AC transistor 103 is connected to the pixel electrode of the light emitting element 104, and the other one is connected to the potential control line W. A gate electrode of the AC transistor 103 is connected to the source electrode or drain electrode of the AC transistor 103, which is connected to the potential control line W.

When the first switching transistor 105 and the second switching transistor 106 are in a non-select state (an off state), the capacitor element 112 is provided in order to maintain a potential difference between the electrodes of the capacitor element 112. It is to be noted that, although a structure in which the capacitor element 112 is provided is shown in FIG. 16, the present invention is not limited to this structure in the case where a gate potential can be maintained by a gate capacitance of the driving transistor 102, and a structure in which the capacitor element is omitted may be employed.

Furthermore, in this embodiment mode, L/W, a ratio of channel length L to channel width W, of the driving transistor 102 is larger than L/W of the AC transistor 103. Specifically, as for the driving transistor 102, L is larger than W, and more preferably, the ratio is 5/1 or more. As for the AC transistor 103, L is shorter than or equal to W. In this way, the value of a current flowing in a reverse direction when a reverse voltage is applied to the light emitting element 104 in the pixel can be larger than the value of a current flowing in a forward direction when a forward voltage is applied to the light emitting element 104.

Here, it can be said that the first switching transistor 105 and the second switching transistor 106 preferably have a structure with a lower leakage current (an off-state current and a gate leakage current). It is to be noted that an off-state current is a current that flows between a source and a drain when a transistor is off, and a gate leakage current is a current that flows between a gate and a source or between a gate and a drain via a gate insulating film.

Accordingly, N-channel transistors used as the first switching transistor 105 and the second switching transistor 106 preferably have a structure with a low concentration impurity region (also referred to as a Lightly Doped Drain: LDD region), because a transistor having a structure with an LDD region can reduce an off-state current. In addition, the first switching transistor 105 and the second switching transistor 106 need to increase an on-state current when applying a current to the light emitting element 104.

As an even more preferable mode, an LDD region is provided in each of the first switching transistor 105 and the second switching transistor 106, and the LDD region includes a region overlapping a gate electrode. Then, the first switching transistor 105 and the second switching transistor 106 can increase an on-state current, and decrease generation of a hot electron. Accordingly, reliability of the first switching transistor 105 and the second switching transistor 106 improves.

In addition, reliability of the driving transistor 102 also improves by providing the driving transistor 102 with an LDD region overlapping a gate electrode.

Furthermore, an off-state current can be reduced by decreasing a film thickness of a gate insulating film. Accordingly, the film thickness of the first switching transistor 105 and the second switching transistor 106 may be thinner than the film thickness of the driving transistor 102.

Furthermore, by forming each of the first switching transistor 105 and the second switching transistor 106 as a transistor with a multi-gate structure such as a double-gate structure, a gate leakage current can be reduced. Also in the driving transistor 102, by employing a multi-gate structure such as a double-gate structure, a gate leakage current can be reduced, and the reliability can be improved.

In particular, if an off-state current flows to the second switching transistor 106, the capacitor element 112 cannot maintain a voltage which is written during a writing period. Therefore, it is preferable that an off-state current be reduced by providing an LDD region, thinning a gate insulating film, or employing a multi-gate structure in the second switching transistor 106.

Next, an operation of the circuit configuration in FIG. 16 will be described with reference to FIGS. 17A to 17C.

Figure 17A:
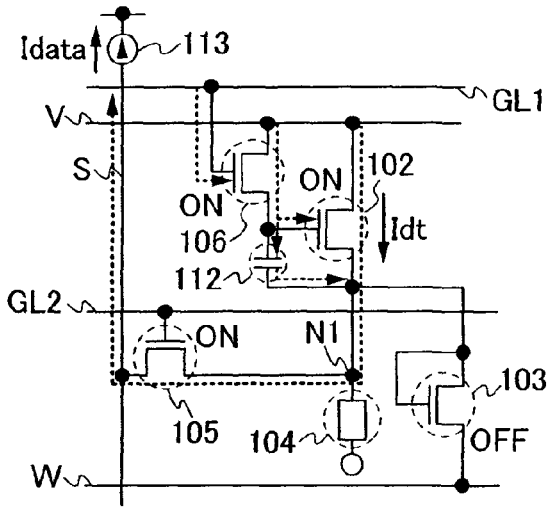
FIGS. 17A to 17C are circuit diagrams of a pixel used in a display device of the present invention.

First, during a writing period of FIG. 17A, the first switching transistor 105 having the gate electrode connected to the second scanning line GL2 and the second switching transistor 106 having the gate electrode connected to the first scanning line GL1 are turned on when the first scanning line GL1 and the second scanning line GL2 are selected. At this time, a predetermined gray scale current Idata required to make the light emitting element 104 emit light with a predetermined luminance gray scale is supplied from the current source 113 to the signal line S. Here, the current source 113 sets a gray scale potential Vdata for supplying the gray scale current Idata to the signal line S lower than a potential Vss of the counter electrode of the light emitting element 104 and a potential Vss1 of the power line V (that is, Vss, Vss1>Vdata). As the potential Vss, GND (a ground potential), 0 V, or the like may be applied, for example.

The potential Vss1 of the power line V is set to be lower than or equal to the potential Vss of the counter electrode of the light emitting element 104 (that is, Vss≧Vss1), and the potential Vss1 of the power line V is input to the capacitor element 112 and the gate electrode of the driving transistor 102 via the second switching transistor 106. In this way, charge is accumulated in the capacitor element 112. When the capacitor element 112 is charged, a voltage component (a holding voltage) is maintained, and the driving transistor 102 is turned on. In addition, the electrode of the driving transistor 102, connected to the power line V, becomes the drain electrode, and the other electrode becomes the source electrode. Accordingly, a writing current Idt based on the gray scale current Idata is supplied via the driving transistor 102.

As described above, by the gray scale current Idata set by the current source 113, Idt flows as a drain current of the driving transistor 102 and the first switching transistor 105, a charge corresponding to a potential difference between the electrodes is accumulated in the capacitor element 112, and a voltage component (a holding voltage) is maintained. At this time, the writing current Idt flows based on the gray scale potential Vdata which is lower than the potential Vss of the counter electrode of the light emitting element 104, and a potential of a node N1 becomes low, so that a reverse bias current flows to the light emitting element 104. Accordingly, the light emitting element 104 does not emit light during the writing period.

On the other hand, during this writing period, a potential Vdd3 of the potential control line W is set to be higher than a potential Vss of the counter electrode of the light emitting element 104 (that is, Vdd3>Vss). Therefore, the electrode of the AC transistor 103, connected to the potential control line W, becomes the drain electrode, and the other electrode becomes the source electrode. The source electrode is connected to a gate electrode of the AC transistor 103, so that the AC transistor 103 is off.

It is to be noted that, although the description is made for the case where the driving transistor 102 is turned on by the gray scale potential Vdata, also in the case where the driving transistor 102 is turned off by the gray scale potential Vdata, no forward bias current is supplied to the light emitting element 104. Therefore, the light emitting element 104 does not emit light, in this case.

Figure 17B:
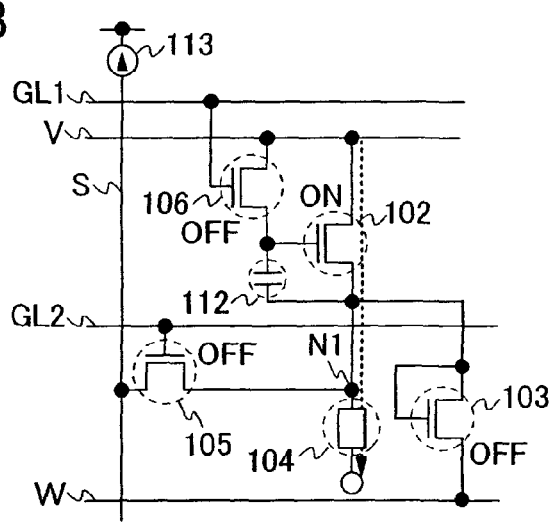

Next, during a display period of FIG. 17B, the first switching transistor 105 and the second switching transistor 106 are turned off by controlling potentials of the first scanning line GL1 and the second scanning line GL2, and charge (a holding voltage) accumulated during the writing period, that is, a potential difference between the electrodes of the capacitor element 112, is maintained so that the driving transistor 102 is on. In addition, a potential Vdd1 of the power line V is set to be higher than the potential Vss of the counter electrode of the light emitting element 104 (Vdd1>Vss), so that a forward bias current flows to the light emitting element 104 and the light emitting element 104 emits light.

On the other hand, in the same way as for the writing period, the potential Vdd3 of the potential control line W is set to be higher than the potential Vss of the counter electrode of the light emitting element 104. Accordingly, the electrode of the AC transistor 103, connected to the potential control line W, becomes the drain electrode, and the other electrode becomes the source electrode. The source electrode is connected to the gate electrode of the AC transistor 103, and the AC transistor 103 is off.

Although the description is made for the case where the driving transistor 102 is turned on by the gray scale potential Vdata during the writing period, in the case where the driving transistor 102 is turned off by the gray scale potential Vdata, no forward bias current is supplied to the light emitting element 104. Therefore, no current is supplied to the light emitting element 104, not even during the display period, in this case.

Figure 17C:
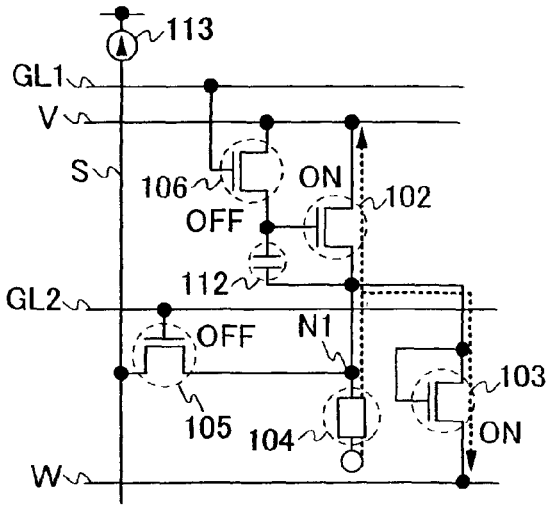

Next, during a reverse bias period (non-lighting period) of FIG. 17C, the potentials of the first scanning line GL1 and the second scanning line GL2 are controlled so that the first switching transistor 105 and the second switching transistor 106 are off.

By setting a potential Vss3 of the potential control line W to be lower than the potential Vss of the counter electrode of the light emitting element 104 (that is, Vss>Vdd3), the electrode of the AC transistor 103, connected to the potential control line W, becomes the source electrode, and the other electrode becomes the drain electrode. Accordingly, the drain electrode is connected to the gate electrode of the AC transistor 103, and the AC transistor 103 is turned on. Therefore, a reverse voltage is applied to the light emitting element 104, and a reverse bias current flows in the light emitting element 104 and the AC transistor 103.

On the other hand, the potential Vss2 of the power line V is set to be lower than or equal to the potential Vss of the counter electrode of the light emitting element 104 (that is, Vss≧Vss2). In addition, in the case where the driving transistor 102 is on during the writing period and the display period, the potential difference between the electrodes of the capacitor element 112 is maintained based on the writing current Idt, so that the driving transistor is on during a reverse bias period, as well.

Accordingly, due to the potential set for the potential Vss2 of the power line V, a reverse bias current flows to the driving transistor 102. (It is to be noted that the current does not flow when the set potential Vss2 is equal to Vss). However, as described above, by setting L/W of the driving transistor 102 larger than L/W of the AC transistor 103, the value of a current flowing to the driving transistor 102 becomes smaller than the value of a current flowing to the AC transistor 103. Of course, in the case where the driving transistor 102 is off during the writing period and the display period, no current is supplied to the driving transistor 102.

In addition, a potential difference between the potential Vss3 of the potential control line W and the potential Vss of the counter electrode of the light emitting element 104 during a reverse bias period may be larger than a potential difference between the potential Vdd1 of the power line V and the potential Vss of the counter electrode of the light emitting element 104 during a display period. In this way, the value of a reverse bias current becomes larger than the value of a forward bias current, and an even larger current can flow to the light emitting element 104 during a reverse bias period.

Figure 18:
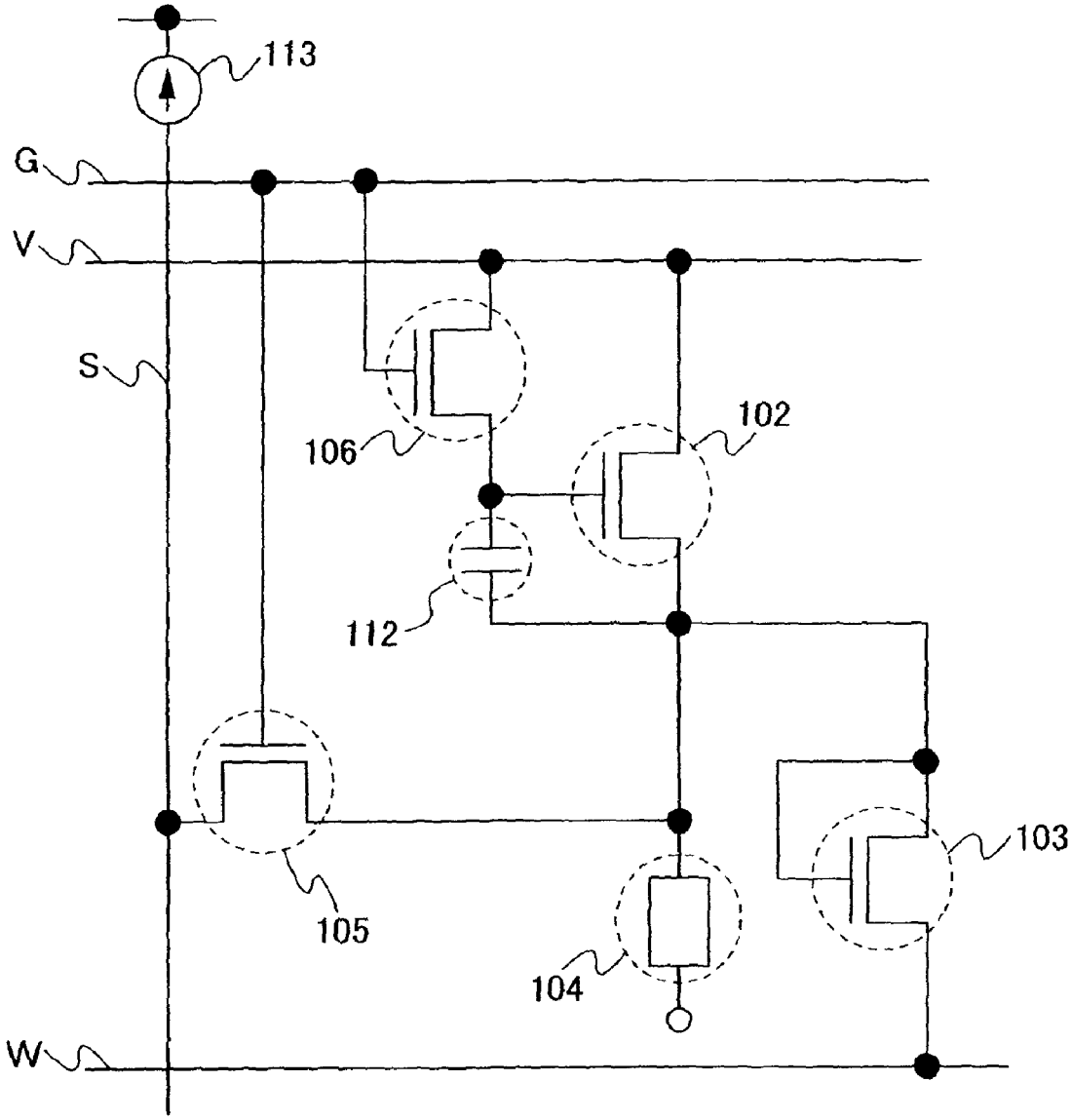
FIG. 18 is a circuit diagram of a pixel used in a display device of the present invention.

In addition to the above-described circuit configuration, a configuration in which the second scanning line GL2 is not provided and the gate electrodes of the first switching transistor 105 and the second switching transistor 106 are connected to the scanning line G may be employed. That configuration is shown in FIG. 18. By forming one scanning line G, the number of wirings can be reduced, and an aperture ratio of the pixel can be increased. The operations are the same except that the operations of the first scanning line GL1 and the second scanning line GL2 in the above-described circuit configuration are performed by the one scanning line G, so the explanation is omitted here.

Figure 19A:
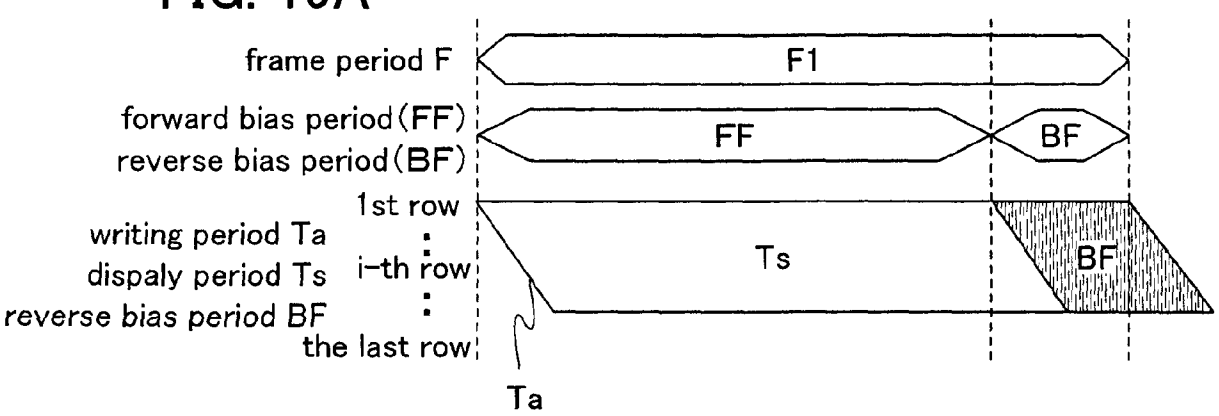
FIGS. 19A and 19B are diagrams each showing a timing chart of the case where a digital time gray scale method is performed in a display device of the present invention.

Next, a gray scale method of driving a circuit with an analog time gray scale method using a pixel shown in FIG. 16 will be described with reference to timing charts in FIGS. 19A and 19B.

As shown in FIG. 14A, a period in which a forward voltage is applied to the light emitting element, which is a forward bias period FF, and a period in which a reverse voltage is applied, which is a reverse bias period BF, are included in one frame period F1. The forward bias period FF is time-divided into a writing period Ta and a display period Ts, and an analog video signal is written to each pixel during the forward bias period FF, so that the light emitting element 104 either emits or does not emit light.

Figure 19B:
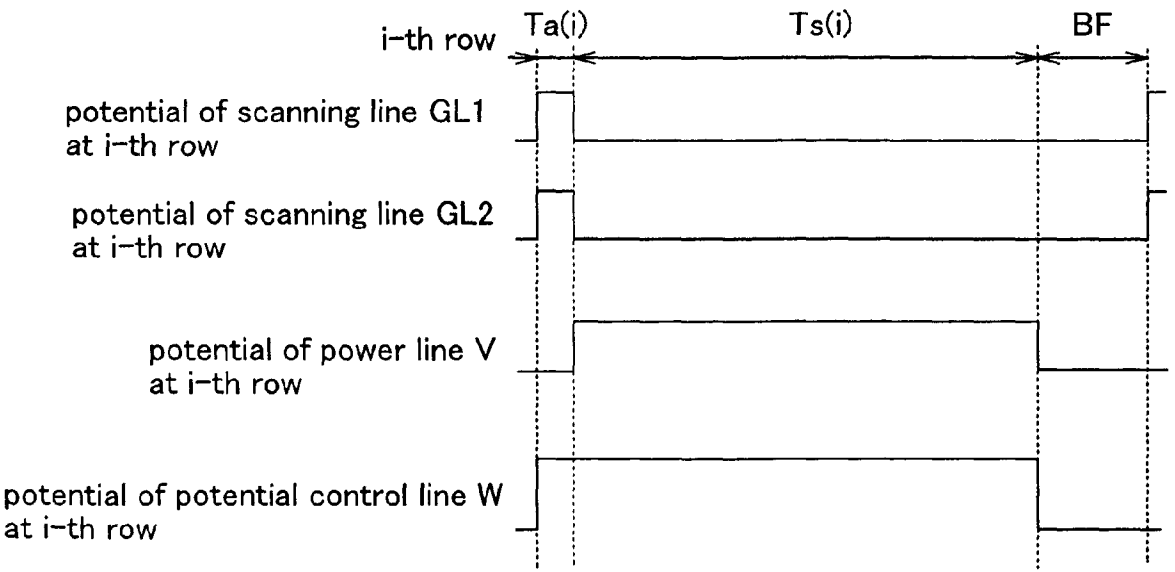

FIG. 19B shows a timing chart of an arbitrary row (an i-th row).

During a writing period Ta (i) in which a signal is written to a pixel, a potential of an analog signal, which is a gray scale potential Vdata, is set in the current source 113 connected to the signal line S. This gray scale potential Vdata corresponds to a video signal. When the video signal is written to the pixel, a high-level potential is applied to the first scanning line GL1 and the second scanning line GL2, and the second switching transistor 106 and the first switching transistor 105 are turned on. In addition, a low-level potential Vss1 is applied to a potential of the power line V, and a high-level potential Vdd3 is applied to a potential of the potential control line W. Here, the potential Vss1 of the power line V is set to be lower than or equal to the potential Vss of the counter electrode of the light emitting element 104 (that is, Vss≧Vss1). In addition, the potential Vdd3 of the potential control line W is set to be higher than the potential Vss of the counter electrode of the light emitting element 104 (that is, Vdd3>Vss).

Next, during a display period Ts (i), a low-level potential is applied to the first scanning line GL1 and the second scanning line GL2, and a high-level potential Vdd1 is applied to the potential of the power line V. In addition, the potential of the potential control line W is maintained at the high-level potential Vdd3. Here, the potential Vdd1 of the power line V is set to be higher than the potential Vss of the counter electrode of the light emitting element 104 (that is, Vdd1>Vss), and the light emitting element 104 emits light. In addition, the potential Vdd3 of the potential control line W is set to be higher than the potential Vss of the counter electrode of the light emitting element 104 (that is, Vdd3>Vss).

During the reverse bias period BF, a low-level potential is maintained in the first scanning line GL1 and the second scanning line GL2. A low-level potential Vss2 is applied to a potential of the power line V, and a low-level potential Vss3 is applied to a potential of the potential control line W. Here, the potential Vss2 of the power line V is set to be lower than or equal to the potential Vss of the counter electrode of the light emitting element 104 (that is, Vss≧Vss2). In addition, the potential Vss3 of the potential control line W is set to be lower than the potential Vss of the counter electrode of the light emitting element 104 (that is, Vss>Vss3). Through provision of such a reverse bias period, a reverse voltage is applied to the light emitting element so that an initial failure or a progressive failure of the light emitting element is suppressed and a decrease in luminance due to deterioration of the electroluminescent layer can be prevented.

It is to be noted that, as for the potential of the power line V, the potential Vss1 during the writing period and the potential Vss2 during the reverse bias period may be equal to the potential Vss of the counter electrode of the light emitting element 104. In the case where Vss1 and Vss2 are lower than Vss, they may be the same potential, or they may be different potentials from each other.

Figure 20A:
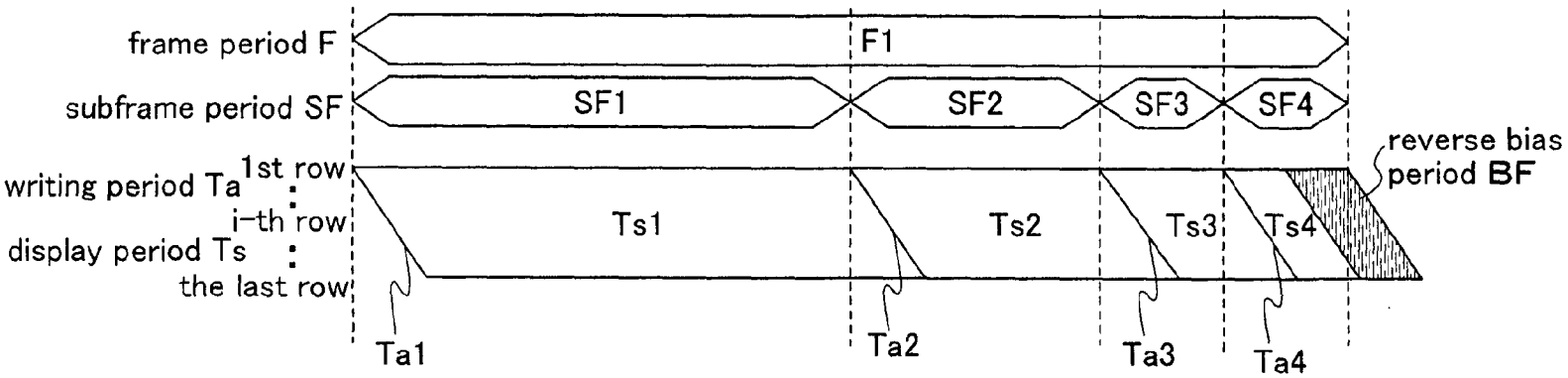
FIGS. 20A and 20B are diagrams each showing a timing chart of the case where gray scale display is performed using an analog method in a display device of the present invention.
Figure 20B:
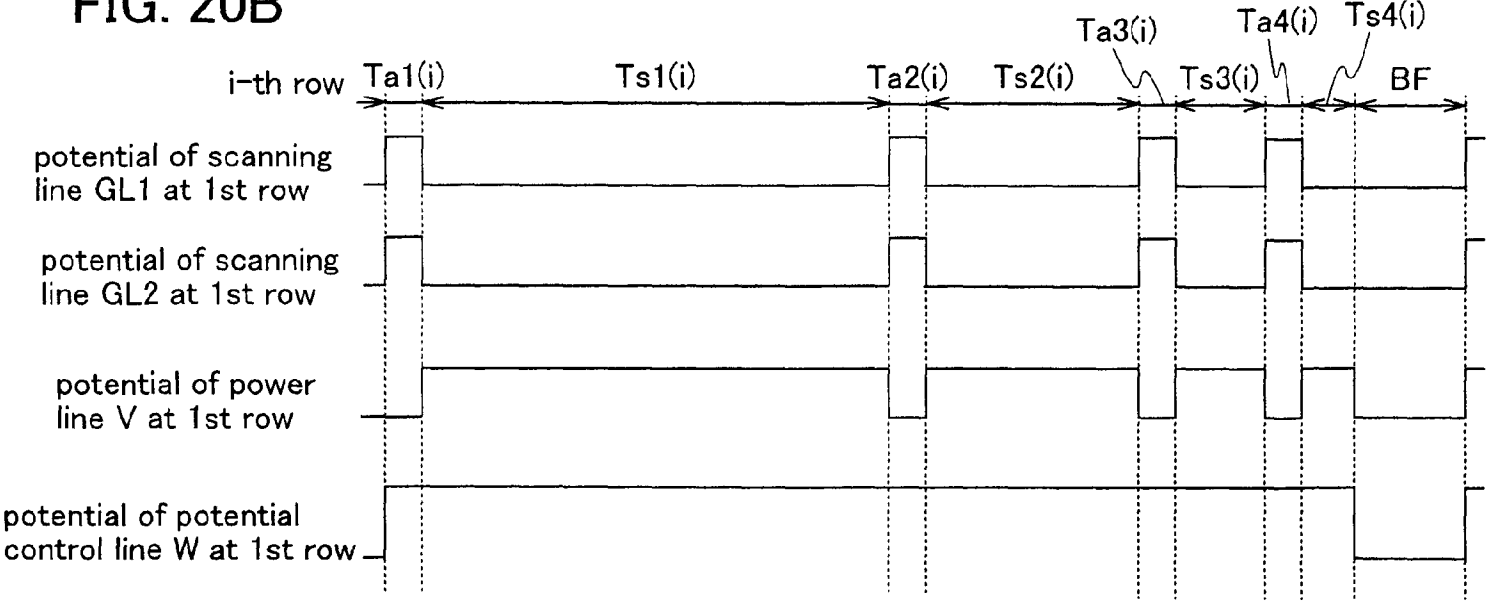

In the case where the pixel in FIG. 16 is driven by a digital time gray scale method, one frame period F1 is time-divided into four subframe periods SF1, SF2, SF3, and SF4, including writing periods Ta1, Ta2, Ta3, and Ta4, and display periods Ts1, Ts2, Ts3, and Ts4, and the reverse bias period (non-lighting period) BF, as shown in FIG. 20A. During the writing period, a light emitting element which receives a signal for light emission changes to a light emitting state during the display period. After the writing period and the display period are performed alternately, the reverse bias period is performed.

Although a 4-bit gray scale is expressed in this embodiment mode, the number of bits and gray scale levels is not limited thereto. For example, an 8-bit gray scale can be offered by providing eight subframe periods. Furthermore, each of the subframe periods SF1 to SF4 may be placed in one frame unconsecutively. In addition, one subframe period may further include a plurality of subframe periods, and the plurality of the subframe periods may be placed in one frame unconsecutively. In the case where a gray scale is expressed using a time gray scale method, the number of subframes is not particularly limited. Furthermore, the length of a lighting period in each subframe period, or in which subframe light is emitted, is not particularly limited. That is, a method for selecting a subframe is not particularly limited.

As described above, in a structure of the present invention, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

Embodiment Mode 6

(Circuit Configuration 5)

In this embodiment mode, a configuration different from the circuit configuration of FIG. 1 described in Embodiment Mode 1 will be described.

Figure 21:
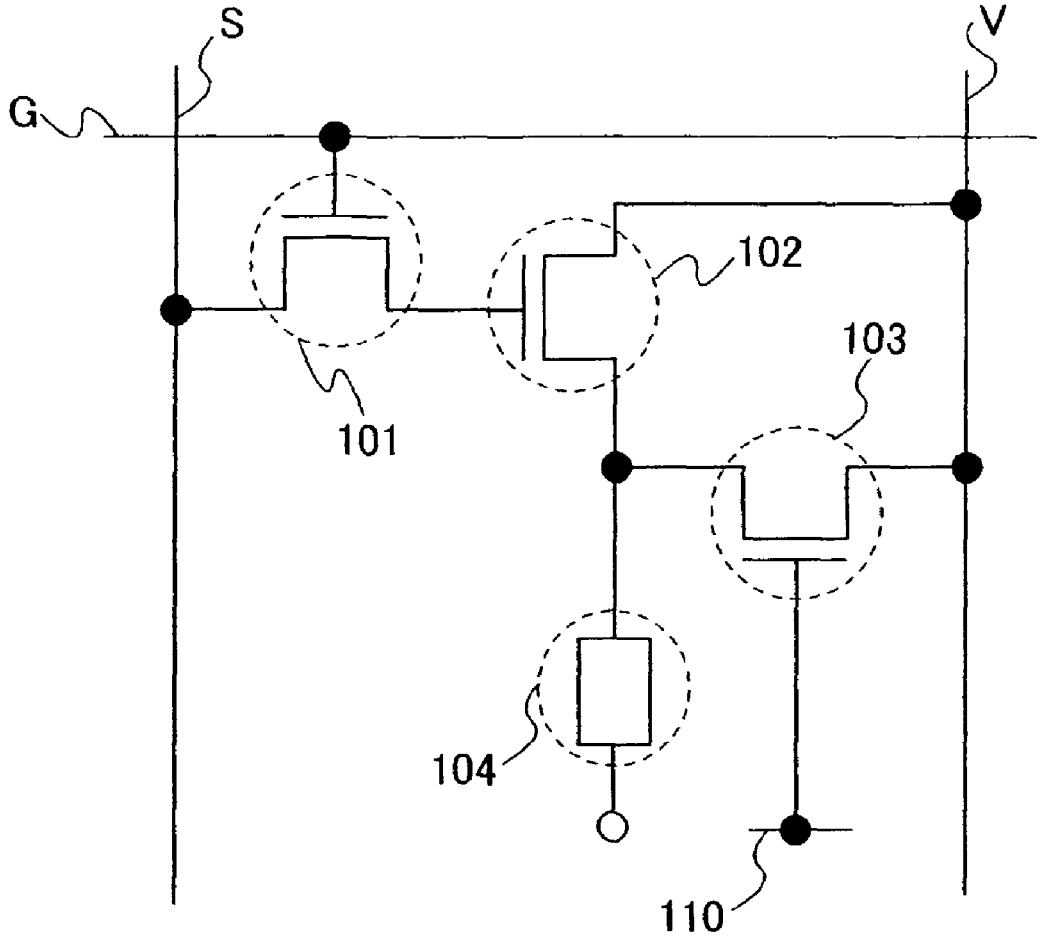
FIG. 21 is a circuit diagram of a pixel used in a display device of the present invention.

A circuit constituting a pixel shown in FIG. 21 includes a light emitting element 104, a transistor used as a switching element for controlling the input of a video signal to a pixel (a switching transistor 101), a transistor that controls the value of a current flowing to the light emitting element 104 (a driving transistor 102), and a transistor that applies a reverse bias current to the light emitting element 104 when a reverse voltage is applied to the light emitting element 104 (an AC transistor 103). The switching transistor 101, the driving transistor 102, and the AC transistor 103 have the same conductivity type, and an N-type transistor is used for each of these transistors, which is a characteristic of the present invention. Although a capacitor element is not provided in this embodiment mode, a capacitor element for maintaining a potential of a video signal may be provided.

As shown in FIG. 21, a gate electrode of the switching transistor 101 is connected to a scanning line G. One of a source electrode or drain electrode of the switching transistor 101 is connected to a signal line S, and the other one is connected to a gate electrode of the driving transistor 102. One of a source electrode or drain electrode of the driving transistor 102 is connected to a power line V, and the other one is connected to a pixel electrode of the light emitting element 104.

Furthermore, in this embodiment mode, one of a source electrode or drain electrode of the AC transistor 103 is connected to a power line V, and the other one is connected to the pixel electrode of the light emitting element 104. A gate electrode of the AC transistor 103 is connected to a wiring 110.

In this embodiment mode, an operation in the case where the wiring 110 and the counter electrode of the light emitting element 104 are connected to each other will be described. By connecting the wiring 110 and the counter electrode of the light emitting element 104 to each other, power consumption can be reduced. Furthermore, since the counter electrode of the light emitting element 104 and the wiring 110 are in contact with each other, the wiring 110 functions as an auxiliary electrode of the counter electrode of the light emitting element 104; thereby reducing resistance of the counter electrode of the light emitting element 104. Then, a film thickness of the counter electrode of the light emitting element 104 can be decreased, and transmission factors of the counter electrode of the light emitting element 104 and the wiring 110 can be increased. Accordingly, higher luminance can be obtained through a top emission structure in which light emitted by the light emitting element 104 is extracted from a top face. It is to be noted that a structure in which the wiring 110 and the light emitting element 104 are not connected to each other may be employed, depending on the circumstances.

When the switching transistor 101 is in a non-select state (an off state), a gate potential of the driving transistor 102 is maintained by a gate capacitance of the driving transistor 102. It is to be noted that, although a configuration in which the gate potential is maintained by the gate capacitance of the driving transistor without a capacitor element being provided is shown in FIG. 21, the present invention is not limited to this configuration, and a configuration in which the capacitor element is provided may also be employed.

Furthermore, in this embodiment mode, L/W, a ratio of channel length L to channel width W, of the driving transistor 102 is larger than L/W of the AC transistor 103. Specifically, as for the driving transistor 102, L is larger than W, and more preferably, the ratio is 5/1 or more. As for the AC transistor 103, L is shorter than or equal to W. In this way, the value of a current flowing in a reverse direction when a reverse voltage is applied to the light emitting element 104 in the pixel can be larger than the value of a current flowing in a forward direction when a forward voltage is applied to the light emitting element 104.

Here, it can be said that the switching transistor preferably has a structure with a smaller leakage current (an off-state current and a gate leakage current). It is to be noted that an off-state current is a current that flows between a source and a drain when a transistor is off, and a gate leakage current is a current that flows between a gate and a source or between a gate and a drain via a gate insulating film.

Accordingly, an N-channel transistor used as the switching transistor 101 is preferably has a structure with a low concentration impurity region (also referred to as a Lightly Doped Drain: LDD region), because a transistor having a structure with an LDD region can reduce an off-state current. In addition, the switching transistor 101 needs to increase an on-state current when applying a current to the light emitting element 104.

As an even more preferable mode, an LDD region is provided in the switching transistor 101, and the LDD region includes a region overlapping a gate electrode. Then, the switching transistor 101 can increase an on-state current, and decrease generation of a hot electron. Accordingly, reliability of the switching transistor 101 improves.

In addition, reliability of the driving transistor 102 also improves by providing the driving transistor 102 with an LDD region overlapping a gate electrode.

Furthermore, an off-state current can be reduced by decreasing a film thickness of a gate insulating film. Accordingly, the film thickness of the switching transistor 101 may be made thinner than the film thickness of the driving transistor 102.

Furthermore, by forming the switching transistor 101 as a transistor with a multi-gate structure such as a double-gate structure, a gate leakage current can be reduced. Also in the driving transistor 102, by employing a multi-gate structure such as a double-gate structure, a gate leakage current can be reduced, and the reliability can be improved.

In particular, if an off-state current flows to the switching transistor 101, gate capacitance of the driving transistor 102 cannot maintain a voltage which is written during a writing period. Therefore, it is preferable that an off-state current be reduced by providing an LDD region, thinning a gate insulating film, or employing a multi-gate structure in the switching transistor 101.

Next, an operation of the circuit configuration in FIG. 21 will be described with reference to FIGS. 22A to 22C.

Figure 22A:
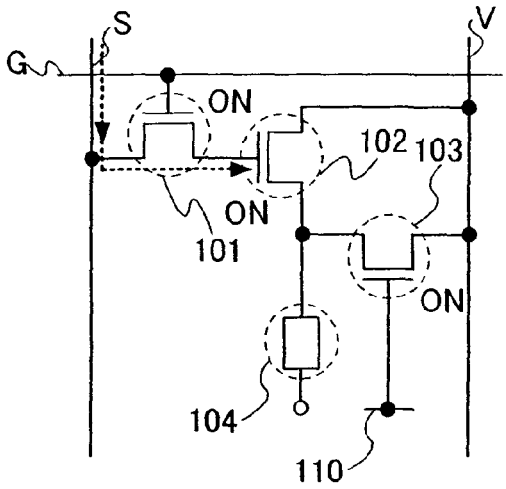
FIGS. 22A to 22C are circuit diagrams of a pixel used in a display device of the present invention.

First, during a writing period of FIG. 22A, the switching transistor 101 having the gate electrode connected to the scanning line G is turned on when the scanning line G is selected. Then, a potential Vsig of a video signal input to the signal line S is input to the gate electrode of the driving transistor 102 via the switching transistor 101, and a gate potential of the driving transistor 102 is maintained by a gate capacitance of the driving transistor 102.

A potential Vss1 of the power line V is set to be lower than or equal to a potential Vss of the counter electrode of the light emitting element 104 (that is, Vss>Vss1 is satisfied), so that the light emitting element 104 does not emit light. As the potential Vss, GND (a ground potential), 0 V, or the like may be applied, for example. In addition, a reverse bias current flows to the light emitting element 104 by a potential difference between the set Vss1 and Vss (however, when Vss1 and Vss are the same potential, the reverse bias current does not flow).

A potential of the wiring 110 which is connected to the gate electrode of the AC transistor 103 becomes equal to the potential Vss of the counter electrode of the light emitting element 104 since it is connected to the counter electrode of the light emitting element 104. Therefore, the potential of the wiring 110 becomes Vss, which is higher than or equal to the potential Vss1 of the power line V.

Accordingly, in the case where Vss1 is lower than Vss, the electrode of the AC transistor 103, connected to the power line V, becomes the source electrode, and a potential of the source electrode of the AC transistor 103 becomes lower than a potential of the gate electrode. Therefore, the AC transistor 103 is turned on and a reverse bias current flows to the light emitting element 104. In addition, in the case where Vss1 is equal to Vss, the AC transistor is turned off, and no current flows to the light emitting element 104. Accordingly, even if Vss1 is lower than or equal to Vss, the light emitting element 104 does not emit light during the writing period.

It is to be noted that, although the description is made for the case where the driving transistor 102 is turned on by the potential Vsig of the video signal during the writing period, also in the case where the driving transistor 102 is turned off by the potential Vsig of the video signal, no forward bias current is supplied to the light emitting element 104 and the light emitting element 104 does not emit light.

Figure 22B:
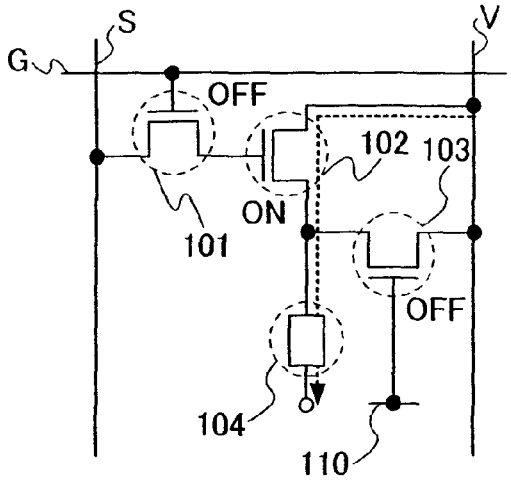

Next, during a display period of FIG. 22B, the switching transistor 101 is turned off by controlling a potential of the scanning line G, and the potential Vsig of the video signal which is written during the writing period is maintained by the gate capacitance of the driving transistor 102, so that the driving transistor 102 is on.

In addition, a potential Vdd1 of the power line V is set to be higher than the potential Vss of the counter electrode of the light emitting element 104 (that is, Vdd1>Vss is satisfied), so that a forward bias current flows to the light emitting element 104 and the light emitting element 104 emits light.

On the other hand, since the potential Vdd1 of the power line V is set to be higher than the potential Vss of the counter electrode of the light emitting element 104, the potential Vss of the wiring 110 connected to the gate electrode of the AC transistor 103 becomes lower than the potential Vdd1 of the power line V In addition, the electrode of the AC transistor 103, connected to the power line V, becomes the drain electrode, and the drain electrode of the AC transistor 103 has a higher potential than a potential of the gate electrode, so that the AC transistor 103 is turned off.

It is to be noted that, although the description is made for the case where the driving transistor 102 is turned on by the potential Vsig of the video signal during the writing period, in the case where the driving transistor 102 is turned off by the potential Vsig of the video signal, no forward bias current is supplied to the light emitting element 104. Therefore, no forward bias current is supplied to the light emitting element 104, not even during the display period, in this case.

Figure 22C:
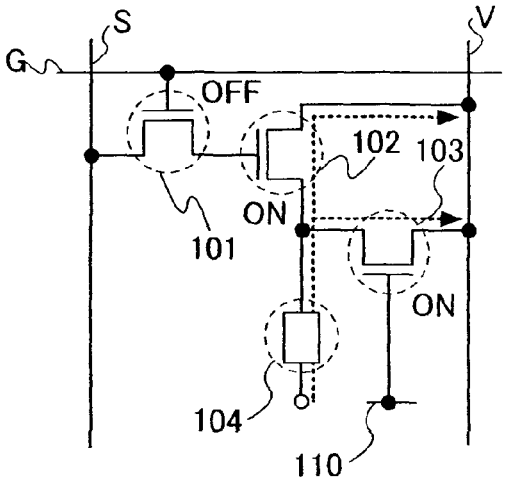

Next, during a reverse bias period (non-lighting period) of FIG. 22C, the potential of the scanning line G is controlled so that the switching transistor 101 is off.

In addition, a potential Vss1' of the power line V is set to be lower than the potential Vss of the counter electrode of the light emitting element 104 (that is, Vss>Vss1'). By doing so, the electrode of the AC transistor 103, connected to the power line V, becomes the source electrode, and a potential of the gate electrode of the AC transistor becomes higher than the source electrode, so that the AC transistor 103 is turned on. Therefore, a reverse voltage is applied to the light emitting element 104, and a reverse bias current flows in the light emitting element 104 and the AC transistor 103.

In the case where the driving transistor 102 is on due to the potential Vsig of the video signal during the writing period and the display period, the gate capacitance maintains the potential Vsig of the video signal during a reverse bias period, as well, so that the driving transistor 102 is on. Accordingly, a reverse bias current flows to the driving transistor 102. However, as described above, by making L/W of the driving transistor 102 larger than L/W of the AC transistor 103, the value of a current flowing to the driving transistor 102 becomes smaller than the value of a current flowing to the AC transistor 103. Of course, in the case where the driving transistor 102 is off during the writing period and the display period, no current is supplied to the driving transistor 102.

In addition, a potential difference between Vss1' and Vss during the reverse bias period may be larger than a potential difference between Vdd1 and Vss during the display period. In this way, the value of a reverse bias current becomes larger than the value of a forward bias current, and an even larger current can flow to the light emitting element 104 during the reverse bias period.

Although the operation in which the potential of the power line V is changed is described in this embodiment mode, the present invention is not limited thereto. For example, just the potential of the counter electrode of the light emitting element 104 (that is, the potential of the wiring 110 connected to the gate electrode of the AC transistor 103) may be changed, or both the potential of the power line V and the potential of the counter electrode of the light emitting element 104 may be changed.

Next, a driving method of a digital time gray scale method using a pixel shown in FIG. 21 is in accordance with the timing charts of FIGS. 9A, 9B, 10A, 10B, 23A, and 23B. The method is similar to the description made in Embodiment Mode 3 using FIGS. 9A, 9B, 10A, 10B, 23A, and 23B, so the description is omitted here.

As described above, in a structure of the present invention, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

Embodiment Mode 7

(Circuit Configuration 6)

In this embodiment mode, a configuration different from the circuit configuration of FIG. 1 described in Embodiment Mode 1 will be described.

Figure 24:
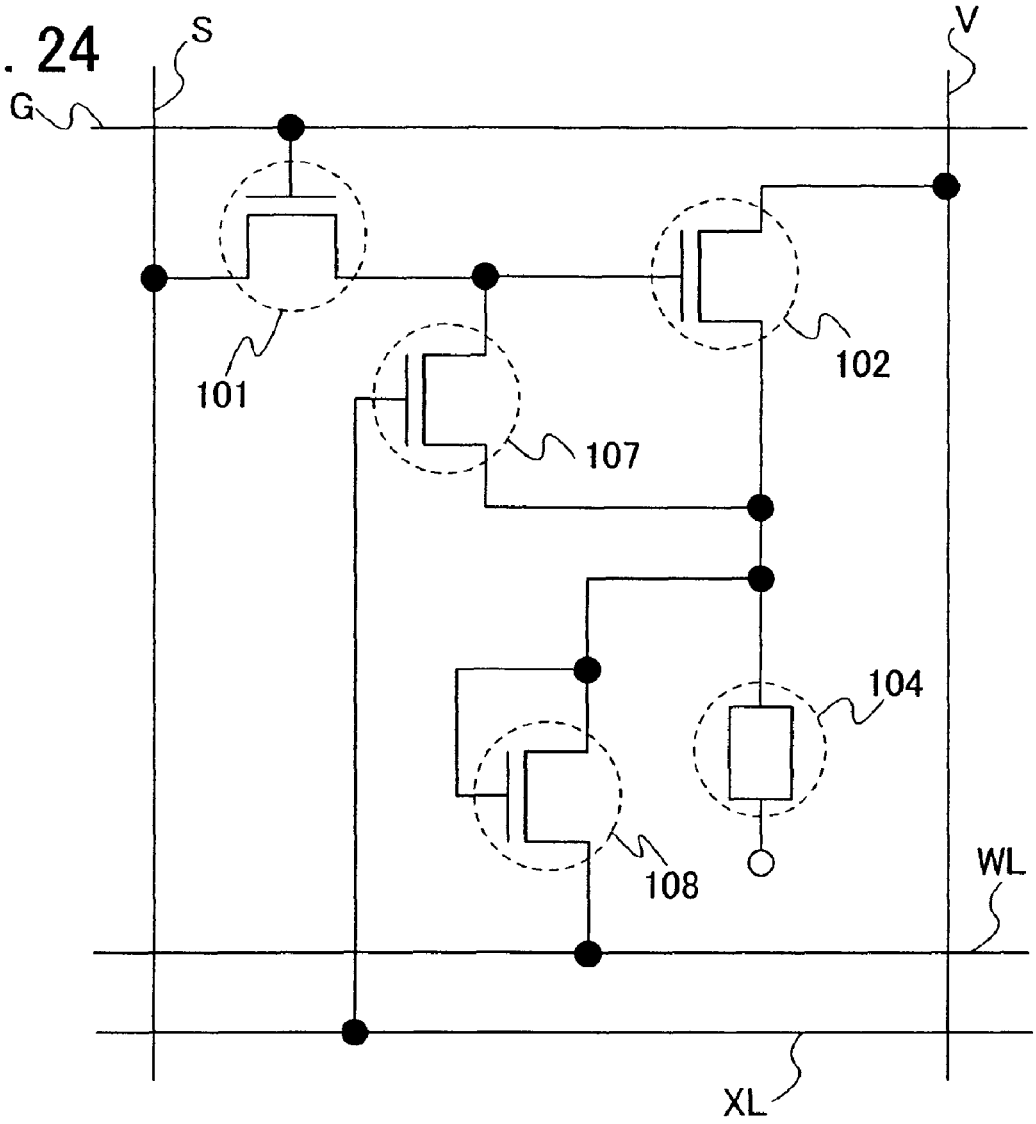
FIG. 24 is a circuit diagram of a pixel used in a display device of the present invention.

A circuit constituting a pixel shown in FIG. 24 includes a light emitting element 104, a transistor used as a switching element for controlling the input of a video signal to a pixel (a switching transistor 101), a transistor that controls the value of a current flowing to the light emitting element 104 (a driving transistor 102), and transistors that apply a reverse bias current to the light emitting element 104 when a reverse voltage is applied to the light emitting element 104 (a first AC transistor 107 and a second AC transistor 108). The switching transistor 101, the driving transistor 102, the first AC transistor 107, and the second AC transistor 108 have the same conductivity type, and an N-type transistor is used for each of these transistors, which is a characteristic of the present invention. Although a capacitor element is not provided in this embodiment mode, a capacitor element for maintaining a potential of a video signal may be provided.

As shown in FIG. 24, a gate electrode of the switching transistor 101 is connected to a scanning line G. One of a source electrode or drain electrode of the switching transistor 101 is connected to a signal line S, and the other one is connected to a gate electrode of the driving transistor 102. One of a source electrode or drain electrode of the driving transistor 102 is connected to a power line V, and the other one is connected to a pixel electrode of the light emitting element 104.

In addition, in this embodiment mode, one of a source electrode or drain electrode of the first AC transistor 107 is connected to the gate electrode of the driving transistor 102, and the other one is connected to the pixel electrode of the light emitting element 104 and either the source electrode or drain electrode of the driving transistor 102. A gate electrode of the first AC transistor 107 is connected to a second potential control line XL. Furthermore, one of a source electrode or drain electrode of the second AC transistor 108 is connected to a first potential control line WL, and the other one is connected to the pixel electrode of the light emitting element 104. A gate electrode of the second AC transistor 108 is connected to the source electrode or drain electrode of the second AC transistor 108, which is connected to the pixel electrode of the light emitting element 104.

When the switching transistor 101 is in a non-select state (an off state), a gate potential of the driving transistor 102 is maintained by a gate capacitance of the driving transistor 102. It is to be noted that, although a configuration in which the gate potential is maintained by the gate capacitance of the driving transistor without a capacitor element being provided is shown in FIG. 24, the present invention is not limited to this configuration, and a configuration in which the capacitor element is provided may also be employed.

Furthermore, L/W, a ratio of channel length L to channel width W, of the driving transistor 102 may be larger than L/W of the second AC transistor 108. Specifically, as for the driving transistor 102, L is larger than W, and more preferably, the ratio is 5/1 or more. As for the second AC transistor 108, L is shorter than or equal to W. In this way, the value of a current flowing in a reverse direction when a reverse voltage is applied to the light emitting element 104 in the pixel can be larger than the value of a current flowing in a forward direction when a forward voltage is applied to the light emitting element 104.

Here, it can be said that the switching transistor preferably has a structure with a smaller leakage current (an off-state current and a gate leakage current). It is to be noted that an off-state current is a current that flows between a source and a drain when a transistor is off, and a gate leakage current is a current that flows between a gate and a source or between a gate and a drain via a gate insulating film.

Accordingly, an N-channel transistor used as the switching transistor 101 preferably has a structure provided with a low concentration impurity region (also referred to as a Lightly Doped Drain: LDD region), because a transistor having a structure provided with an LDD region can reduce an off-state current. In addition, because the switching transistor 101 needs to increase an on-state current when applying a current to the light emitting element 104.

As an even more preferable mode, an LDD region is provided in the switching transistor 101, and the LDD region includes a region overlapping a gate electrode. Then, the switching transistor 101 can increase an on-state current, and decrease generation of a hot electron. Accordingly, reliability of the switching transistor 101 improves.

In addition, reliability of the driving transistor 102 also improves by providing the driving transistor 102 with an LDD region overlapping a gate electrode.

Furthermore, an off-state current can be reduced by decreasing a film thickness of a gate insulating film. Accordingly, the film thickness of the switching transistor 101 may be made thinner than the film thickness of the driving transistor 102.

Furthermore, by forming the switching transistor 101 as a transistor with a multi-gate structure such as a double-gate structure, a gate leakage current can be reduced. Also in the driving transistor 102, by employing a multi-gate structure such as a double-gate structure, a gate leakage current can be reduced, and the reliability can be improved.

In particular, if an off-state current flows to the switching transistor 101, gate capacitance of the driving transistor 102 cannot maintain a voltage which is written during a writing period. Therefore, it is preferable that an off-state current be reduced by providing an LDD region, thinning a gate insulating film, or employing a multi-gate structure in the switching transistor 101.

Next, an operation of the circuit configuration in FIG. 24 will be described with reference to FIGS. 25A to 25C.

Figure 25A:
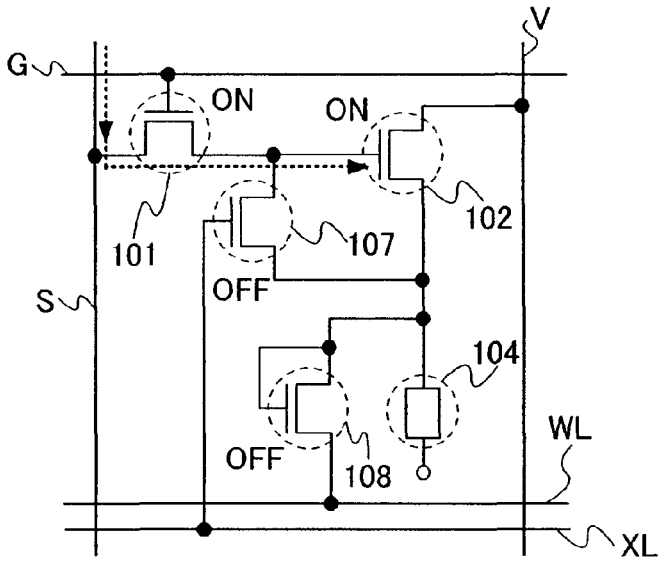
FIGS. 25A to 25C are circuit diagrams of a pixel used in a display device of the present invention.

First, during a writing period of FIG. 25A, the switching transistor 101 having the gate electrode connected to the scanning line G is turned on when the scanning line G is selected. Then, a potential Vsig of a video signal input to the signal line S is input to the gate electrode of the driving transistor 102 via the switching transistor 101, and a gate potential is maintained by a gate capacitance of the driving transistor 102.

A potential Vss1 of the power line V is set to be lower than or equal to a potential Vss of the counter electrode of the light emitting element 104 (that is, Vss≧Vss1 is satisfied), so that the light emitting element 104 does not emit light. As the potential Vss, GND (a ground potential), 0 V, or the like may be applied, for example. In addition, a reverse bias current flows to the light emitting element 104 by a potential difference between the set Vss1 and Vss (however, when Vss1 and Vss are the same potential, the reverse bias current does not flow).

On the other hand, during this writing period, a potential Vss3 of a second potential control line XL is set to be low enough to make the first AC transistor 107 be off. In addition, a potential Vdd2 of a first potential control line WL is set to be higher than the potential Vss of the counter electrode of the light emitting element 104 (that is, Vdd2>Vss is satisfied), so that the electrode of the second AC transistor 108, connected to the first potential control line WL, becomes the drain electrode, and the electrode of the second AC transistor 108, connected to the pixel electrode of the light emitting element 104, becomes the source electrode. Furthermore, the source electrode is connected to the gate electrode of the second AC transistor 108, so that the second AC transistor 108 is off.

It is to be noted that, although the description is made for the case where the driving transistor 102 is turned on by the potential Vsig of the video signal during the writing period, also in the case where the driving transistor 102 is turned off by the potential Vsig of the video signal, no current is supplied to the light emitting element 104 and the light emitting element 104 does not emit light.

Figure 25B:
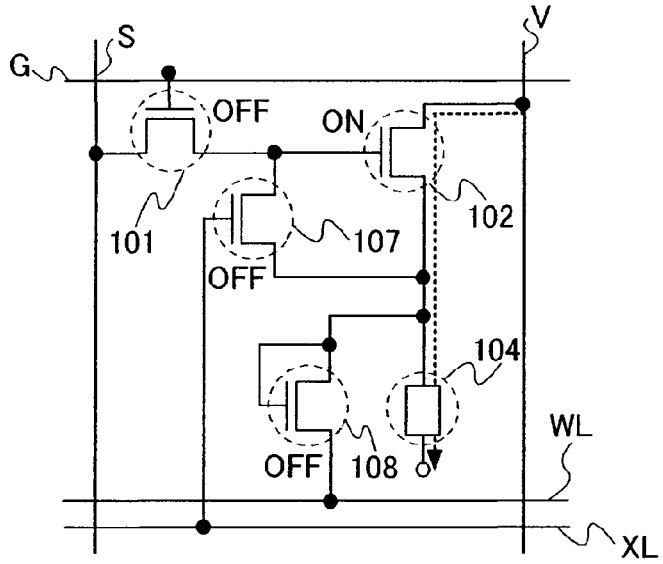

Next, during a display period of FIG. 25B, the switching transistor 101 is turned off by controlling a potential of the scanning line G. Since the potential Vsig of the video signal which is written during the writing period is maintained by the gate capacitance of the driving transistor 102, the driving transistor 102 is on. In addition, a potential Vdd1 of the power line V is set to be higher than the potential Vss of the counter electrode of the light emitting element 104 (that is, Vdd1>Vss is satisfied), so that a forward bias current flows to the light emitting element 104 and the light emitting element 104 emits light.

On the other hand, in the same way as for the writing period, the potential Vss3 of the second potential control line XL is set to be low enough to make the first AC transistor 107 be off. In addition, the potential Vdd2 of the first potential control line WL is set to be higher than the potential of the counter electrode of the light emitting element 104 (that is, Vdd2>Vss is satisfied). Accordingly, the electrode of the second AC transistor 108, connected to the first potential control line WL, becomes the drain electrode, and the electrode of the second AC transistor 108, connected to the pixel electrode of the light emitting element 104, becomes the source electrode. Furthermore, the source electrode is connected to the gate electrode of the second AC transistor 108, so that the second AC transistor 108 is off also during the display period.

It is to be noted that, although the description is made for the case where the driving transistor 102 is turned on by the potential Vsig of the video signal during the writing period, in the case where the driving transistor 102 is turned off by the potential Vsig of the video signal, no current is supplied to the light emitting element 104. Therefore, no current is supplied to the light emitting element 104 not even during the display period, in this case.

Figure 25C:
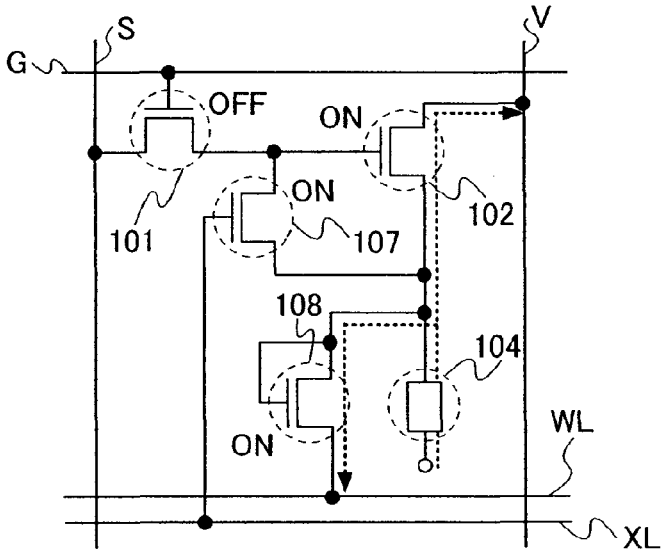

Next, during a reverse bias period (non-lighting period) of FIG. 25C, the switching transistor 101 is turned off by controlling the potential of the scanning line G In addition, a potential Vss1' of the power line V is set to be lower than the potential Vss of the counter electrode of the light emitting element 104 (that is, Vss>Vss1' is satisfied). Under this condition and in the case where the driving transistor 102 is turned on, the electrode of the driving transistor 102, connected to the power line V, becomes the source electrode, and the electrode of the driving transistor 102, connected to the pixel electrode of the light emitting element 104, becomes the drain electrode.

Furthermore, a potential Vdd3 of the second potential control line XL is set to be high enough to turn on the first AC transistor 107. In this way, the gate electrode and the drain electrode of the driving transistor 102 have the same potential, and the driving transistor 102 is on.

In addition, by setting a potential Vss2 of the first potential control line WL to be lower than the potential Vss of the counter electrode of the light emitting element 104 (that is, Vss>Vss2 is satisfied), the electrode of the second AC transistor 108, connected to the first potential control line WL, becomes the source electrode, and the electrode connected to the pixel electrode of the light emitting element 104 becomes the drain electrode. Furthermore, the drain electrode is connected to the gate electrode of the second AC transistor 108, so that the second AC transistor 108 is turned on.

Accordingly, by using the two AC transistors, a reverse voltage is applied to the light emitting element 104, and a reverse bias current flows in the light emitting element 104, the driving transistor 102, and the second AC transistor 108.

It is to be noted that, as described above, a current flowing to the second AC transistor 108 can be made larger than a current flowing to the driving transistor 102 by making L/W of the driving transistor 102 larger than L/W of the second AC transistor 108. In other words, the value of a reverse bias current becomes larger than the value of a forward bias current, and a large current can flow to the light emitting element 104 during a reverse bias period.

In addition, a potential difference between Vss1' and Vss during the reverse bias period may be larger than a potential difference between Vdd1 and Vss during the display period. In this way, the value of a reverse bias current becomes larger than the value of a forward bias current, and an even larger current can flow to the light emitting element 104 during the reverse bias period.

It is to be noted that, although a potential of the counter electrode of the light emitting element 104 is a fixed potential in this embodiment mode, the present invention is not limited thereto. For example, just the potential of the counter electrode of the light emitting element 104 may be changed, or both the potential of the power line V and the potential of the counter electrode of the light emitting element 104 may be changed.

Next, a driving method of a digital time gray scale method using a pixel shown in FIG. 24 is in accordance with the timing charts of FIGS. 9A, 9B, 10A, 10B, 23A, and 23B. The method is similar to the description made in Embodiment Mode 3 using FIGS. 9A, 9B, 10A, 10B, 23A, and 23B, so the description is omitted here.

As described above, in a structure of the present invention, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

Embodiment Mode 8

(Circuit Configuration 7)

In this embodiment mode, a configuration different from the circuit configuration of FIG. 1 described in Embodiment Mode 1 will be described.

Figure 26:
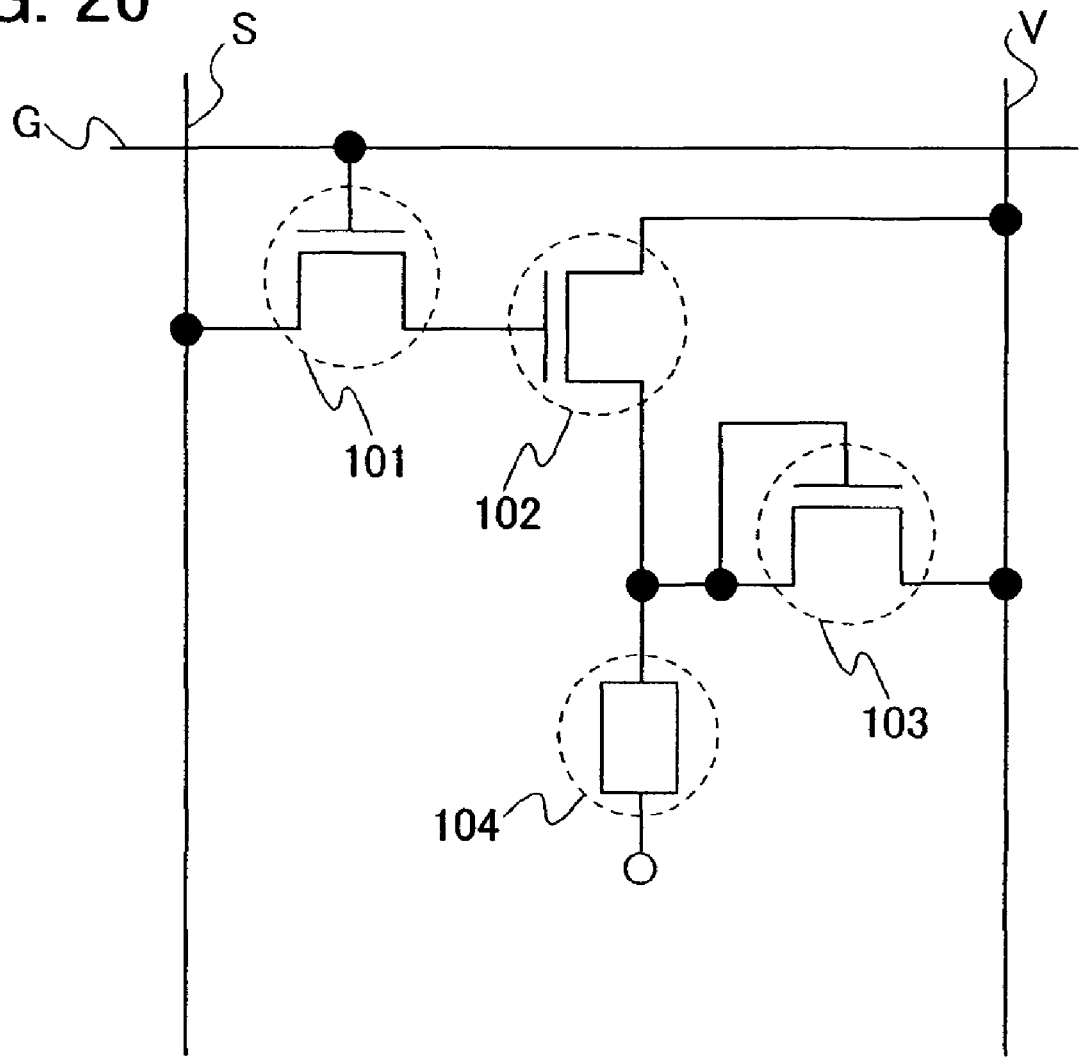
FIG. 26 is a circuit diagram of a pixel used in a display device of the present invention.

A circuit constituting a pixel shown in FIG. 26 includes a light emitting element 104, a transistor used as a switching element for controlling the input of a video signal to a pixel (a switching transistor 101), a transistor that controls the value of a current flowing to the light emitting element 104 (a driving transistor 102), and a transistor that applies a reverse bias current to the light emitting element 104 when a reverse voltage is applied to the light emitting element 104 (an AC transistor 103). The switching transistor 101, the driving transistor 102, and the AC transistor 103 have the same conductivity type, and an N-type transistor is used for each of these transistors, which is a characteristic of the present invention. Although a capacitor element is not provided in this embodiment mode, a capacitor element for maintaining a potential of a video signal may be provided.

As shown in FIG. 26, a gate electrode of the switching transistor 101 is connected to a scanning line G. One of a source electrode or drain electrode of the switching transistor 101 is connected to a signal line S, and the other one is connected to a gate electrode of the driving transistor 102. One of a source electrode or drain electrode of the driving transistor 102 is connected to a power line V, and the other one is connected to a pixel electrode of the light emitting element 104.

Furthermore, in this embodiment mode, one of a source electrode or drain electrode of the AC transistor 103 is connected to the power line V, and the other one is connected to the pixel electrode of the light emitting element 104. A gate electrode of the AC transistor 103 is connected to the source electrode or drain electrode of the AC transistor 103, which is connected to the pixel electrode of the light emitting element 104.

When the switching transistor 101 is in a non-select state (an off state), a gate potential of the driving transistor 102 is maintained by a gate capacitance of the driving transistor 102. It is to be noted that, although a configuration in which the gate potential is maintained by the gate capacitance of the driving transistor without a capacitor element being provided is shown in FIG. 26, the present invention is not limited to this configuration, and a configuration in which the capacitor element is provided may also be employed.

Furthermore, in this embodiment mode, L/W, a ratio of channel length L to channel width W, of the driving transistor 102 is larger than L/W of the AC transistor 103. Specifically, as for the driving transistor 102, L is larger than W, and more preferably, the ratio is 5/1 or more. As for the AC transistor 103, L is shorter than or equal to W. In this way, the value of a current flowing in a reverse direction when a reverse voltage is applied to the light emitting element 104 in the pixel can be larger than the value of a current flowing in a forward direction when a forward voltage is applied to the light emitting element 104.

Here, it can be said that the switching transistor preferably has a structure with a smaller leakage current (an off-state current and a gate leakage current). It is to be noted that an off-state current is a current that flows between a source and a drain when a transistor is off, and a gate leakage current is a current that flows between a gate and a source or between a gate and a drain via a gate insulating film.

Accordingly, an N-channel transistor used as the switching transistor 101 preferably has a structure provided with a low concentration impurity region (also referred to as a Lightly Doped Drain: LDD region), because a transistor having a structure provided with an LDD region can reduce an off-state current. In addition, because the switching transistor 101 needs to increase an on-state current when applying a current to the light emitting element 104.

As an even more preferable mode, an LDD region is provided in the switching transistor 101, and the LDD region includes a region overlapping a gate electrode. Then, the switching transistor 101 can increase an on-state current, and decrease generation of a hot electron. Accordingly, reliability of the switching transistor 101 improves.

In addition, reliability of the driving transistor 102 also improves by providing the driving transistor 102 with an LDD region overlapping a gate electrode.

Furthermore, an off-state current can be reduced by decreasing a film thickness of a gate insulating film. Accordingly, the film thickness of the switching transistor 101 may be made thinner than the film thickness of the driving transistor 102.

Furthermore, by forming the switching transistor 101 as a transistor with a multi-gate structure such as a double-gate structure, a gate leakage current can be reduced. Also in the driving transistor 102, by employing a multi-gate structure such as a double-gate structure, a gate leakage current can be reduced, and the reliability can be improved.

In particular, if an off-state current flows to the switching transistor 101, gate capacitance of the driving transistor 102 cannot maintain a voltage which is written during a writing period. Therefore, it is preferable that an off-state current be reduced by providing an LDD region, thinning a gate insulating film, or employing a multi-gate structure in the switching transistor 101.

Next, an operation of the circuit configuration in FIG. 26 will be described with reference to FIGS. 27A to 27C.

Figure 27A:
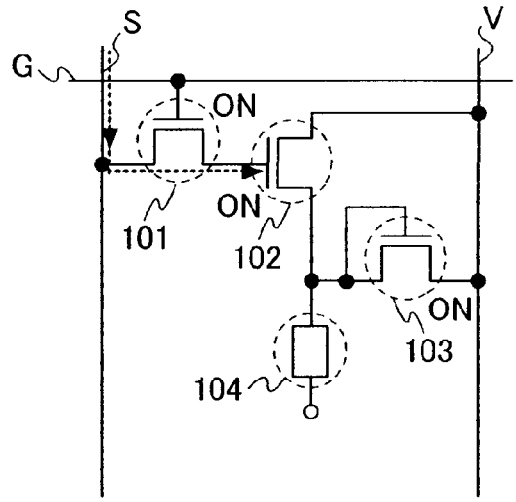
FIGS. 27A to 27C are circuit diagrams of a pixel used in a display device of the present invention.
Figure 27B:
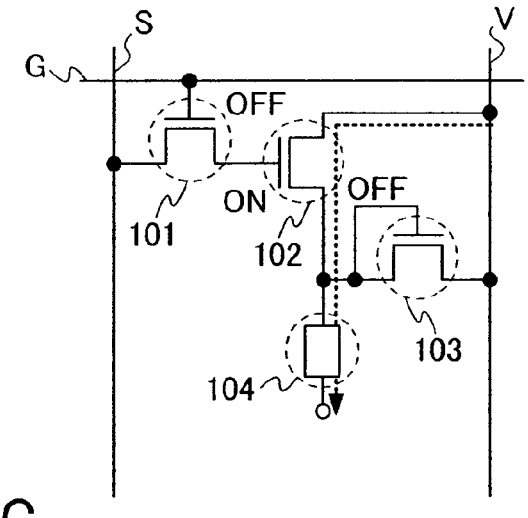

First, during a writing period of FIG. 27A, the switching transistor 101 having the gate electrode connected to the scanning line G is turned on when the scanning line G is selected. Then, a potential Vsig of a video signal input to the signal line S is input to the gate electrode of the driving transistor 102 via the switching transistor 101, and a gate potential is maintained by a gate capacitance of the driving transistor 102.

A potential Vss1 of the power line V is set to be lower than or equal to a potential Vss of the counter electrode of the light emitting element 104 (that is, Vss≧Vss1 is satisfied), so that the light emitting element 104 does not emit light. As the potential Vss, GND (a ground potential), 0 V, or the like may be applied, for example. In addition, a reverse bias current flows to the light emitting element 104 by a potential difference between the set Vss1 and Vss (however, when Vss1 and Vss are the same potential, the reverse bias current does not flow).

On the other hand, during this writing period, the potential Vss1 of the power line V is set to be lower than or equal to a potential of the counter electrode of the light emitting element 104, so that the AC transistor 103 is off and no current flows to the light emitting element 104, in the case where Vss1 and Vss are the same potential. In addition, in the case where Vss1 is lower than Vss, the electrode of the AC transistor 103, connected to the power line V, becomes the source electrode, and the electrode connected to the pixel electrode of the light emitting element 104 becomes the drain electrode. Since the source electrode is connected to the gate electrode of the AC transistor 103, the AC transistor 103 is turned on and a reverse bias current flows to the light emitting element 104. Accordingly, even if Vss1 is lower than or equal to Vss, the light emitting element 104 does not emit light during a reverse bias period.

It is to be noted that, although the description is made for the case where the driving transistor 102 is turned on by the potential Vsig of the video signal during the writing period, also in the case where the driving transistor 102 is turned off by the potential Vsig of the video signal, no forward bias current is supplied to the light emitting element 104 and the light emitting element 104 does not emit light.

Next, during a display period of FIG. 25B, the switching transistor 101 is turned off by controlling a potential of the scanning line G. Since the potential Vsig of the video signal which is written during the writing period is maintained by the gate capacitance of the driving transistor 102, the driving transistor 102 is on.

In addition, a potential Vdd1 of the power line V is set to be higher than the potential Vss of the counter electrode of the light emitting element 104 (that is, Vdd1>Vss is satisfied), so that a forward bias current flows to the light emitting element 104 and the light emitting element 104 emits light.

On the other hand, since the potential Vdd1 of the power line V is set to be higher than the potential Vss of the counter electrode of the light emitting element 104, the electrode of the AC transistor, connected to the power line V, becomes the drain electrode, and the electrode connected to the pixel electrode of the light emitting element 104 becomes the source electrode. Furthermore, the source electrode is connected to the gate electrode of the AC transistor 103, so that the AC transistor 103 is turned off.

It is to be noted that, although the description is made for the case where the driving transistor 102 is turned on by the potential Vsig of the video signal during the writing period, in the case where the driving transistor 102 is turned off by the potential Vsig of the video signal, no forward bias current is supplied to the light emitting element 104. Therefore, no forward bias current is supplied to the light emitting element 104, not even during the display period, in this case.

Figure 27C:
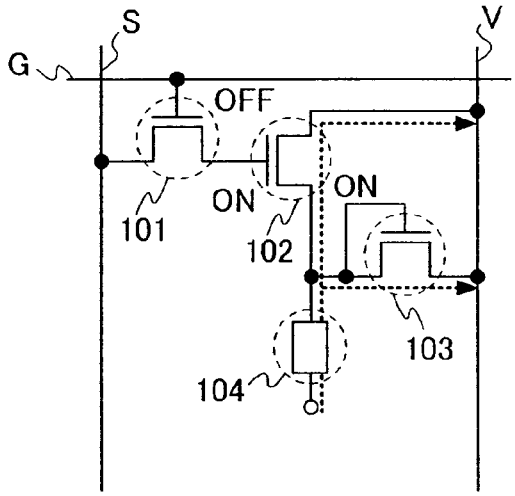

Next, during a reverse bias period (non-lighting period) of FIG. 27C, the potential of the scanning line G is controlled so that the switching transistor 101 is off.

In addition, a potential Vss1' of the power line V is set to be lower than the potential Vss of the counter electrode of the light emitting element 104 (that is, Vss>Vdd1' is satisfied). Accordingly, the electrode of the AC transistor 103, connected to the power line V, becomes the source electrode, and the electrode connected to the pixel electrode of the light emitting element 104 becomes the drain electrode. Furthermore, since the drain electrode is connected to the gate electrode of the AC transistor 103, the AC transistor 103 is turned on. Accordingly, a reverse voltage is applied to the light emitting element 104, and a reverse bias current flows in the light emitting element 104 and the AC transistor 103.

In the case where the driving transistor 102 is on due to the potential Vsig of the video signal during the writing period and the display period, the gate capacitance maintains the potential Vsig of the video signal during a reverse bias period, as well, so that the driving transistor is on. Accordingly, a reverse bias current flows to the driving transistor 102. However, as described above, by making L/W of the driving transistor 102 larger than L/W of the AC transistor 103, the value of a current flowing to the driving transistor 102 becomes smaller than the value of a current flowing to the AC transistor 103. Of course, in the case where the driving transistor 102 is off during the writing period and the display period, no current is supplied to the driving transistor 102.

In addition, a potential difference between Vss1' and Vss during the reverse bias period may be larger than a potential difference between Vdd1 and Vss during the display period. In this way, the value of a reverse bias current becomes larger than the value of a forward bias current, and a larger current can flow to the light emitting element 104 during the reverse bias period.

It is to be noted that, although a potential of the counter electrode of the light emitting element 104 is a fixed potential in this embodiment mode, the present invention is not limited thereto. For example, just the potential of the counter electrode of the light emitting element 104 may be changed, or both the potential of the power line V and the potential of the counter electrode of the light emitting element 104 may be changed.

Next, a driving method of a digital time gray scale method using a pixel shown in FIG. 26 is in accordance with the timing charts of FIGS. 9A, 9B, 10A, 10B, 23A, and 23B. The method is similar to the description made in Embodiment Mode 3 using FIGS. 9A, 9B, 10A, 10B, 23A, and 23B, so the description is omitted here.

As described above, in a structure of the present invention, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

Hereinafter, embodiments of the present invention will be described.

Embodiment 1

Figure 37:
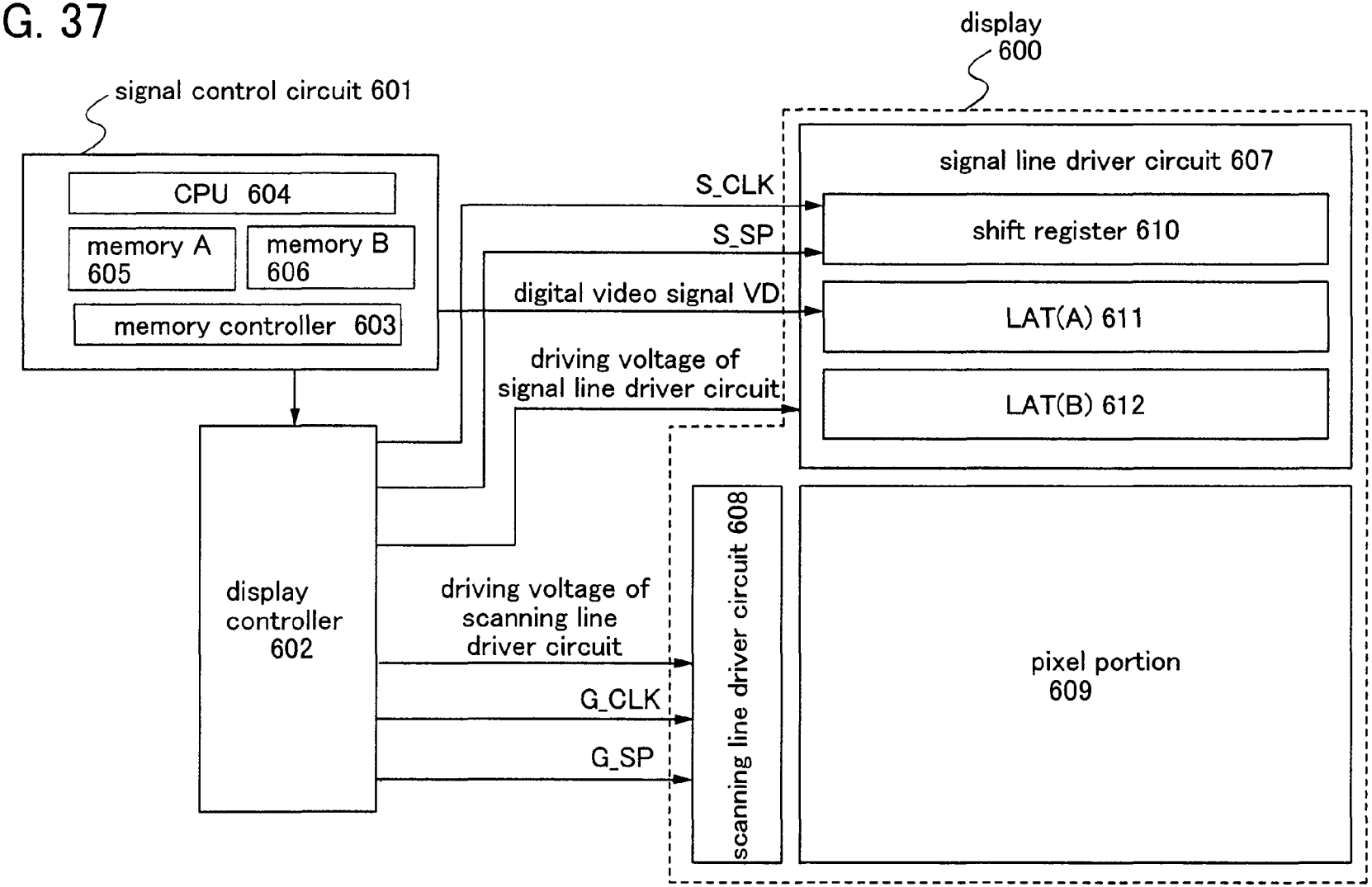
FIG. 37 is a diagram showing a structure of a controller used in a display device of the present invention.

Description will be made with reference to FIG. 37 on a circuit which inputs signals for driving a display using a digital time gray scale method to a signal line driver circuit and a scanning line driver circuit of the display.

In this embodiment, description will be made, of an example of a display device for displaying images by inputting 4-bit digital video signals to a display device. However, the present invention is not limited to the 4-bit signals.

A signal control circuit 601 reads in a digital video signal, and outputs a digital video signal VD to a display 600.

In this embodiment, a signal obtained by converting a digital video signal in the signal control circuit 601 into a signal to be input to the display is called a digital video signal VD.

Signals and driving voltages for driving a signal line driver circuit 607 and a scanning line driver circuit 608 in the display 600 are input by a display controller 602.

Description of a configuration of the signal control circuit 601 and the display controller 602 will be made.

The signal line driver circuit 607 in the display 600 includes a shift register 610, a LAT (A) 611, and a LAT (B) 612. Though not shown, a level shifter, a buffer and the like may be provided. It is to be noted that the present invention is not limited to such a configuration. It is also to be noted that a reference numeral 609 denotes a pixel portion.

The signal control circuit 601 includes a CPU 604, a memory A 605, a memory B 606 and a memory controller 603.

Digital video signals input to the signal control circuit 601 are controlled by the memory controller 603 and input to the memory A 605 through a switch. The memory A 605 has a capacity high enough to store digital video signals for the whole pixels of the display 600. When signals for one frame period are stored in the memory A 605, a signal of each bit is sequentially read out by the memory controller 603, which is then input to the source signal line driver circuit 607 as a digital video signal VD.

When the read operation of the signal stored in the memory A 605 starts, a digital video signal corresponding to the next frame period is input to the memory B 606 though the memory controller 603, and thus starts to be stored therein. The memory B 606 has, similarly to the memory A 605, a capacity high enough to store digital video signals for the whole pixels of the display device.

In this manner, the signal control circuit 601 has the memory A 605 and the memory B 606 each of which is capable of storing digital video signals for one frame period. By alternately using the memory A 605 and the memory B 606, digital video signals VD are sampled.

Here, description is made of the signal control circuit 601 which stores signals by alternately using the two memories A 605 and B 606. In general, a display device has a plurality of memories for storing data of a plurality of frames, which can be used alternately.

Figure 38:
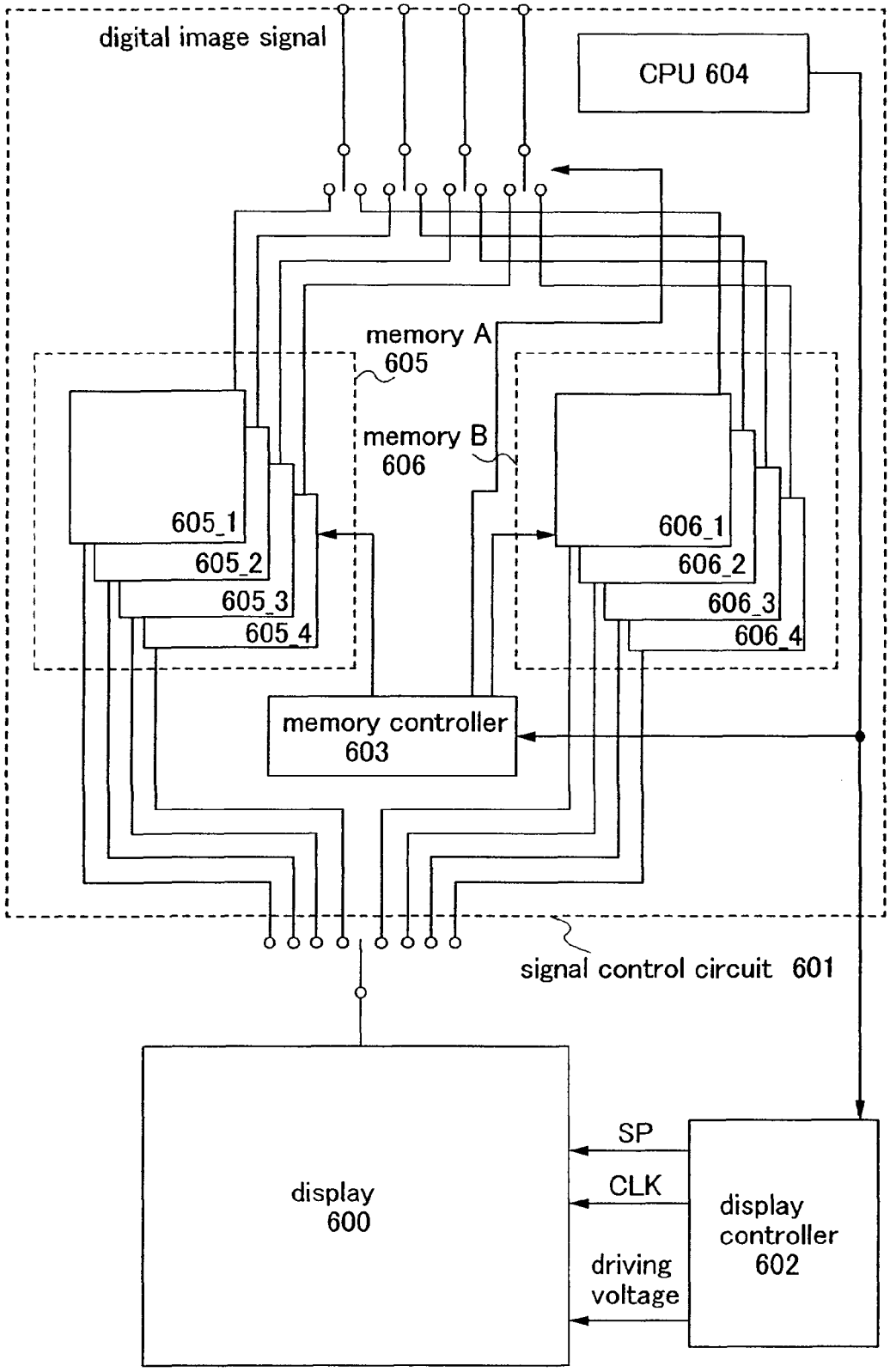
FIG. 38 is a block diagram showing a structure of a display device of the present invention.

FIG. 38 is a block diagram of a display device having the above-described configuration.

The display device includes the signal control circuit 601, the display controller 602, and the display 600.

The display controller 602 supplies start pulses SP, clock pulses CLK, driving voltages and the like to the display 600.

The signal control circuit 601 includes the CPU 604, the memory A 605, the memory B 606, and the memory controller 603.

The memory A 605 includes memories 605_1 to 605_4 which store data of first to fourth bits of a digital video signal respectively. Similarly, the memory B 606 includes memories 606_1 to 606_4 which store data of first to fourth bits of a digital video signal respectively. The memory corresponding to each bit has memory elements for storing one bit of a signal, in the corresponding number of pixels which constitute one image.

In general, in a display device capable of displaying gray scales using n-bit digital video signals, the memory A 605 includes memories 605_1 to 605_n for storing data of first to n-th bits respectively. Similarly, the memory B 606 includes memories 606_1 to 606_n for storing data of first to n-th bits respectively. The memory corresponding to each bit has a capacity high enough to store one bit of a signal correspondingly to the number of pixels which constitute one image.

Description will be made hereinafter on the configuration of the display controller 602.

Figure 39:
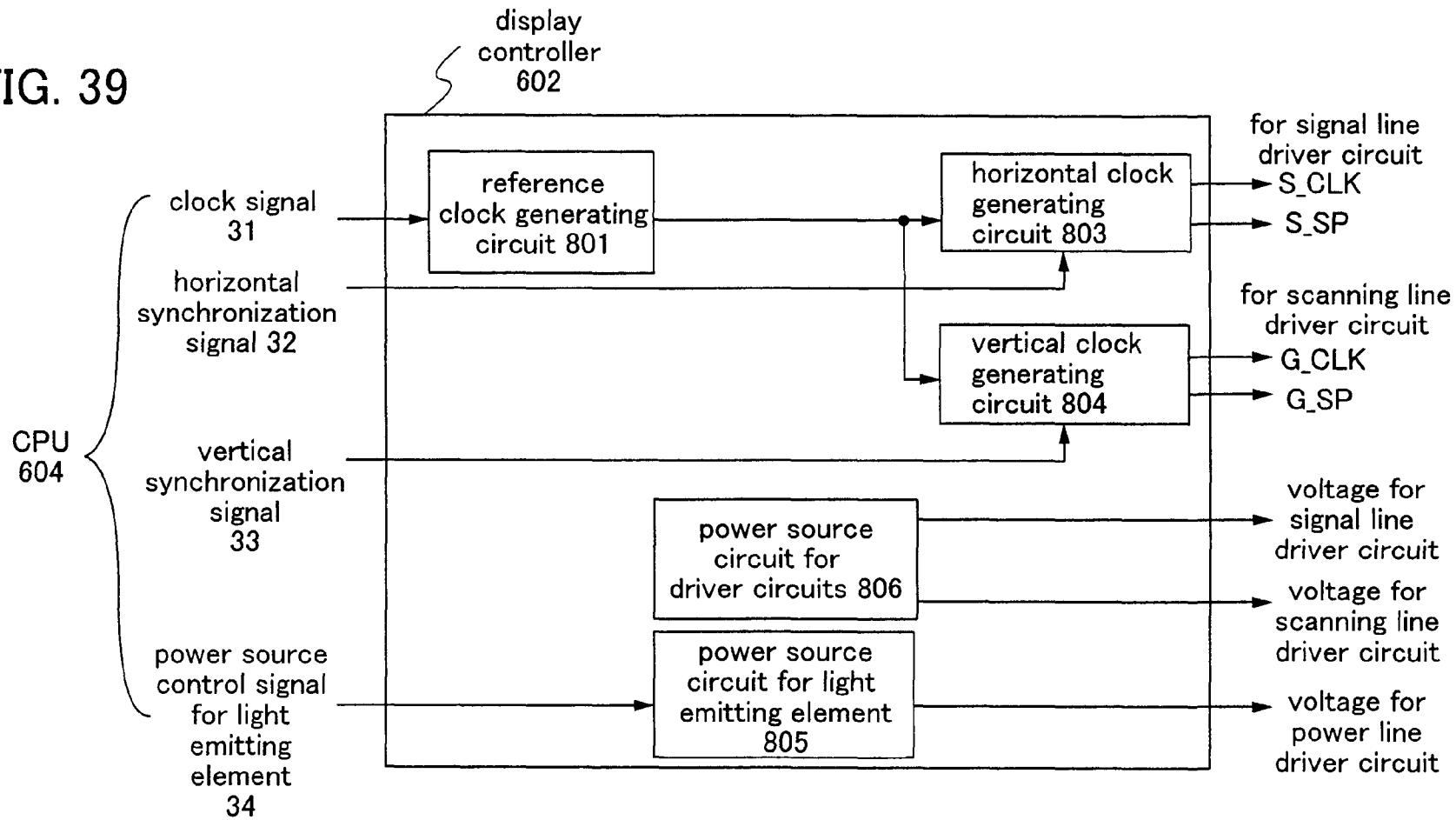
FIG. 39 is a diagram showing a structure of a display controller used in a display device of the present invention.

FIG. 39 is a view showing a configuration of the display controller of the present invention.

The display controller 602 includes a reference clock generating circuit 801, a horizontal clock generating circuit 803, a vertical clock generating circuit 804, a power source control circuit 805 for light emitting elements, and a power source control circuit 806 for driver circuits.

A clock signal 31 input from the CPU 604 is input to the reference clock generating circuit 801, which generates a reference clock. The reference clock is input to the horizontal clock generating circuit 803 and the vertical clock generating circuit 804.

The horizontal clock generating circuit 803 is input with a horizontal synchronization signal 32 for determining a horizontal cycle from the CPU 604, and outputs a clock pulse S_CLK and a start pulse S_SP for the signal line driver circuit. Similarly, the vertical clock generating circuit 804 is input with a vertical synchronization signal 33 for determining a vertical cycle from the CPU 604, and outputs a clock pulse G_CLK and a start pulse G_SP for the scanning line driver circuit.

The power source control circuit 805 for light emitting elements is controlled by a power source control signal 34 for light emitting elements. For example, in a case of using the timing charts in FIGS. 9A and 9B, a potential of the power line is controlled in such a manner that a voltage of 0 V is applied to the power line during the writing period Ta, a forward voltage is applied to the light emitting element during the display period Ts, and a reverse voltage is applied to the light emitting element during the reverse bias period BF.

In a case of using the timing charts in FIGS. 23A and 23B, the power source control circuit 805 for light emitting elements controls the potential of the power line in such a manner that a reverse voltage is applied to the light emitting element during the writing period Ta while a forward voltage is applied to the light emitting element during the display period Ts.

The power source control circuit 806 for driver circuits controls a power source voltage input to each driver circuit.

It is to be noted that the power source control circuit 806 for driver circuits may have a known configuration.

The above-described signal control circuit 601, memory controller 603, CPU 604, memory A 605, memory B 606 and display controller 602 may be formed over the same substrate as the pixels so as to be formed concurrently with the display 600; formed using an LS1 chip and attached to the substrate of the display 600 with COG or TAB bonding; or formed over a different substrate from the display 600 and connected with an electric wiring.

By using the present invention and circuits for inputting signals to the signal line driver circuit and the scanning line driver circuit of the display, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

This embodiment can be combined with the above-described embodiment modes.

Embodiment 2

In this embodiment, description of a configuration example of a signal line driver circuit using a digital time gray scale method which is used in the display device of the present invention will be made.

Figure 40:
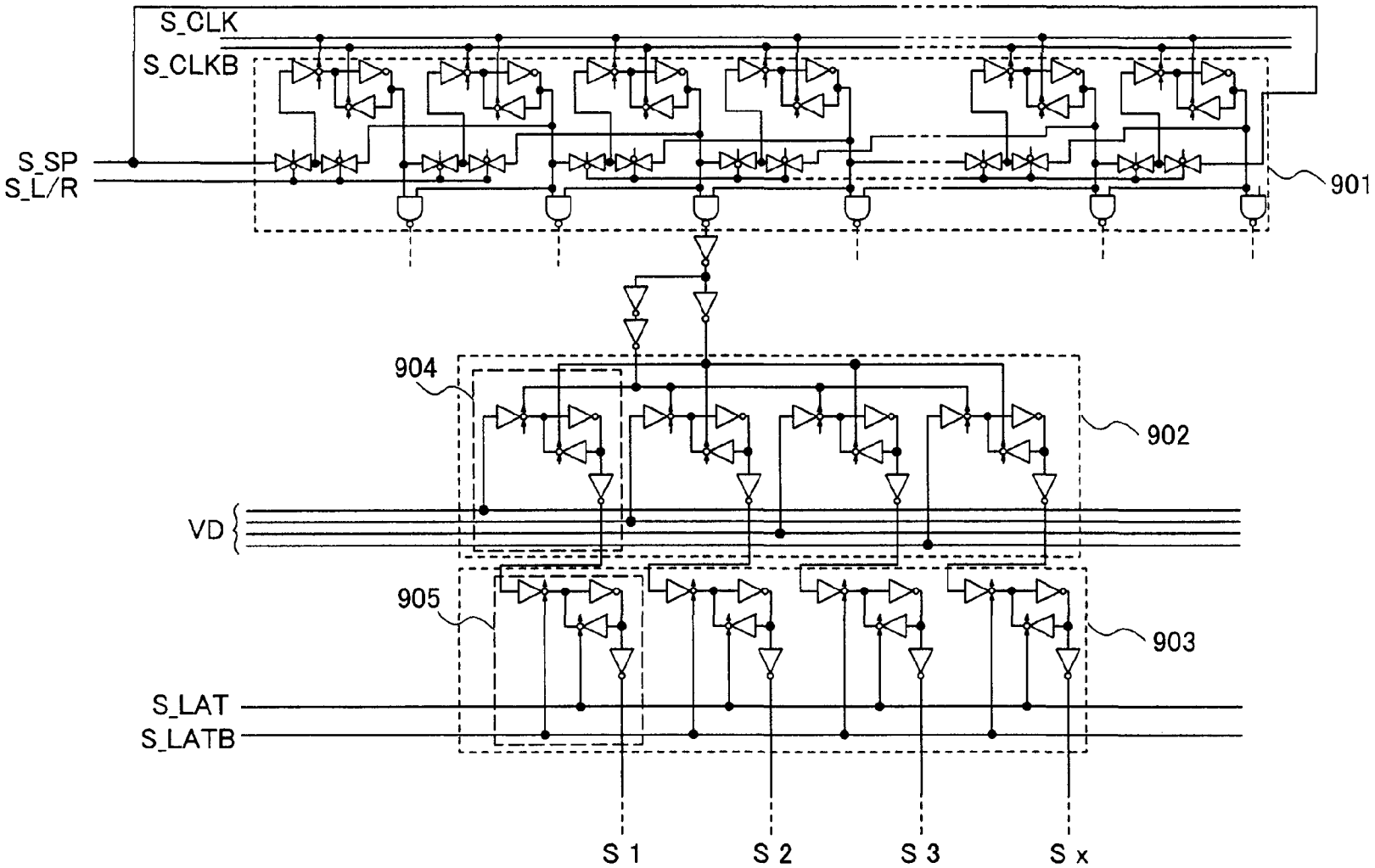
FIG. 40 is a diagram showing a configuration of a source signal line driver circuit used in a display device of the present invention.

FIG. 40 shows a configuration example of the signal line driver circuit.

The signal line driver circuit includes a shift register 901, a scan direction switching circuit, a LAT (A) 902, and a LAT (B) 903. It is to be noted that FIG. 40 partially shows the LAT (A) 902 and the LAT (B) 903 each corresponding to one output of the shift register 901; however, the LAT (A) 902 and the LAT (B) 903 of the same configuration correspond to the whole outputs of the shift register 901.

The shift register 901 includes a clocked inverter, an inverter, and a NAND. The shift register 901 is input with a start pulse S_SP for a signal line driver circuit, and on/off of the clocked inverter therein is controlled by a clock pulse S_CLK for the signal line driver circuit and an inverted clock pulse S_CLKB for the signal line driver circuit which is obtained by inverting the S_CLK, whereby sampling pulses are sequentially output from the NAND to the LAT (A) 902.

The scan direction switching circuit includes a switch, which switches the scan direction of the shift register 901 to the left or right in the drawing. In FIG. 40, in the case where a left/right switching signal L/R corresponds to a Low signal, the shift register 901 sequentially outputs sampling pulses from left to right in the drawing. On the other hand, in the case where the left/right switching signal L/R corresponds to a High signal, the shift register 901 sequentially outputs sampling pulses from right to left in the drawing.

Here, each stage of the LAT (A) 902 corresponds to a LAT (A) 904 for sampling a video signal to be input to one signal line.

The LAT (A) 904 includes a clocked inverter and an inverter

Here, a digital video signal VD output from the signal control circuit described in Embodiment 1 is divided into p (p is a natural number) signals. That is, signals corresponding to the outputs of p signal lines are input in parallel. When sampling pulses are simultaneously input to the clocked inverters of the p LATs (A) 902 through buffers, the p divided input signals are simultaneously sampled by the p LATs (A) 904 respectively.

Here, description is made of an example of a signal line driver circuit for outputting signal voltages to x signal lines; therefore, x/p sampling pulses are sequentially output from the shift register per horizontal period. In accordance with each sampling pulse, the p LATs (A) 904 simultaneously sample digital video signals correspondingly to the outputs of the p signal lines.

In this embodiment, the above-described method for dividing a digital video signal input to the signal line driver circuit into p-phase parallel signals, and sampling the p digital video signals simultaneously using one sampling pulse is called a p-division drive. FIG. 40 shows a 4-division drive.

According to such a division drive, an enough margin is secured for sampling of the shift register of the signal line driver circuit. In this manner, the reliability of the display device can be improved.

Upon input of signals for one horizontal period to all the LATs (A) 904, a latch pulse S_LAT and an inverted latch pulse S_LATB which is obtained by inverting the S-LAT are input thereto, and signals input to the LATs (A) 904 are output to the respective stages of the LAT (B) 903 all at once.

It is to be noted that each stage of the LAT (B) 903 corresponds to a LAT (B) 905 to which a signal from each stage of the LAT (A) 902 is input.

Each LAT (B) 905 includes a clocked inverted and an inverter. A signal output from each LAT (A) 904 is held in the LAT (B) 905, and at the same time, output to each of the signal lines S1 to Sx.

It is to be noted that a level shifter, a buffer and the like may be appropriately provided though not shown.

A start pulse S_SP, a clock pulse S_CLK and the like input to the shift register 901, the LAT (A) 902, and the LAT (B) 903 are input from the display controller shown in Embodiment 1 of the present invention.

In this embodiment, the operation of inputting a digital video signal to the LAT (A) of the signal line driver circuit is controlled by the signal control circuit, while the operation of inputting a clock pulse S_CLK and a start pulse S_SP to the shift register of the signal line driver circuit, and the operation of inputting a driving voltage for operating the signal line driver circuit are controlled by the display controller.

It is to be noted that the display device of the present invention is not limited to have the configuration of the signal line driver circuit in this embodiment, and a signal line driver circuit having a known configuration may be employed.

In addition, depending on the configuration of the signal line driver circuit, the number of the signal lines input to the signal line driver circuit from the display controller and the number of the power lines of the driving voltage vary.

By using the present invention and the above-described configuration, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

This embodiment can be combined with the above-described embodiment modes and embodiment.

Embodiment 3

Figure 41:
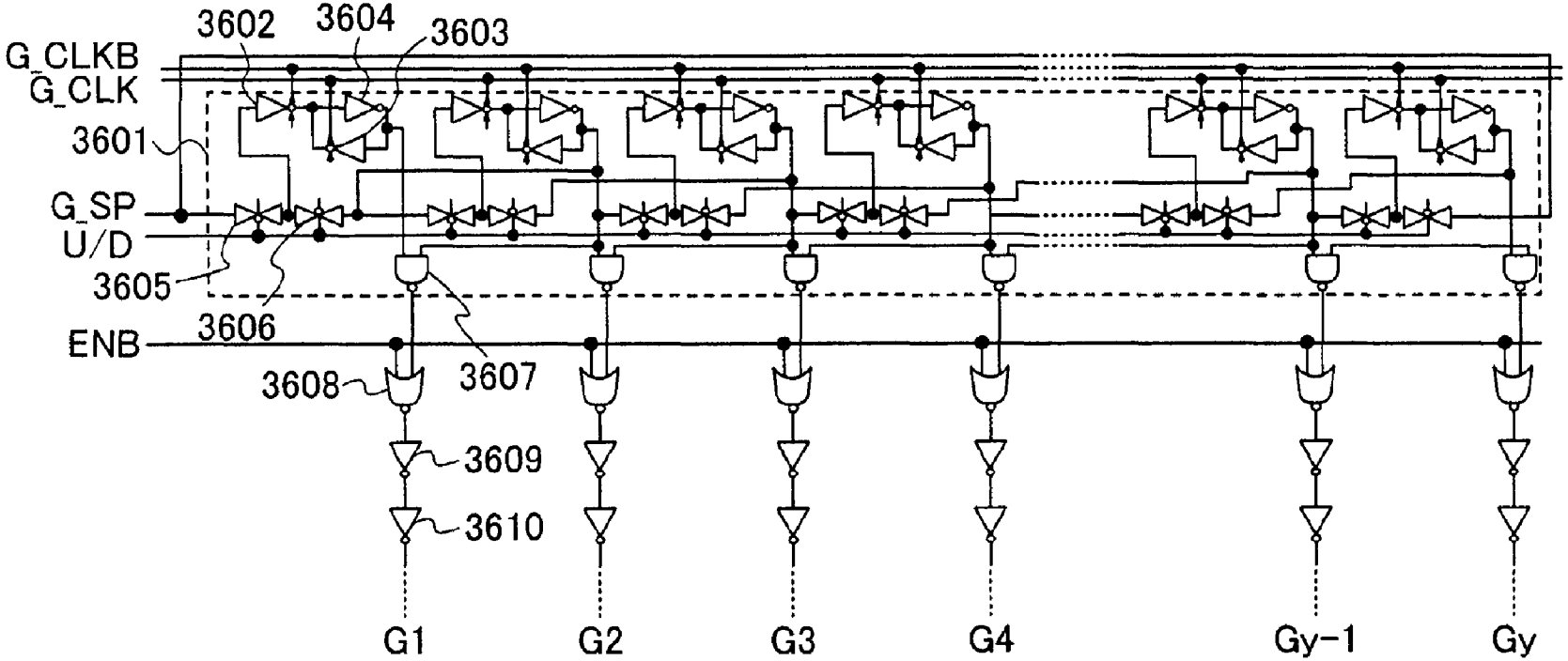
FIG. 41 is a diagram showing a configuration of a gate signal line driver circuit used in a display device of the present invention.

In this embodiment, description will be made with reference to FIG. 41 on a configuration example of a scanning line driver circuit used in the display device of the present invention.

The scanning line driver circuit includes a shift register, a scan direction switching circuit, and the like. It is to be noted that a level shifter, a buffer and the like may be appropriately provided though not shown.

The shift register is input with a start pulse G_SP, a clock pulse G_CLK, a driving voltage and the like, and outputs a scanning line selection signal.

A shift register 3601 includes clocked inverters 3602 and 3603, an inverter 3604 and a NAND circuit 3607. The shift register 3601 is input with a start pulse G_SP, and on/off of the clocked inverters 3602 and 3603 therein are controlled by a clock pulse G_CLK and an inverted clock pulse G_CLKB which is obtained by inverting the G_CLK, thereby sampling pulses are sequentially output from the NAND circuit 3607.

A scan direction switching circuit includes switches 3605 and 3606, which switches the scan direction of the shift register 3601 to the left or right in the drawing. In FIG. 41, in the case where a scan direction switching signal U/D corresponds to a Low signal, the shift register 3601 sequentially outputs sampling pulses from left to right in the drawing. On the other hand, in the case where the scan direction switching signal U/D corresponds to a High signal, the shift register sequentially outputs sampling pulses from right to left in the drawing.

The sampling pulse output from the shift register 3601 is input to a NOR circuit 3608, and operated with an enable signal ENB. This operation is carried out in order to prevent the adjacent scanning lines from being selected simultaneously due to a rounded sampling pulse. The signal output from the NOR 3608 is output to the scanning lines G1 to Gy though buffers 3609 and 3610.

It is to be noted that a level shifter, a buffer, and the like may be appropriately provided though not shown.

The start pulse G_SP, the clock pulse G_CLK, the driving voltage, and the like which are input to the shift register 3601 are input from the display controller shown in Embodiment Mode 1 of this specification.

The display device of the present invention is not limited to have the configuration of the scanning line driver circuit in this embodiment, and a scanning line driver circuit having a known configuration may be employed.

In addition, depending on the configuration of the scanning line driver circuit, the number of the signal lines input to the scanning line driver circuit from the display controller and the number of the power lines of the driving voltage vary.

By using the above-described configuration for the display device of the present invention, a current sufficient enough to insulate a short-circuited point can flow when a reverse voltage is applied, and the life of a light emitting element can be extended. In addition, a circuit configuration can be constituted by transistors having the same conductivity type, so that the manufacturing costs can be low.

This embodiment can be combined with the above-described embodiment modes and embodiments.

Embodiment 4

In this embodiment, a configuration of a display panel including the pixel configuration described in the above embodiment modes will be described with reference to drawings.

Figure 28A:
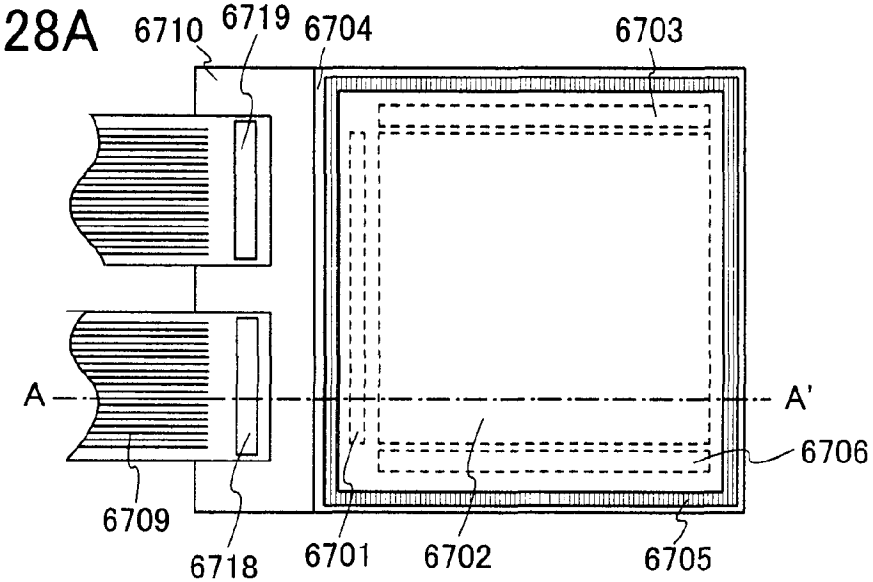
FIGS. 28A and 28B are views describing a display panel used in a display device of the present invention.
Figure 28B:
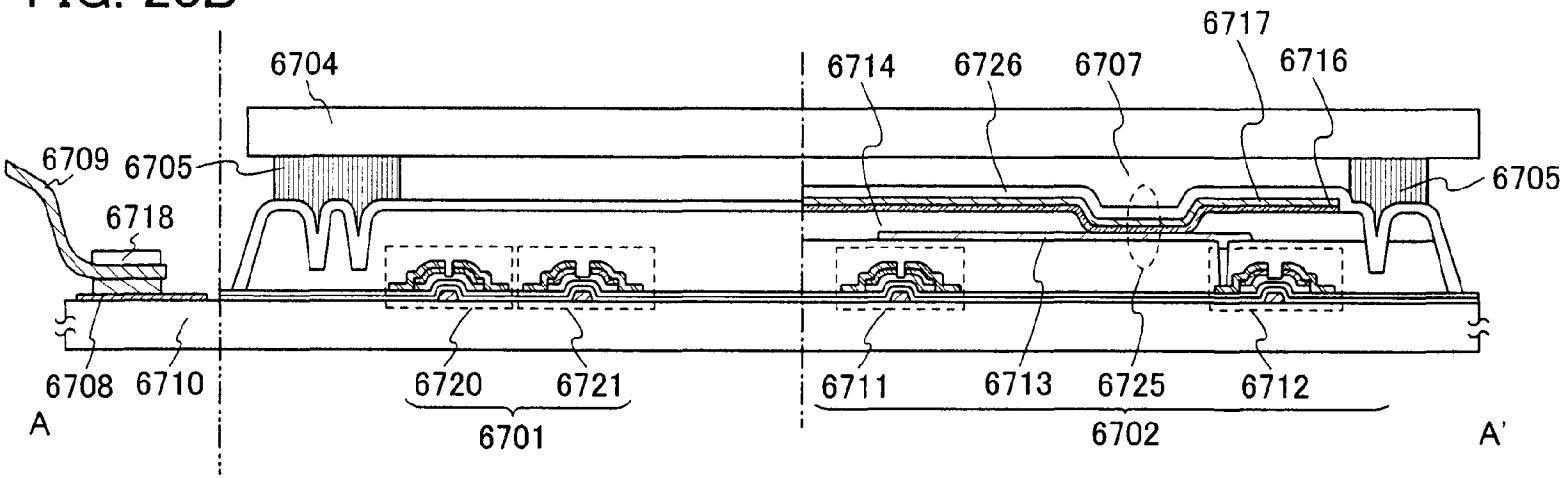

It is to be noted that FIG. 28A is a top plan view of the display panel and FIG. 28B is a cross-sectional view along a line A-A' of FIG. 28A. The display panel includes a signal line driver circuit 6701, a pixel portion 6702, a first scanning line driver circuit 6703, and a second scanning line driver circuit 6706, which are shown by dotted lines. Furthermore, a sealing substrate 6704 and a sealing material 6705 are provided. A portion surrounded by the sealing material 6705 is a space 6707.

It is to be noted that a wire 6708 is a wire for transmitting a signal input to the first scanning line driver circuit 6703, the second scanning line driver circuit 6706, and the signal line driver circuit 6701 and receives a video signal, a clock signal, a start signal, and the like from an FPC (Flexible Printed Circuit) 6709 functioning as an external input terminal. An IC chip (a semiconductor chip including a memory circuit, a buffer circuit, and the like) 6718 and an IC chip 6719 are mounted over a connecting portion of the FPC 6709 and the display panel by COG (Chip On Glass) or the like. It is to be noted that only the FPC is shown here; however, a printed wire board (PWB) may be attached to the FPC. The display device in this specification includes not only a main body of the display panel but also one with an FPC or a PWB attached thereto and one on which an IC chip or the like is mounted.

Next, description will be made with reference to FIG. 28B of a cross-sectional structure. The pixel portion 6702 and peripheral driver circuits (the first scanning line driver circuit 6703, the second scanning line driver circuit 6706, and the signal line driver circuit 6701) are formed over a substrate 6710. Here, the signal line driver circuit 6701 and the pixel portion 6702 are shown.

It is to be noted that the signal line driver circuit 6701 includes TFTs 6720 and 6721, and the TFTs 6720 and 6721 are transistors having the same conductivity type as N-channel transistors. It is to be noted that a pixel can be formed using transistors having the same conductivity type by applying any of the pixel configurations described in the above embodiment modes. Accordingly, when the peripheral driver circuits are formed using N-channel transistors, a display panel with a single conductivity type can be manufactured. In addition, the peripheral driver circuit may be formed by using an NMOS circuit using an N-channel transistor. Needless to say, in the peripheral circuit, a PMOS circuit or a CMOS circuit may be formed using a P-channel transistor, in addition to transistors having the same conductivity type using N-channel transistors. Furthermore, in this embodiment, a display panel in which the peripheral driver circuits are formed over the same substrate is shown; however, the present invention is not limited thereto. All or some of the peripheral driver circuits may be formed into an IC chip or the like and mounted by COG or the like. In this case, the driver circuit is not required to have a single conductivity type and can be designed freely, such as being formed in combination with a P-channel transistor.

Furthermore, the pixel portion 6702 includes TFTs 6711 and 6712. It is to be noted that a source electrode of the TFT 6712 is connected to a first electrode (pixel electrode) 6713. An insulator 6714 is formed so as to cover end portions of the first electrode 6713. Here, a positive photosensitive acrylic resin film is used for the insulator 6714.

In order to obtain excellent coverage, the insulator 6714 is formed to have a curved surface having a curvature at its top end portion or bottom end portion. For example, in a case of using a positive photosensitive acrylic as a material for the insulator 6714, it is preferable that only the top end portion of the insulator 6714 has a curved surface having a curvature radius (0.2 to 3 μm). Moreover, either a negative photosensitive acrylic which becomes insoluble in etchant by light or a positive photosensitive acrylic which becomes soluble in etchant by light can be used as the insulator 6714.

A layer 6716 containing an organic compound and a second electrode (counter electrode) 6717 are formed over the first electrode 6713. Here, it is preferable to use a material having a high work function as a material used for the first electrode 6713 which functions as an anode. For example, a single layer of an indium tin oxide (ITO) film, an indium zinc oxide (IZO) film, a titanium nitride film, a chromium film, a tungsten film, a Zn film, a Pt film, or the like, a stacked layer of a titanium nitride film and a film containing aluminum as a main component, a three-layer structure of a titanium nitride film, a film containing aluminum as a main component, and a titanium nitride film, or the like can be used. It is to be noted that with a stacked layer structure, resistance as a wire is low, good ohmic contact can be obtained, and a function as an anode can be obtained.

The layer 6716 containing an organic compound is formed by an evaporation method using an evaporation mask, or ink-jet method. A complex of a metal belonging to group 4 of the periodic table of the elements is used for a part of the layer 6716 containing an organic compound. Besides, a low molecular material or a high molecular material may be used in combination as well. Furthermore, as a material used for the layer containing an organic compound, a single layer or a stacked layer of an organic compound is often used; however, in this embodiment, an inorganic compound may be used in a part of a film formed of an organic compound. Moreover, a known triplet material can also be used.

Furthermore, as a material used for the second electrode 6717 which is formed over the layer 6716 containing an organic compound, a material having a low work function (Al, Ag, Li, Ca, or an alloy thereof such as MgAg, MgIn, AlLi, $CaF_2$, or calcium nitride) may be used. In the case where light generated from the layer 6716 containing an organic compound passes through the second electrode 6717, a stacked layer of a thin metal film with a thinner thickness and a transparent conductive film (indium tin oxide (ITO) film), an indium oxide zinc oxide alloy ($In_2O_3$—ZnO), zinc oxide (ZnO), or the like) is preferably used as the second electrode 6717.

Furthermore, a protective stacked layer 6726 may be formed in order to seal the light emitting element 6725. The protective stacked layer 6726 is formed by stacking a first inorganic insulating film, a stress relaxation film, and a second inorganic insulating film.

Furthermore, by attaching the sealing substrate 6704 to the protective stacked layer 6726 and the substrate 6710 with the sealing material 6705, a light emitting element 6725 is provided in the space 6707 surrounded by the protective stacked layer 6726, the substrate 6710, the sealing substrate 6704, and the sealing material 6705. It is to be noted that the space 6707 may be filled with the sealing material 6705, as well as with an inert gas (nitrogen, argon, or the like).

It is to be noted that an epoxy-based resin is preferably used for the sealing material 6705. Furthermore, it is preferable that these materials should not transmit moisture or oxygen as much as possible. As a material for the sealing substrate 6704, a glass substrate, a quartz substrate, a plastic substrate formed of FRP (Fiberglass-Reinforced Plastics), PVF (polyvinylfluoride), myler, polyester, acrylic, or the like can be used.

As described above, a display panel having a pixel configuration of the present invention can be obtained. It is to be noted that the structure described above is just one example, and a structure of a display panel of the present invention is not limited to this.

As shown in FIGS. 28A and 28B, the cost of the display device can be reduced by forming the signal line driver circuit 6701, the pixel portion 6702, the first scanning line driver circuit 6703, and the second scanning line driver circuit 6706 over the same substrate. Furthermore, in this case, transistors having the same conductivity type are used for the signal line driver circuit 6701, the pixel portion 6702, the first scanning line driver circuit 6703, and the second scanning line driver circuit 6706, whereby a manufacturing process can be simplified. As a result, further cost reduction can be achieved.

Figure 29B:
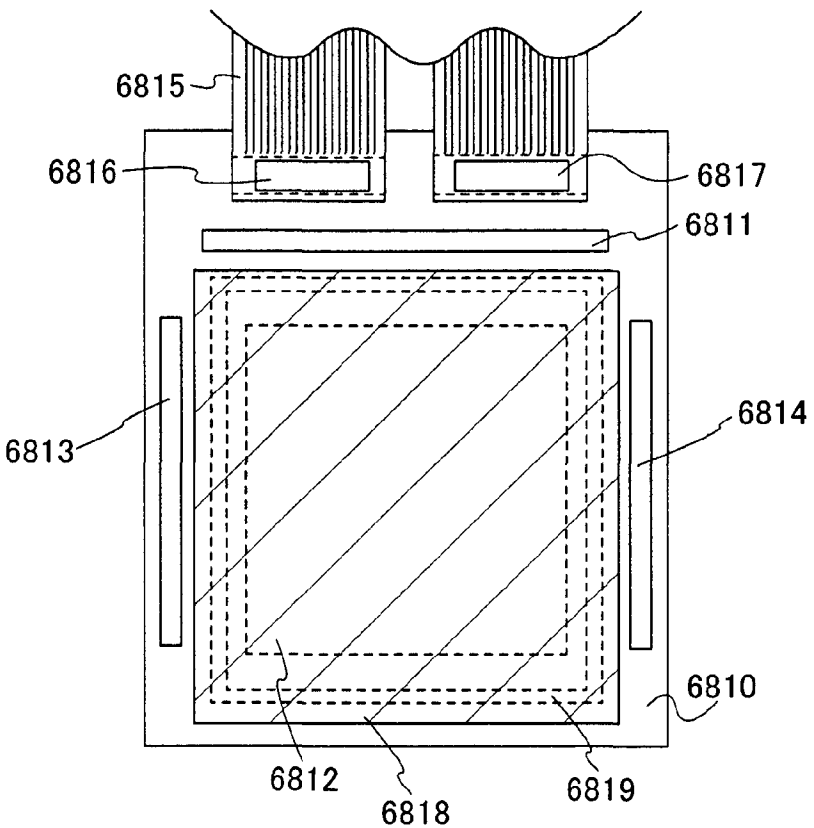
FIGS. 29A and 29B are views describing a display panel used in a display device of the present invention.
Figure 29A:
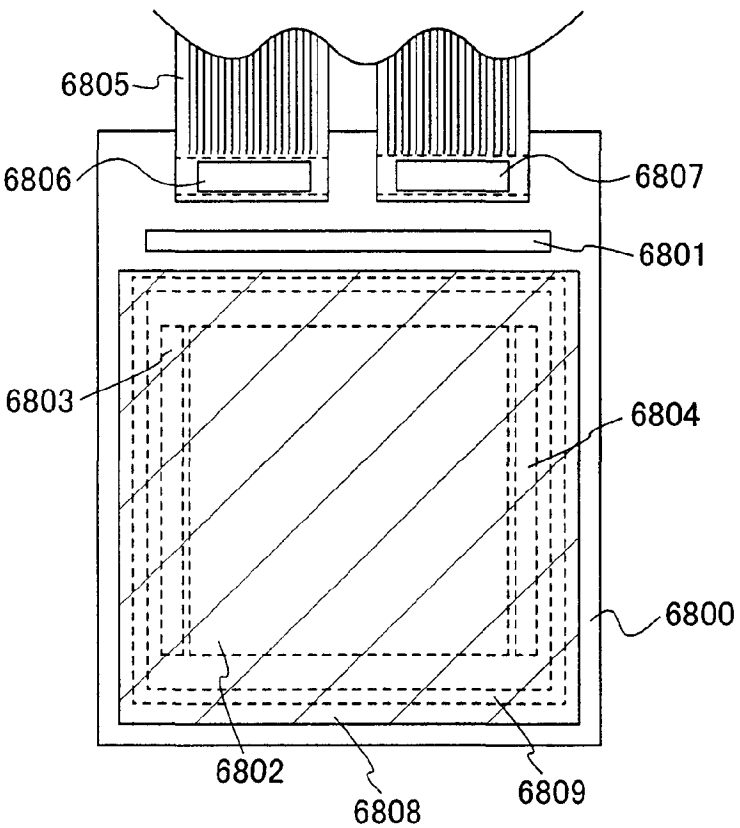

It is to be noted that the structure of the display panel is not limited to the structure shown in FIG. 28A where the signal line driver circuit 6701, the pixel portion 6702, the first scanning line driver circuit 6703, and the second scanning line driver circuit 6706 are formed over the same substrate, and a signal line driver circuit 6801 shown in FIG. 29A corresponding to the signal line driver circuit 6701 may be formed into an IC chip and mounted on the display panel by COG, or the like. It is to be noted that a substrate 6800, a pixel portion 6802, a first scanning line driver circuit 6803, a second scanning line driver circuit 6804, an FPC 6805, IC chips 6806 and 6807, a sealing substrate 6808, and a sealing material 6809 in FIG. 29A correspond to the substrate 6710, the pixel portion 6702, the first scanning line driver circuit 6703, the second scanning line driver circuit 6706, the FPC 6709, the IC chips 6718 and 6719, the sealing substrate 6704, and the sealing material 6705 in FIG. 28A, respectively.

That is, only the signal line driver circuit which is required to operate at high speed is formed into an IC chip using a CMOS or the like, whereby lower power consumption is achieved. Furthermore, by forming the IC chip as a semiconductor chip formed of a silicon wafer or the like, a higher-speed operation and lower power consumption can be realized.

By forming the first scanning line driver circuit 6803 and/or the second scanning line driver circuit 6804 over the same substrate as the pixel portion 6802, cost reduction can be achieved. Furthermore, transistors having the same conductivity type are used for the first scanning line driver circuit 6803, the second scanning line driver circuit 6804, and the pixel portion 6802, whereby furthermore, cost reduction can be achieved. As for a pixel configuration of the pixel portion 6802, the pixels described in the above embodiment modes can be applied.

In this manner, cost reduction of a high definition display device can be realized. Furthermore, by mounting an IC chip including a functional circuit (memory or buffer) at a connecting portion of the FPC 6805 and the substrate 6800, a substrate area can be effectively utilized.

Moreover, a signal line driver circuit 6811, a first scanning line driver circuit 6814, and a second scanning line driver circuit 6813 shown in FIG. 29B corresponding to the signal line driver circuit 6701, the first scanning line driver circuit 6703, and the second scanning line driver circuit 6706 shown in FIG. 28A may be formed into an IC chip and mounted on a display panel by COG or the like. In this case, lower power consumption of a high definition display device can be realized. It is to be noted that a substrate 6810, a pixel portion 6812, an FPC 6815, IC chips 6816 and 6817, a sealing substrate 6818, and a sealing material 6819 in FIG. 29B correspond to the substrate 6710, the pixel portion 6702, the FPC 6709, the IC chips 6718 and 6719, the sealing substrate 6704, and the sealing material 6705 in FIG. 28A, respectively.

Furthermore, by using amorphous silicon for a semiconductor layer of a transistor of the pixel portion 6812, further cost reduction can be achieved. Moreover, a large-sized display panel can be manufactured.

Furthermore, the second scanning line driver circuit, the first scanning line driver circuit, and the signal line driver circuit are not necessarily provided in a row direction and a column direction of the pixels. For example, as shown in FIG. 30A, a peripheral driver circuit 6901 formed in an IC chip may have functions of the first scanning line driver circuit 6814, the second scanning line driver circuit 6813, and the signal line driver circuit 6811 shown in FIG. 29B. It is to be noted that a substrate 6900, a pixel portion 6902, an FPC 6904, IC chips 6905 and 6906, a sealing substrate 6907, and a sealing material 6908 in FIG. 30A correspond to the substrate 6710, the pixel portion 6702, the FPC 6709, the IC chips 6718 and 6719, the sealing substrate 6704, and the sealing material 6705 in FIG. 28A, respectively.

Figure 30B:
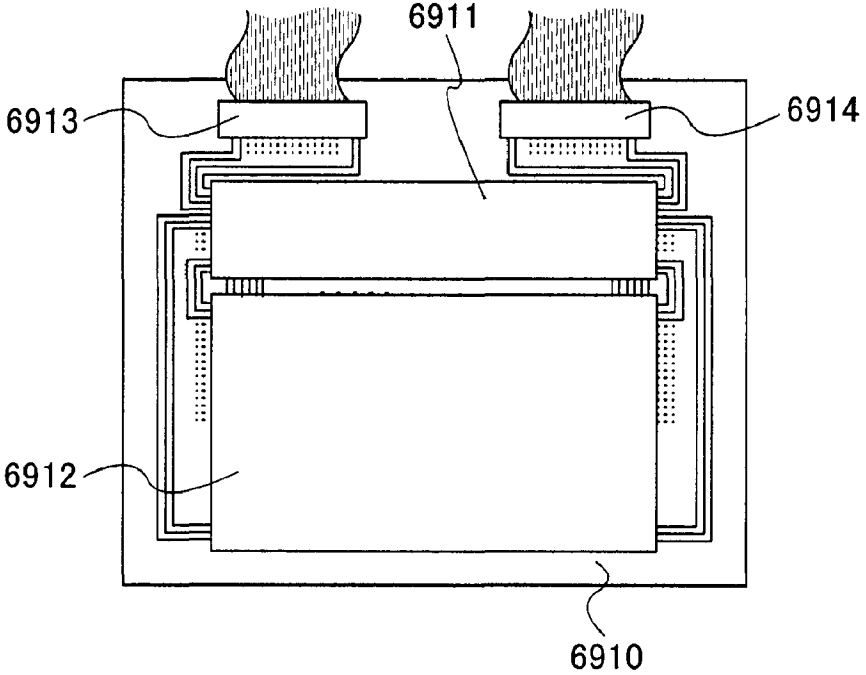
FIGS. 30A and 30B are views describing a display panel used in a display device of the present invention.
Figure 30A:
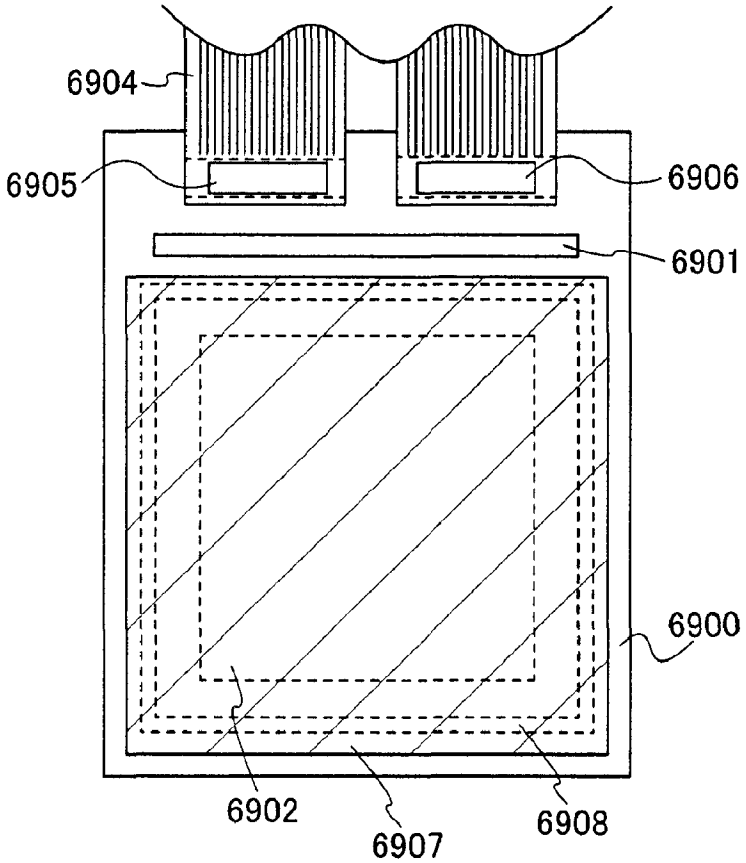

FIG. 30B shows a schematic view showing connections of wires of the display device shown in FIG. 30A. A substrate 6910, a peripheral driver circuit 6911, a pixel portion 6912, and FPCs 6913 and 6914 are provided. A signal and a power source potential are externally input from the FPC 6913 to the peripheral driver circuit 6911. An output from the peripheral driver circuit 6911 is input to wires in the row direction and wires in the column direction, which are connected to the pixels in the pixel portion 6912.

Figure 31A:
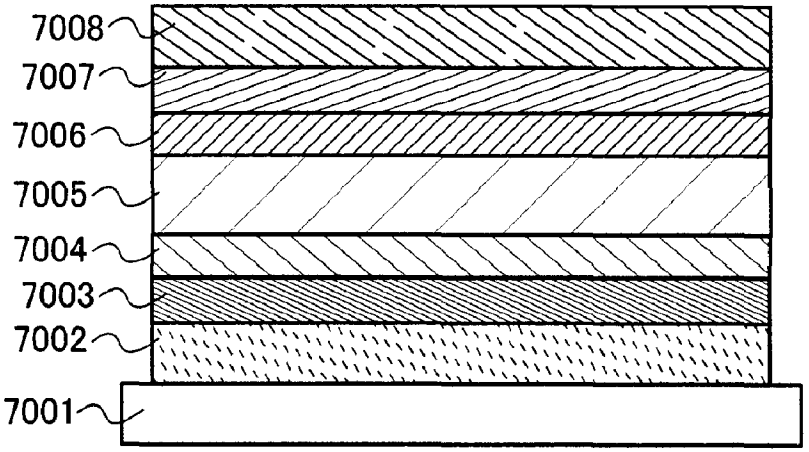
FIGS. 31A and 31B are views describing a display panel used in a display device of the present invention.
Figure 31B:
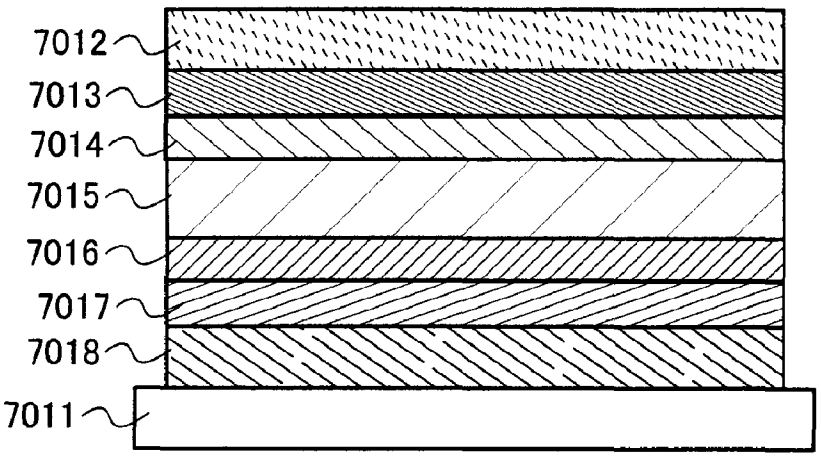

Furthermore, FIGS. 31A and 31B show examples of a light emitting element which can be applied to the light emitting element 6725. That is, description will be made with reference to FIGS. 31A and 31B of structures of a light emitting element which can be applied to the pixels described in the above embodiment modes.

In a light emitting element shown in FIG. 31A, an anode 7002, a hole injecting layer 7003 formed of a hole injecting material, a hole transporting layer 7004 formed of a hole transporting material, a light emitting layer 7005, an electron transporting layer 7006 formed of an electron transporting material, an electron injecting layer 7007 formed of an electron injecting material, and a cathode 7008 are stacked over a substrate 7001 in this order. Here, the light emitting layer 7005 may be formed of only one kind of light emitting material; however, it may also be formed of two or more kinds of materials. The structure of the element of the present invention is not limited to this.

In addition to the stacked layer structure shown in FIG. 31A where each functional layer is stacked, there are wide variations such as an element formed of a high molecular compound, a high efficiency element utilizing a triplet light emitting material which emits light from a triplet excitation state in a light emitting layer. It is also possible to apply to a white light emitting element which can be obtained by dividing a light emitting region into two regions by controlling a recombination region of carriers using a hole blocking layer, and the like.

The element of the present invention shown in FIG. 31A can be formed by sequentially depositing a hole injecting material, a hole transporting material, and a light emitting material over the substrate 7001 having the anode 7002 (ITO, indium tin oxide). Next, an electron transporting material and an electron injecting material are deposited, and finally the cathode 7008 is formed by an evaporation method.

Materials suitable for the hole injecting material, the hole transporting material, the electron transporting material, the electron injecting material, and the light emitting material are as follows.

As the hole injecting material, an organic compound such as a porphyrin-based compound, a phthalocyanine (hereinafter referred to as "$H_2Pc$"), copper phthalocyanine (hereinafter referred to as "CuPc"), or the like is available. Furthermore, a material that has a smaller value of an ionization potential than that of the hole transporting material to be used and has a hole transporting function can also be used as the hole injecting material. There is also a material obtained by chemically doping a conductive high molecular compound, which includes polyaniline, polyethylene dioxythiophene (hereinafter referred to as "PEDOT") doped with polystyrene sulfonate (hereinafter referred to as "PSS") and the like. Also, a high molecular compound of an insulator is effective in terms of planarization of an anode, and polyimide (hereinafter referred to as "PI") is often used. Furthermore, an inorganic compound is also used, which includes an ultra-thin film of aluminum oxide (hereinafter referred to as "alumina") in addition to a thin film of a metal such as gold or platinum.

An aromatic amine-based (that is, one having a bond of benzene ring-nitrogen) compound is most widely used as the hole transporting material. A material that is widely used includes 4,4'-bis(diphenylamino)-biphenyl (hereinafter referred to as "TAD"), derivatives thereof such as 4,4'-bis[N-(3-methylphenyl)-N-phenyl-amino]-biphenyl (hereinafter referred to as "TPD"), 4,4'-bis[N-(1-naphthyl)-N-phenyl-amino]-biphenyl (hereinafter referred to as "α-NPD"), and star burst aromatic amine compounds such as 4,4',4"-tris(N, N-diphenyl-amino)-triphenylamine (hereinafter referred to as "TDATA") and 4,4',4"-tris[N-(3-methylphenyl)-N-phenyl-amino]-triphenylamine (hereinafter referred to as "MTDATA").

As the electron transporting material, a metal complex is often used, which includes a metal complex having a quinoline skeleton or a benzoquinoline skeleton such as $Alq_3$, BAlq, tris(4-methyl-8-quinotinolato)aluminum (hereinafter referred to as "Almq"), or bis(10-hydroxybenzo[h]-quinolinato)beryllium (hereinafter referred to as "Bebq"), and in addition, a metal complex having an oxazole-based or a thiazole-based ligand such as bis[2-(2-hydroxyphenyl)-benzoxazolato]zinc (hereinafter referred to as "$Zn(BOX)_2$") or bis[2-(2-hydroxyphenyl)-benzothiazolato]zinc (hereinafter referred to as "$Zn(BTZ)_2$"). Furthermore, in addition to the metal complexes, oxadiazole derivatives such as 2-(4-biphenylyl)-5-(4-tert-butylphenyl)-1,3,4-oxadiazole (hereinafter referred to as "PBD") and OXD-7, triazole derivatives such as TAZ and 3-(4-tert-butylphenyl)-4-(4-ethylphenyl)-5-(4-biphenylyl)-2,3,4-triazole (hereinafter referred to as "p-Et-TAZ"), and phenanthroline derivatives such as bathophenanthroline (hereinafter referred to as "BPhen") and BCP have an electron transporting property.

As the electron injecting material, the above-mentioned electron transporting materials can be used. In addition, an ultra-thin film of an insulator, for example, metal halide such as calcium fluoride, lithium fluoride, or cesium fluoride, alkali metal oxide such as lithium oxide, or the like is often used. Furthermore, an alkali metal complex such as lithium acetyl acetonate (hereinafter referred to as "Li(acac)") or 8-quinolinolato-lithium (hereinafter referred to as "Liq") is also available.

As the light emitting material, in addition to the above-mentioned metal complexes such as $Alq_3$, Almq, BeBq, BAlq, $Zn(BOX)_2$, and $Zn(BTZ)_2$, various fluorescent pigments are available. The fluorescent pigments include 4,4'-bis(2,2-diphenyl-vinyl)-biphenyl, which is blue, and 4-(dicyanomethylene)-2-methyl-6-(p-dimethylaminostyryl)-4H-pyran, which is red-orange, and the like. Also, a triplet light emitting material is available, which mainly includes a complex with platinum or iridium as a central metal. As the triplet light emitting material, tris(2-phenylpyridine)iridium, bis(2-(4'-tryl)pyridinato-N,$C^{2'}$)acetylacetonato iridium (hereinafter referred to as "$acacIr(tpy)_2$"), 2,3,7,8,23,13,17,18-octaethyl-21H,23H-porphyrin-platinum, and the like are known.

By using the materials each having a function as described above in combination, a highly reliable light emitting element can be formed.

In the case where it is possible in the circuit configurations of the above-described embodiment modes, a light emitting element in which layers are formed in a reverse order to that of FIG. 31A may be used as shown in FIG. 31B. That is, a cathode 7018, an electron injecting layer 7017 formed of an electron injecting material, an electron transporting layer 7016 formed of an electron transporting material, a light emitting layer 7015, a hole transporting layer 7014 formed of a hole transporting material, a hole injecting layer 7013 formed of a hole injecting material, and an anode 7012 are stacked over a substrate 7011 in this order.

In addition, in order to extract light emission of a light emitting element, at least one of an anode and a cathode is required to be transparent. A TFT and a light emitting element are formed over a substrate; and there are light emitting elements having a top emission structure where light emission is taken out through a surface on the side opposite to the substrate, having a bottom emission structure where light emission is taken out through a surface on the substrate side, and having a dual emission structure where light emission is taken out through the surface on the side opposite to the substrate and the surface on the substrate side respectively. The pixel configuration of the present invention can be applied to the light emitting element having any emission structure.

Description of a light emitting element with a top emission structure will be made with reference to FIG. 32A.

A driving TFT 7101 is formed over a substrate 7100 and a first electrode 7102 is formed in contact with a source electrode of the driving TFT 7101, over which a layer 7103 containing an organic compound and a second electrode 7104 are formed.

Furthermore, the first electrode 7102 is an anode of a light emitting element. The second electrode 7104 is a cathode of the light emitting element. That is, a region where the layer 7103 containing an organic compound is interposed between the first electrode 7102 and the second electrode 7104 corresponds to the light emitting element.

Furthermore, as a material used for the first electrode 7102 which functions as an anode, a material having a high work function is preferably used. For example, a single layer of a titanium nitride film, a chromium film, a tungsten film, a Zn film, a Pt film, or the like, a stacked layer of a titanium nitride film and a film containing aluminum as a main component, a three-layer structure of a titanium nitride film, a film containing aluminum as a main component, and a titanium nitride film, or the like can be used. With a stacked layer structure, the resistance as a wire is low, a good ohmic contact can be obtained, and furthermore, a function as an anode can be obtained. By using a metal film which reflects light, an anode which does not transmit light can be formed.

As a material used for the second electrode 7104 which functions as a cathode, a stacked layer of a thin metal film formed of a material having a low work function (Al, Ag, Li, Ca, or an alloy thereof such as MgAg, MgIn, AlLi, $CaF_2$, or calcium nitride) and a transparent conductive film (indium tin oxide (ITO), indium zinc oxide (IZO), zinc oxide (ZnO), or the like) is preferably used. By using a thin metal film and a transparent conductive film with transparency in this manner, a cathode which can transmit light can be formed.

Figure 32A:
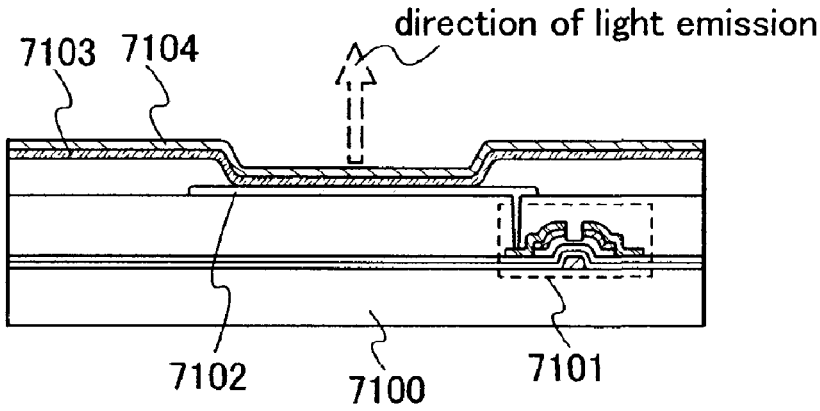
FIGS. 32A to 32C are views describing a display panel used in a display device of the present invention.

In this manner, light from the light emitting element can be extracted to the top surface as shown by an arrow in FIG. 32A. That is, in a case of applying to the display panel shown in FIGS. 28A and 28B, light is emitted to the sealing substrate 6704 side. Therefore, in a case of using a light emitting element with a top emission structure to a display device, a light-transmitting substrate is used as the sealing substrate 6704.

In a case of providing an optical film, an optical film may be provided over the sealing substrate 6704.

Furthermore, description of a light emitting element with a bottom emission structure will be made with reference to FIG. 32B. The same reference numerals as those in FIG. 32A are used since the structures are the same, except for the light emission structure.

Here, as a material used for the first electrode 7102 which functions as an anode, a material having a high work function is preferably used. For example, a transparent conductive film such as an indium tin oxide (ITO) film or an indium zinc oxide (IZO) film can be used. By using a transparent conductive film with transparency, an anode which can transmit light can be formed.

As a material used for the second electrode 7104 which functions as a cathode, a metal film formed of a material having a low work function (Al, Ag, Li, Ca, or an alloy thereof such as MgAg, MgIn, AlLi, $CaF_2$, or $Ca_3N_2$) can be used. By using a metal film which reflects light, a cathode which does not transmit light can be formed.

Figure 32B:
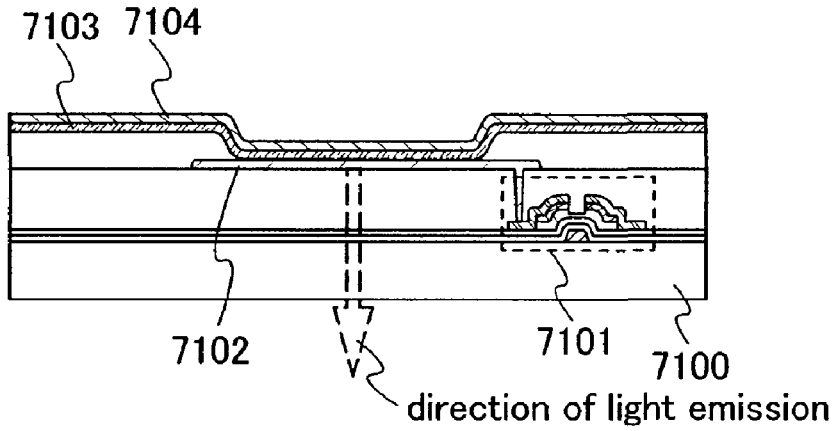

In the above-described manner, light from the light emitting element can be extracted to a bottom surface as shown by an arrow in FIG. 32B. That is, in a case of applying to the display panel shown in FIGS. 28A and 28B, light is emitted to the substrate 6710 side. Therefore, in a case of using a light emitting element with a bottom emission structure to a display device, a light-transmitting substrate is used as the substrate 6710.

In a case of providing an optical film, an optical film may be provided over the substrate 6710.

Description of a light emitting element with a dual emission structure will be made with reference to FIG. 32C. The same reference numerals as those in FIG. 32A are used since the structures are the same, except for the light emission structure.

Here, as a material used for the first electrode 7102 which functions as an anode, a material having a high work function is preferably used. For example, a transparent conductive film such as an indium tin oxide (ITO) film or an indium zinc oxide (IZO) film can be used. By using a transparent conductive film with transparency, an anode which can transmit light can be formed.

As a material used for the second electrode 7104 which functions as a cathode, a stacked layer of a thin metal film formed of a material having a low work function (Al, Ag, Li, Ca, or an alloy thereof such as MgAg, MgIn, AlLi, $CaF_2$, or calcium nitride), and a transparent conductive film (indium tin oxide (ITO), indium oxide zinc oxide alloy ($In_2O_3$—ZnO), zinc oxide (ZnO), or the like) is preferably used. By using a thin metal film and a transparent conductive film with transparency in this manner, a cathode which can transmit light can be formed.

Figure 32C:
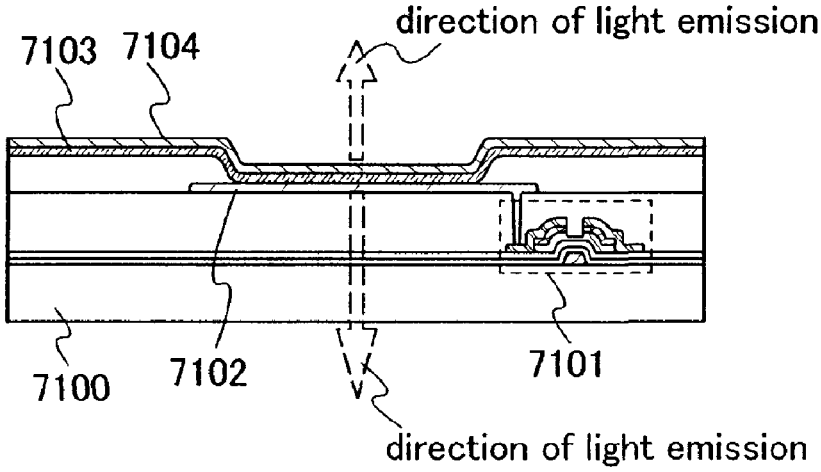

In this manner, light from the light emitting element can be extracted to the both surfaces as shown by arrows of FIG. 32C. That is, in a case of applying to the display panel shown in FIGS. 28A and 28B, light is emitted to the substrate 6710 side and the sealing substrate 6704 side. Therefore, in a case of applying a light emitting element with a dual emission structure to a display device, light-transmitting substrates are used as the substrate 6710 and the sealing substrate 6704 both.

In a case of providing an optical film, optical films may be provided over both the substrate 6710 and the sealing substrate 6704.

The present invention can also be applied to a display device which realizes full color display by using a white light emitting element and a color filter.

Figure 33:
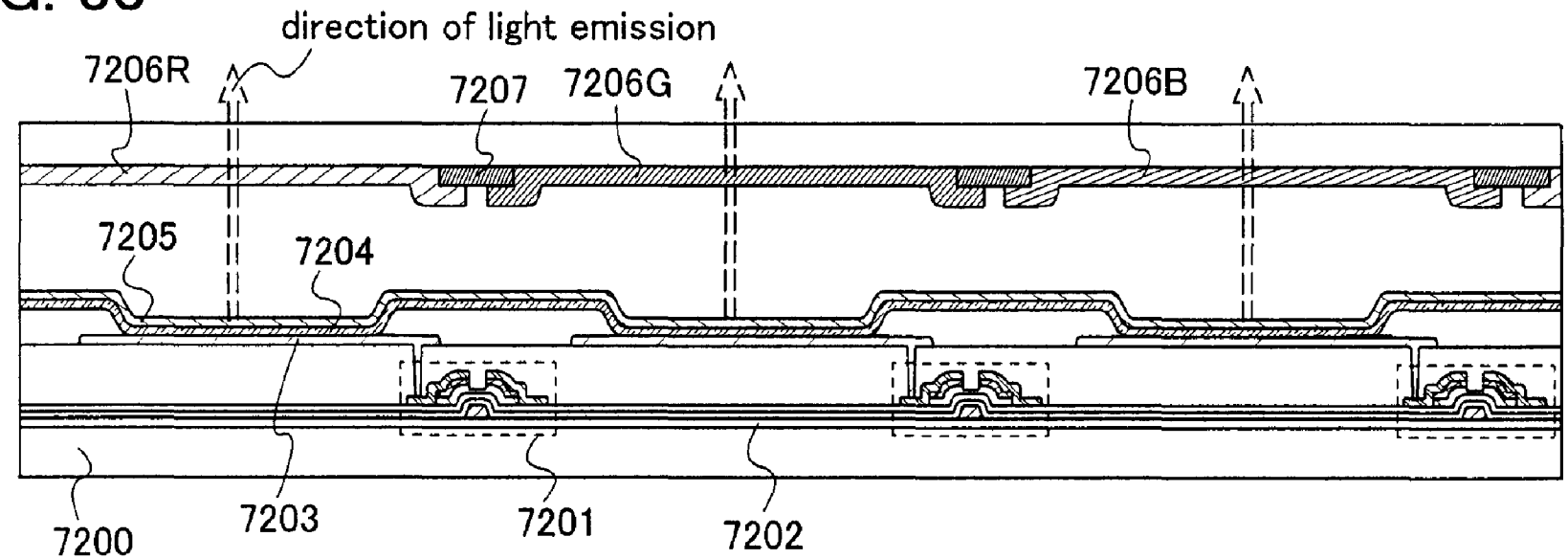
FIG. 33 is a view describing a display panel used in a display device of the present invention.

As shown in FIG. 33, a base film 7202 is formed over a substrate 7200 and a driving TFT 7201 is formed thereover. A first electrode 7203 is formed in contact with a source electrode of the driving TFT 7201 and a layer 7204 containing an organic compound and a second electrode 7205 are formed thereover.

The first electrode 7203 is an anode of a light emitting element. The second electrode 7205 is a cathode of the light emitting element. That is, a region where the layer 7204 containing an organic compound is interposed between the first electrode 7203 and the second electrode 7205 corresponds to the light emitting element. In the structure shown in FIG. 33, white light is emitted. A red color filter 7206R, a green color filter 7206G, and a blue color filter 7206B are provided over the light emitting element, whereby full color display can be performed. Furthermore, a black matrix (also referred to as BM) 7207 for separating these color filters is provided.

The above-described structures of the light emitting element can be used in combination and can be used appropriately for the display device having the pixel configuration of the present invention. The structures of the display panel and the light emitting elements which are described in this specification are just examples and it is needless to say that the pixel configuration of the present invention can be applied to display devices having other structures.

Next, a partial cross-sectional view of a pixel portion of a display panel will be described.

First, description of a case of using an amorphous silicon (a-Si:H) film for a semiconductor layer of a transistor will be made. A top gate transistor is shown in FIGS. 34A and 34B, and a bottom gate transistor is shown in FIGS. 35A, 35B, 36A, and 36B.

Figure 34A:
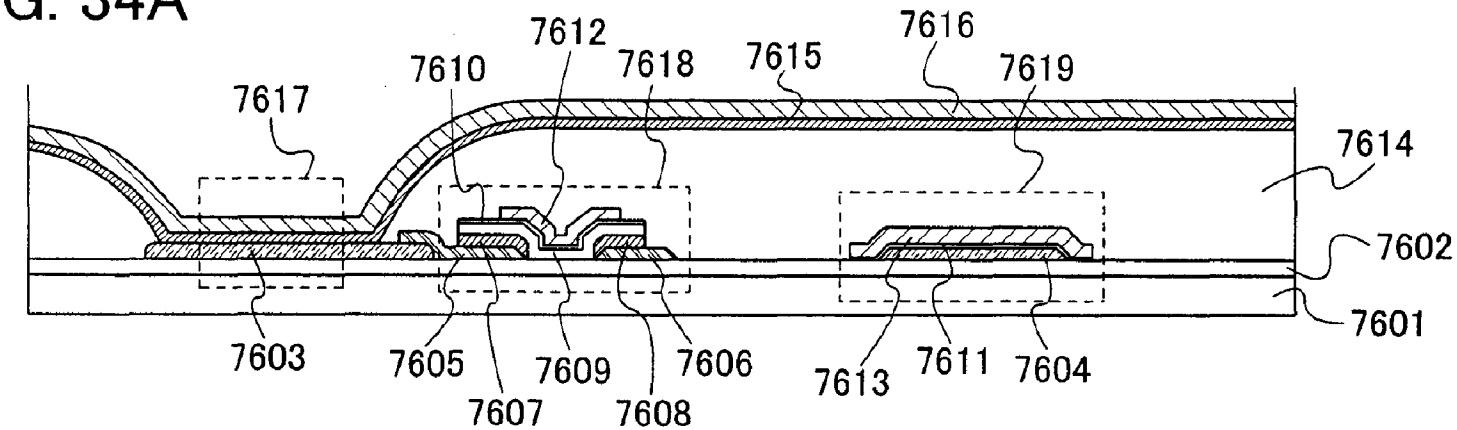
FIGS. 34A and 34B are views describing a display panel used in a display device of the present invention.
Figure 34B:
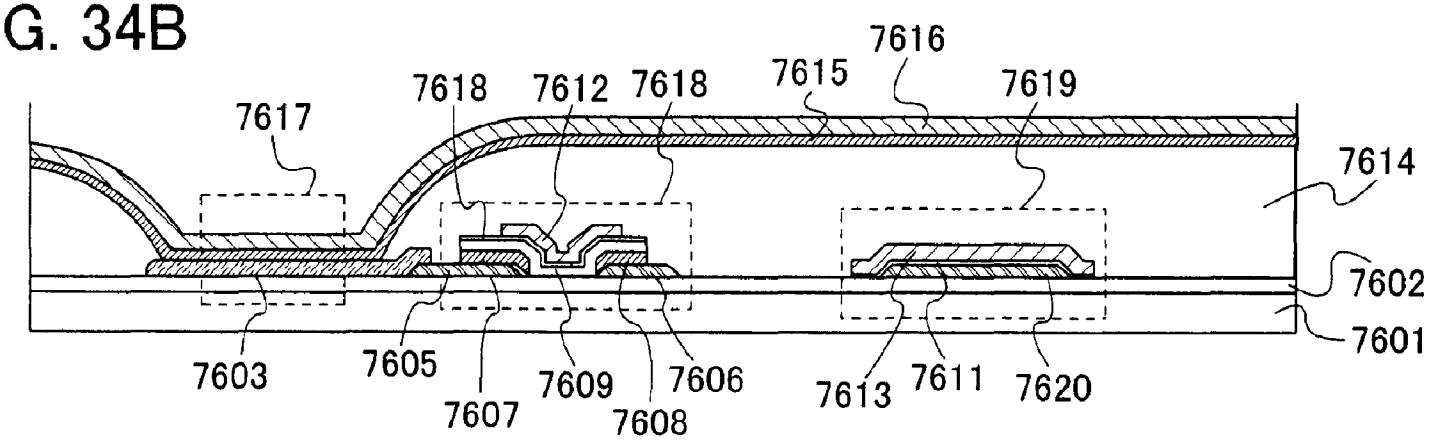

A cross-section of a staggered transistor using amorphous silicon for a semiconductor layer is shown in FIG. 34A. As shown in FIG. 34A, a base film 7602 is formed over a substrate 7601. A pixel electrode 7603 is formed over the base film 7602. In addition, a first electrode 7604 is formed with the same material as the pixel electrode 7603.

As the substrate, a glass substrate, a quartz substrate, a ceramic substrate, a plastic substrate, or the like can be used. The base film 7602 can be formed using a single layer of aluminum nitride (AlN), silicon oxide ($SiO_2$), silicon oxynitride ($SiO_xN_y$), or the like, or stacked layers thereof.

Furthermore, wirings 7605 and 7606 are formed over the base film 7602, and an end portion of the pixel electrode 7603 is covered with the wiring 7605. N-type semiconductor layers 7607 and 7608 having an N-type conductivity are formed above the wirings 7605 and 7606. In addition, a semiconductor layer 7609 is formed between the wirings 7605 and 7606, and over the base film 7602. A part of the semiconductor layer 7609 is extended to over the N-type semiconductor layers 7607 and 7608. It is to be noted that this semiconductor layer is formed using a semiconductor film having noncrystallinity such as amorphous silicon (a-Si:H) or a microcrystalline semiconductor (μ-Si:H). A gate insulating film 7610 is formed over the semiconductor layer 7609. In addition, an insulating film 7611 is formed of the same material as the gate insulating film 7610, over the first electrode 7604. As the gate insulating film 7610, a silicon oxide film, a silicon nitride film, or the like is used.

A gate electrode 7612 is formed over the gate insulating film 7610. In addition, a second electrode 7613 is formed of the same material as the gate electrode, over the first electrode 7604 with the insulating film 7611 therebetween. The first electrode 7604 and the second electrode 7613 with the insulating film 7611 therebetween form a capacitor element 7619. Furthermore, an interlayer insulator 7614 is formed so as to cover an end portion of the pixel electrode 7603, the driving transistor 7618, and the capacitor element 7619.

A layer 7615 containing an organic compound, and a counter electrode 7616 are formed over the interlayer insulator 7614 and the pixel electrode 7603 located in an opening portion of the interlayer insulator 7614; thereby forming a light emitting element 7618 in a region where the layer 7615 containing an organic compound is sandwiched between the pixel electrode 7603 and the counter electrode 7616.

In addition, the first electrode 7604 shown in FIG. 34A may be formed as a first electrode 7620 shown in FIG. 34B. The first electrode 7620 is formed with the same material as the wirings 7605 and 7606.

Figure 35A:
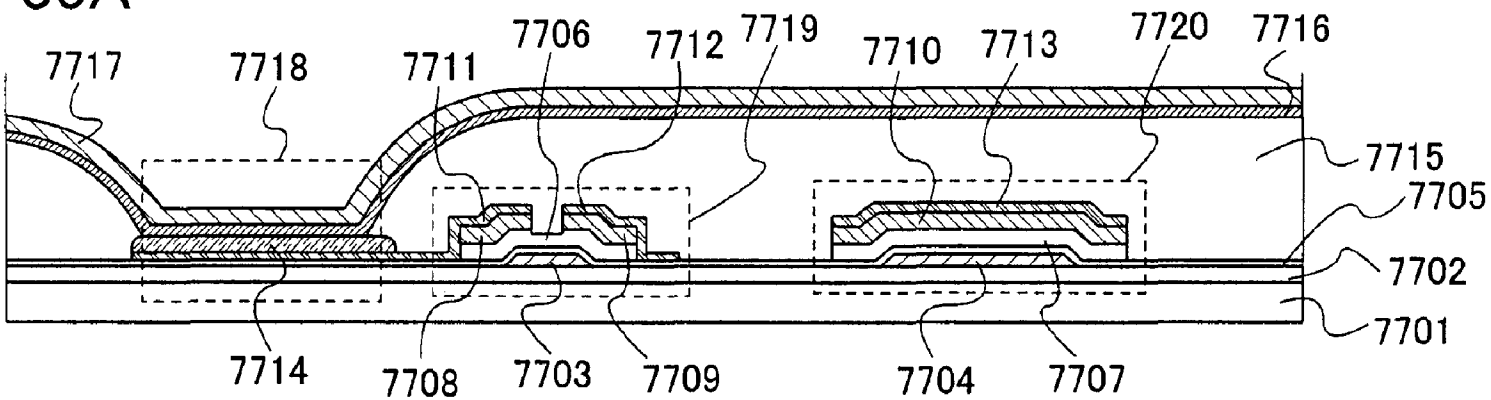
FIGS. 35A and 35B are views describing a display panel used in a display device of the present invention.
Figure 35B:
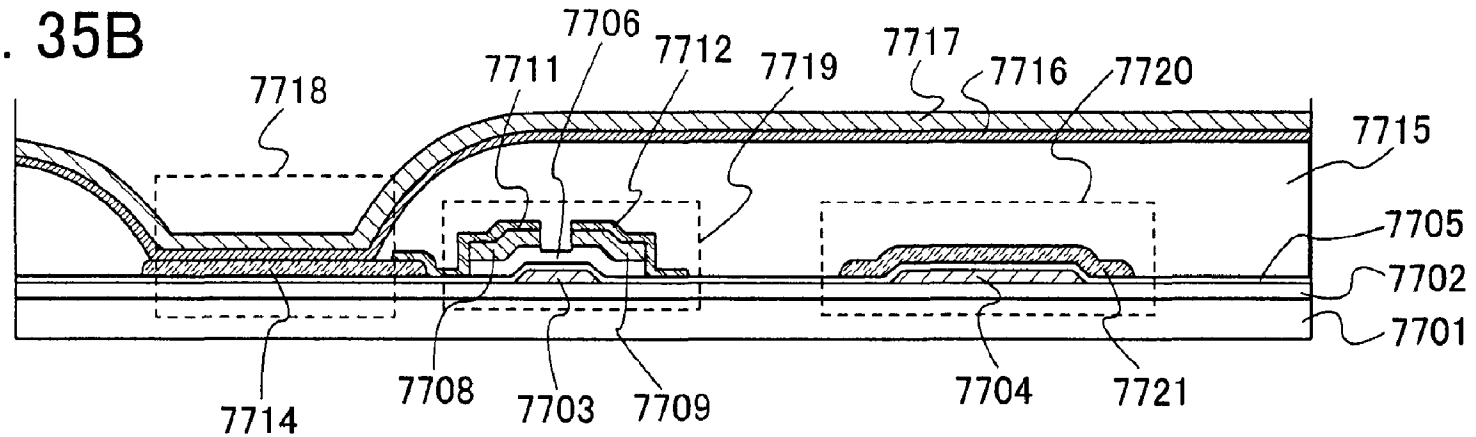

In addition, a part of a cross-section of a display panel using a bottom gate transistor including a semiconductor layer of amorphous silicon is shown in FIGS. 35A and 35B.

A base film 7702 is formed over a substrate 7701. Then, a gate electrode 7703 is formed over the base film 7702. A first electrode 7704 is formed with the same material as the gate electrode 7703. As a material of the gate electrode 7703, polycrystalline silicon to which phosphorus is added can be used. Besides polycrystalline silicon, silicide which is a compound of metal and silicon may be used.

In addition, a gate insulating film 7705 is formed so as to cover the gate electrode 7703 and the first electrode 7704. As the gate insulating film 7705, a silicon oxide film, a silicon nitride film, or the like is used.

A semiconductor layer 7706 is formed over the gate insulating film 7705. In addition, a semiconductor layer 7707 is formed with the same material as the semiconductor layer 7706.

As the substrate, a glass substrate, a quartz substrate, a ceramic substrate, a plastic substrate, or the like can be used. The base film 7602 can be formed using a single layer of aluminum nitride (AlN), silicon oxide ($SiO_2$), silicon oxynitride ($SiO_xN_y$), or the like or stacked layers thereof.

N-type semiconductor layers 7708 and 7709 having N-type conductivity are formed over the semiconductor layer 7706, and an N-type semiconductor layer 7710 is formed over the semiconductor layer 7707.

Wires 7711 and 7712 are formed over the N-type semiconductor layers 7708 and 7709 respectively, and a conductive layer 7713 is formed with the same material as the wires 7711 and 7712, over the N-type semiconductor layer 7710.

Thus, a second electrode is formed with the semiconductor layer 7707, the N-type semiconductor layer 7710, and the conductive layer 7713. It is to be noted that a capacitor element 7720 having a structure where the gate insulating film 7705 is interposed between the second electrode and the first electrode 7704 is formed.

One end portion of the wire 7711 is extended, and a pixel electrode 7714 is formed so as to be in contact with an upper potion of the extended wire 7711.

In addition, an insulator 7715 is formed so as to cover end portions of the pixel electrode 7714, a driving transistor 7719, and the capacitor element 7720.

Then, a layer 7716 containing an organic compound and a counter electrode 7717 are formed over the pixel electrode 7714 and the insulator 7715. A light emitting element 7718 is formed in a region where the layer 7716 containing an organic compound is interposed between the pixel electrode 7714 and the counter electrode 7717.

The semiconductor layer 7707 and the N-type semiconductor layer 7710 to be a part of the second electrode of the capacitor element 7720 are not necessarily formed. That is, the second electrode may be the conductive layer 7713, so that the capacitor element may have such a structure that the gate insulating film is interposed between the first electrode 7704 and the conductive layer 7713.

It is to be noted that the pixel electrode 7714 is formed before forming the wire 7711 in FIG. 35A, whereby a capacitor element 7720 as shown in FIG. 35B can be obtained, which has a structure where the gate insulating film 7705 is interposed between the first electrode 7704 and a second electrode 7721 formed of the pixel electrode 7714.

Although FIGS. 35A and 35B show inverted staggered channel-etched transistors, a channel-protective transistor may be used. Description of channel-protective transistors will be made with reference to FIGS. 36A and 36B.

Figure 36A:
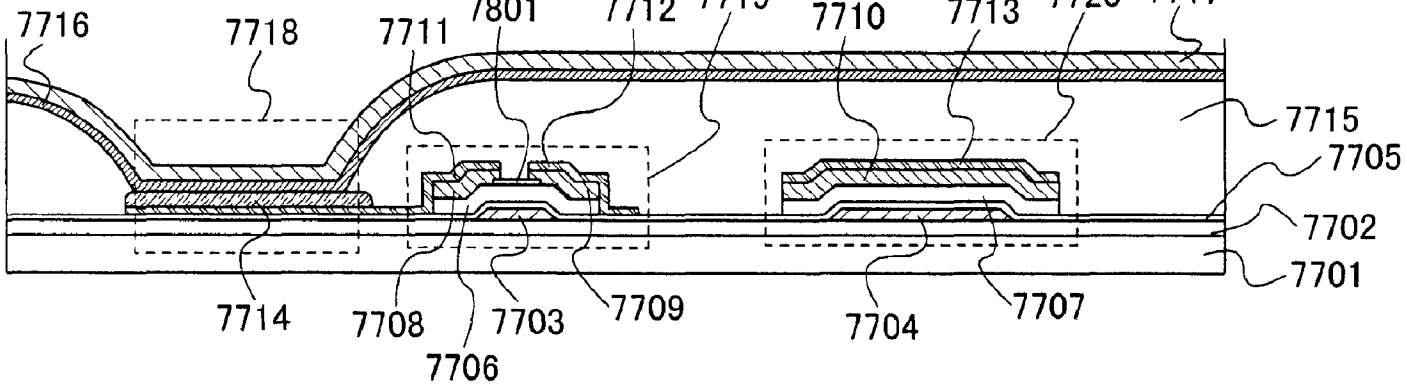
FIGS. 36A and 36B are views describing a display panel used in a display device of the present invention.

A channel-protective transistor shown in FIG. 36A is different from the channel-etched driving transistor 7719 shown in FIG. 35A in that an insulator 7801 functioning as an etching mask is provided over a region in which a channel is to be formed in the semiconductor layer 7706. Common portions except that point are denoted by the same reference numerals.

Figure 36B:
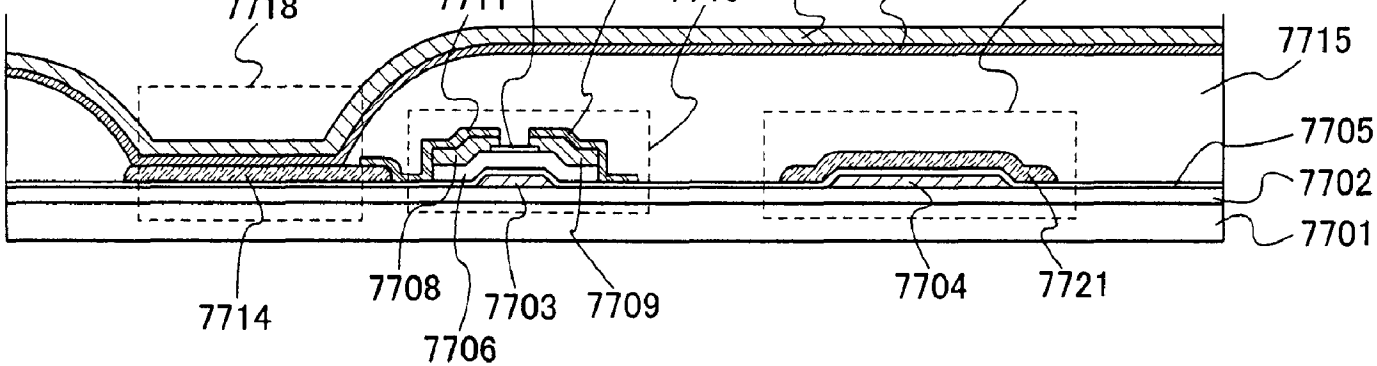

Similarly, a channel-protective transistor shown in FIG. 36B is different from the channel-etched driving transistor 7719 shown in FIG. 35B in that the insulator 7802 functioning as an etching mask is provided over the region in which a channel is to be formed in the semiconductor layer 7706 of the channel-etched driving transistor 7719. Common portions except that point are denoted by the same reference numerals.

It is to be noted that structures of the transistors and capacitor elements to which the pixel configuration of the present invention can be applied are not limited to those described above, and transistors and capacitor elements with various structures can be used.

By using the pixel configuration of the present invention, an initial failure or a progressive failure of a light emitting element can be suppressed, and a decrease in luminescence caused by deterioration of an electroluminescent layer can be prevented. Furthermore, by using an amorphous semiconductor film for a semiconductor layer (a channel formation region, a source region, a drain region, or the like) of a transistor included in a pixel of the present invention, the manufacturing costs can be reduced.

This embodiment can be carried out in combination with the embodiment modes or the other embodiments in this specification.

Embodiment 5

Figure 42:
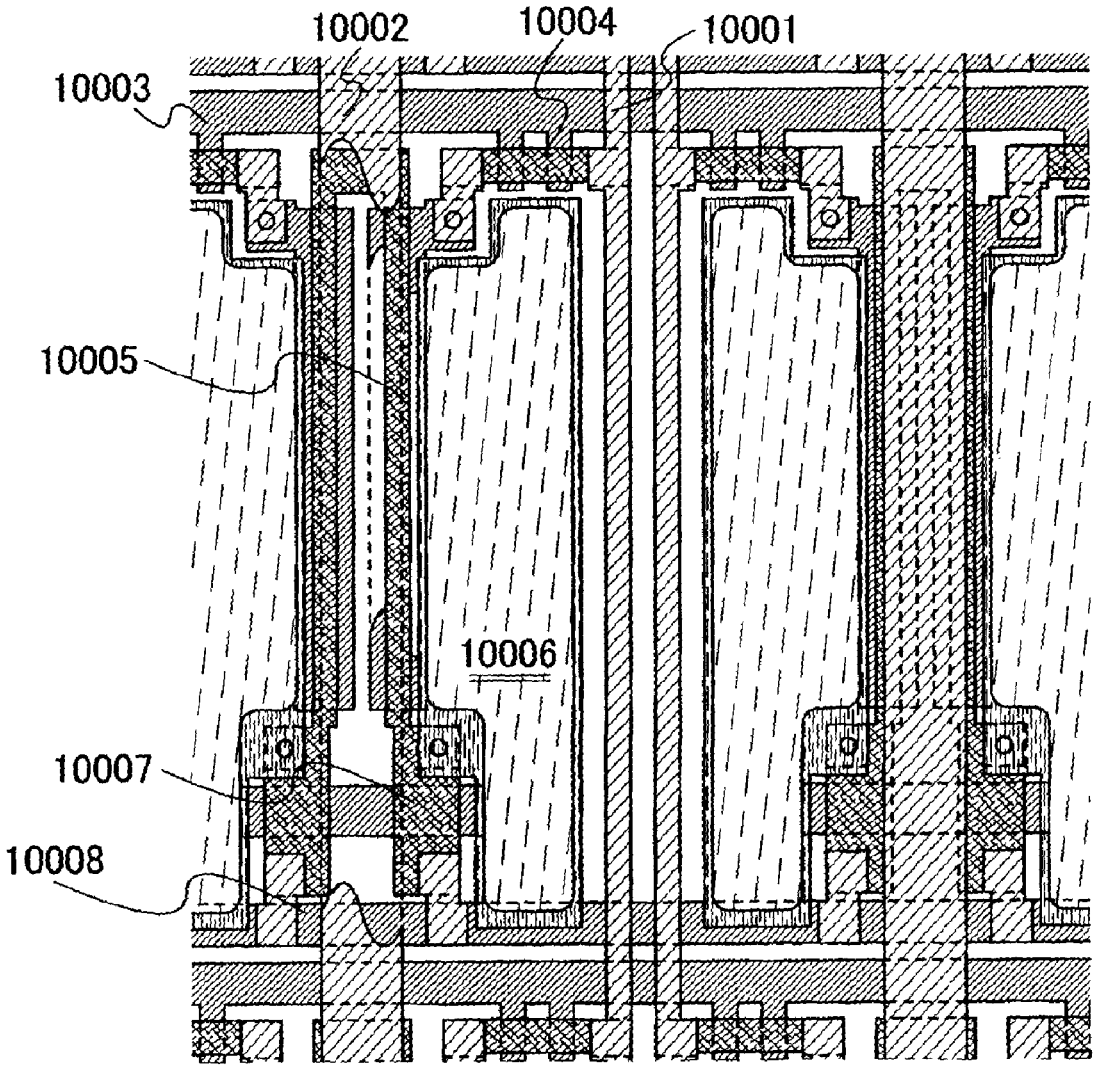
FIG. 42 is a layout view of a pixel of the present invention.

A layout drawing of the pixel configuration of FIG. 1, which is Embodiment Mode 1, is shown in FIG. 42.

In FIG. 42, a signal line 10001, a power line 10002, a scanning line 10003, a switching transistor 10004, a driving transistor 10005, a pixel electrode 10006, an AC transistor 10007, and a potential control line 10008 are included The objects with the same terms as in FIG. 1 correspond to the respective objects in FIG. 1.

It is to be noted that the display device of the present invention is not limited to the layout of this embodiment.

By using the pixel configuration of the present invention, it is possible to apply a constant current to a light emitting element when a forward light emitting element driving voltage is applied to the light emitting element, and apply a current sufficient enough to insulate a short-circuited point to the short-circuited point when a reverse light emitting element driving voltage is applied to the light emitting element. Furthermore, the life of the light emitting element can be extended. In addition, a circuit configuration can be constituted by transistors having the same conductivity type, so that the manufacturing costs can be low.

Although the circuit configuration of FIG. 1 of the above-described Embodiment Mode 1 is used in this embodiment, the present invention is not limited thereto, and this embodiment can be combined with other embodiment modes and other embodiments.

Embodiment 6

The display device of the present invention can be applied to various electronic devices, specifically a display portion of electronic devices. The electronic devices include cameras such as a video camera and a digital camera, a goggle-type display, a navigation system, an audio reproducing device (car audio component stereo, audio component stereo, or the like), a computer, a game machine, a portable information terminal (mobile computer, mobile phone, mobile game machine, electronic book, or the like), an image reproducing device provided with a recording medium (specifically, a device for reproducing content of a recording medium such as a digital versatile disc (DVD) and having a display for displaying the reproduced image) and the like.

Figure 43A:
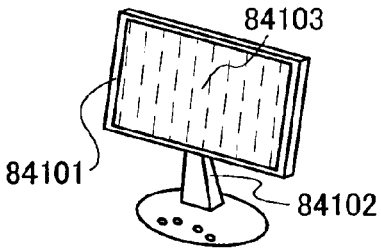
FIGS. 43A to 43H are views each describing an electronic device to which a display device of the present invention can be applied.

FIG. 43A shows a display which includes a housing 84101, a supporting base 84102, a display portion 84103, and the like. A display device having a pixel configuration of the present invention can be used for the display portion 84103. It is to be noted that the display includes all display devices for displaying information such as for a personal computer, receiving television broadcasting, and displaying an advertisement. A display using the display device having a pixel configuration of the present invention for the display portion 84103 can prevent a display defect and extend the life of the light emitting element. Furthermore, cost reduction can be achieved.

In recent years, the need for a large-sized display has been increased. As a display becomes larger, there is caused a problem of increased cost. Therefore, it is an issue to reduce the manufacturing costs as much as possible and to provide a high quality product at as low a price as possible.

For example, by applying the pixel configuration described in the above embodiment modes to a pixel portion of a display panel, a display panel formed with transistors having the same conductivity type can be provided. Therefore, the number of manufacturing steps can be reduced, which leads to reduction in the manufacturing costs.

In addition, by forming the pixel portion and the peripheral driver circuit over the same substrate as shown in FIG. 28A, the display panel can be formed using circuits including transistors having the same conductivity type.

In addition, by using an amorphous semiconductor (such as amorphous silicon (a-Si:H)) as a semiconductor layer of a transistor in a circuit constituting the pixel portion, a manufacturing process can be simplified and further cost reduction can be realized. In this case, it is preferable that a driver circuit in the periphery of the pixel portion be formed into an IC chip and mounted on the display panel by COG or the like as shown in FIGS. 29B and 30A. In this manner, by using an amorphous semiconductor, it becomes easy to size up the display.

Figure 43B:
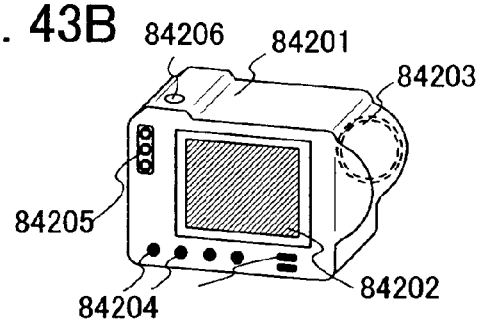

FIG. 43B shows a camera which includes a main body 84201, a display portion 84202, an image receiving portion 84203, operating keys 84204, an external connection port 84205, a shutter 84206, and the like.

In recent years, in accordance with advance in performance of a digital camera and the like, competitive manufacturing thereof has been intensified. Thus, it is important to provide a higher-performance product at as low a price as possible. A digital camera using a display device having a pixel configuration of the present invention for the display portion 84202 can prevent a display defect and extend the life of the light emitting element. Furthermore, cost reduction can be achieved.

For example, by using the pixel configuration of the above-described embodiment modes for the pixel portion, the pixel portion can be constituted by transistors having the same conductivity type. In addition, as shown in FIG. 29A, by forming a signal line driver circuit whose operating speed is high into an IC chip, and forming a scanning line driver circuit whose operating speed is relatively low with a circuit constituted by transistors having the same conductivity type over the same substrate as the pixel portion, higher performance can be realized and cost reduction can be achieved. In addition, by using an amorphous semiconductor such as amorphous silicon for a semiconductor layer of a transistor in the pixel portion and the scanning line driver circuit formed over the same substrate as the pixel portion, further cost reduction can be achieved.

Figure 43C:
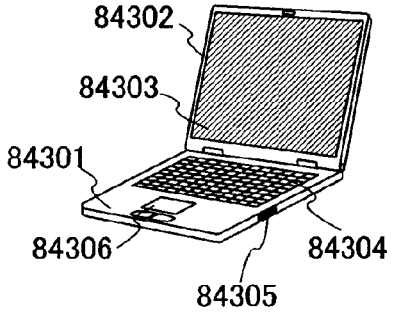

FIG. 43C shows a computer which includes a main body 84301, a housing 84302, a display portion 84303, a keyboard 84304, an external connection port 84305, a pointing mouse 84306, and the like. A computer using a display device having a pixel configuration of the present invention for the display portion 84303 can prevent a display defect and extend the life of the light emitting element. Furthermore, cost reduction can be achieved.

Figure 43D:
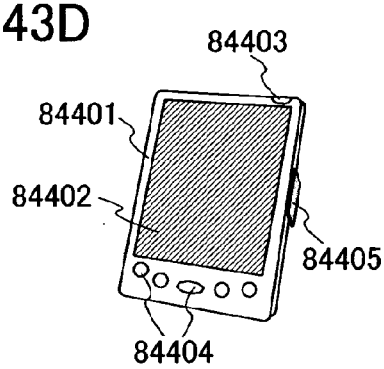

FIG. 43D shows a mobile computer which includes a main body 84401, a display portion 84402, a switch 84403, operating keys 84404, an infrared port 84405, and the like. A mobile computer using a display device having a pixel configuration of the present invention for the display portion 84402 can prevent a display defect and extend the life of the light emitting element. Furthermore, cost reduction can be achieved.

Figure 43E:
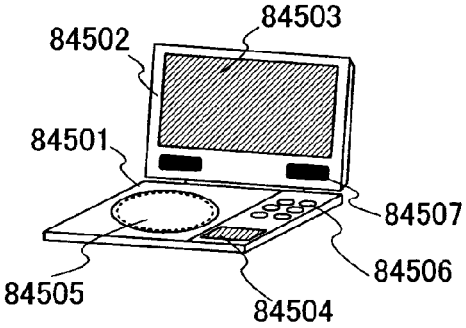

FIG. 43E shows a portable image reproducing device having a recording medium (specifically, a DVD player), which includes a main body 84501, a housing 84502, a display portion A 84503, a display portion B 84504, a recording medium (DVD or the like) reading portion 84505, operating keys 84506, a speaker portion 84507, and the like. The display portion A 84503 mainly displays video data and the display portion B 84504 mainly displays text data. An image reproducing device using a display device having a pixel configuration of the present invention for the display portions A 84503 and B 84504 can prevent a display defect and extend the life of the light emitting element. Furthermore, cost reduction can be achieved.

Figure 43F:
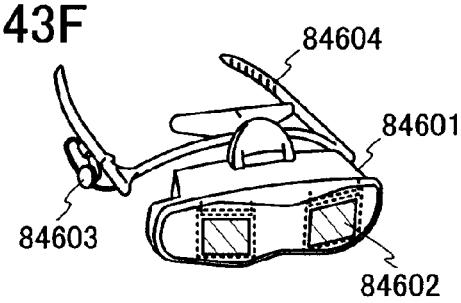

FIG. 43F shows a goggle-type display which includes a main body 84601, a display portion 84602, an earphone 84603, and a support portion 84604. A goggle type display using a display device having a pixel configuration of the present invention for the display portion 84602 can prevent a display defect and extend the life of the light emitting element. Furthermore, cost reduction can be achieved.

Figure 43G:
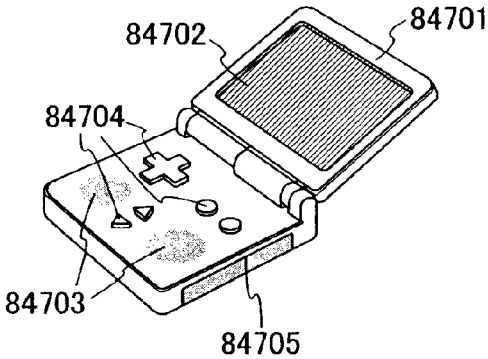

FIG. 43G shows a portable type game machine, which includes a housing 84701, a display portion 84702, a speaker portion 84703, operation keys 84704, a recording medium insert portion 84705 and the like. A portable type game machine using a display device having a pixel configuration of the present invention for the display portion 84702 can prevent a display defect and extend the life of the light emitting element. Furthermore, cost reduction can be achieved.

Figure 43H:
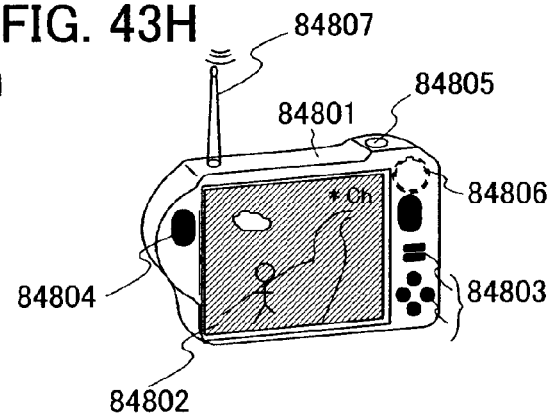

FIG. 43H shows a digital camera having a television receiving function, which includes a main body 84801, a display portion 84802, operation keys 84803, a speaker 84804, a shutter 84805, an image receiving portion 84806, an antenna 84807 and the like. A digital camera having a television receiving function using a display device having a pixel configuration of the present invention for the display portion 84802 can prevent a display defect and extend the life of the light emitting element. Furthermore, cost reduction can be achieved.

For example, the pixel configuration of the above-described embodiment modes is used in the pixel portion to enhance an aperture ratio of a pixel. Specifically, the aperture ratio can be increased by using an N-channel transistor for a driving transistor for driving a light emitting element. Thus, a digital camera having a television receiving function which includes a high-definition display portion can be provided.

As the functions are increased and frequency of using such a digital camera having a television receiving function, such as television watching and listening, has been increased, the life per charge has been required to be long.

For example, by forming a peripheral driver circuit into an IC chip as shown in FIG. 29B and FIG. 30A and using a CMOS or the like, power consumption can be reduced.

Thus, the present invention can be applied to various electronic devices.

This embodiment can be carried out in combination with the other embodiment modes or embodiments in this specification.

Embodiment 7

Figure 44:
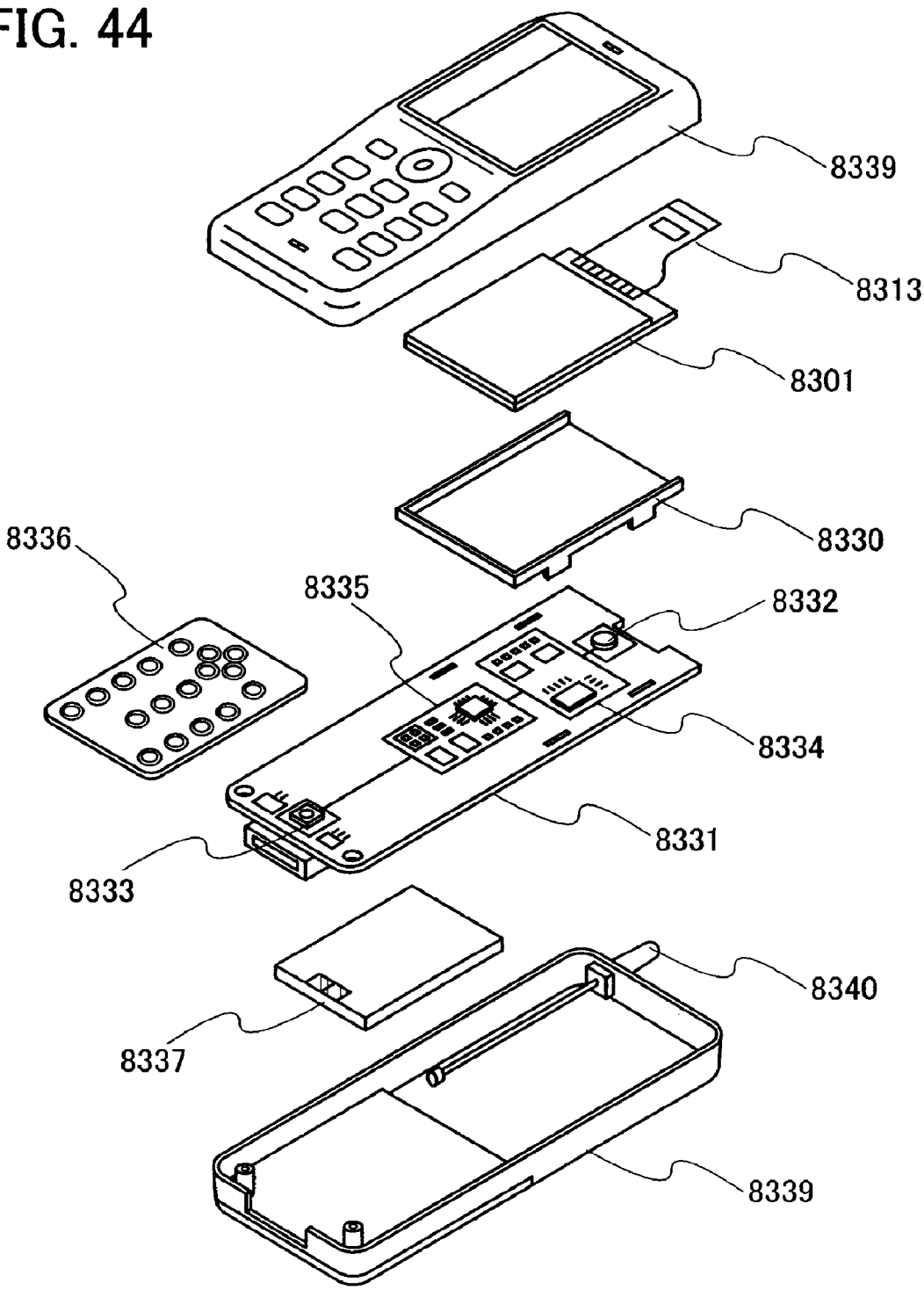
FIG. 44 is a view describing an electronic device to which a display device of the present invention can be applied.

In this embodiment, description will be made with reference to FIG. 44, of an example structure of a mobile phone which has a display portion having a display device using a pixel configuration of the present invention.

A display panel 8301 is incorporated in a housing 8330 so as to be freely attached and detached. The shape and size of the housing 8330 can be changed appropriately in accordance with the size of the display panel 8301. The housing 8330 provided with the display panel 8301 is fitted in a printed circuit board 8331 so as to be assembled as a module.

The display panel 8301 is connected to the printed circuit board 8331 through an FPC 8313. A speaker 8332, a microphone 8333, a transmitting and receiving circuit 8334, and a signal processing circuit 8335 including a CPU, a controller, and the like are formed over the printed circuit board 8331. Such a module, an inputting means 8336, and a battery 8337 are combined, and they are stored in a housing 8339. A pixel portion of the display panel 8301 is disposed so as to be seen from an opening window formed in the housing 8339.

The display panel 8301 may be formed by forming a pixel portion and a part of peripheral driver circuits (a driver circuit whose operation frequency is low among a plurality of driver circuits) using TFTs over the same substrate; forming a part of the peripheral driver circuits (a driver circuit whose operation frequency is high among the plurality of driver circuits) into an IC chip; and mounting the IC chip on the display panel 8301 by COG (Chip On Glass). The IC chip may be, alternatively, connected to a glass substrate by using TAB (Tape Automated Bonding) or a printed circuit board. It is to be noted that FIG. 28A shows an example of a structure of such a display panel in which a part of peripheral driver circuits is formed over the same substrate as a pixel portion and an IC chip provided with the other part of the peripheral driver circuits is mounted by COG or the like. By employing such a structure, power consumption of a display device can be reduced and the life per charge of a mobile phone can be made long. In addition, cost reduction of the mobile phone can be achieved.

To the pixel portion, the pixel configurations described in the above embodiment modes can be appropriately applied.

For example, by applying the pixel configuration described in the above embodiment modes, the number of manufacturing steps can be reduced. That is to say, the pixel portion and the peripheral driver circuit formed over the same substrate as the pixel portion are constituted by transistors having the same conductivity type in order to achieve cost reduction.

In addition, in order to further reduce the power consumption, the pixel portion may be formed using TFTs over a substrate, all of the peripheral driver circuits may be formed into IC chips, and the IC chips may be mounted on the display panel by COG (Chip On Glass) or the like as shown in FIGS. 29B and 30A. The pixel configuration of the above-described embodiment modes is used for the pixel portion, and an amorphous semiconductor film is used for a semiconductor layer of a transistor, thereby reducing manufacturing costs.

It is to be noted that the structure described in this embodiment is just an example of a mobile phone, and the pixel configuration of the present invention can be applied not only to a mobile phone having the above-described structure but also to mobile phones having various structures.

This embodiment can be carried out in combination with the embodiment modes or the other embodiments in this specification.

Embodiment 8

In this embodiment, a structural example of an electronic device which includes a display device using a pixel configuration of the present invention in a display portion, in particular, a television receiver including an EL module, will be described.

Figure 45:
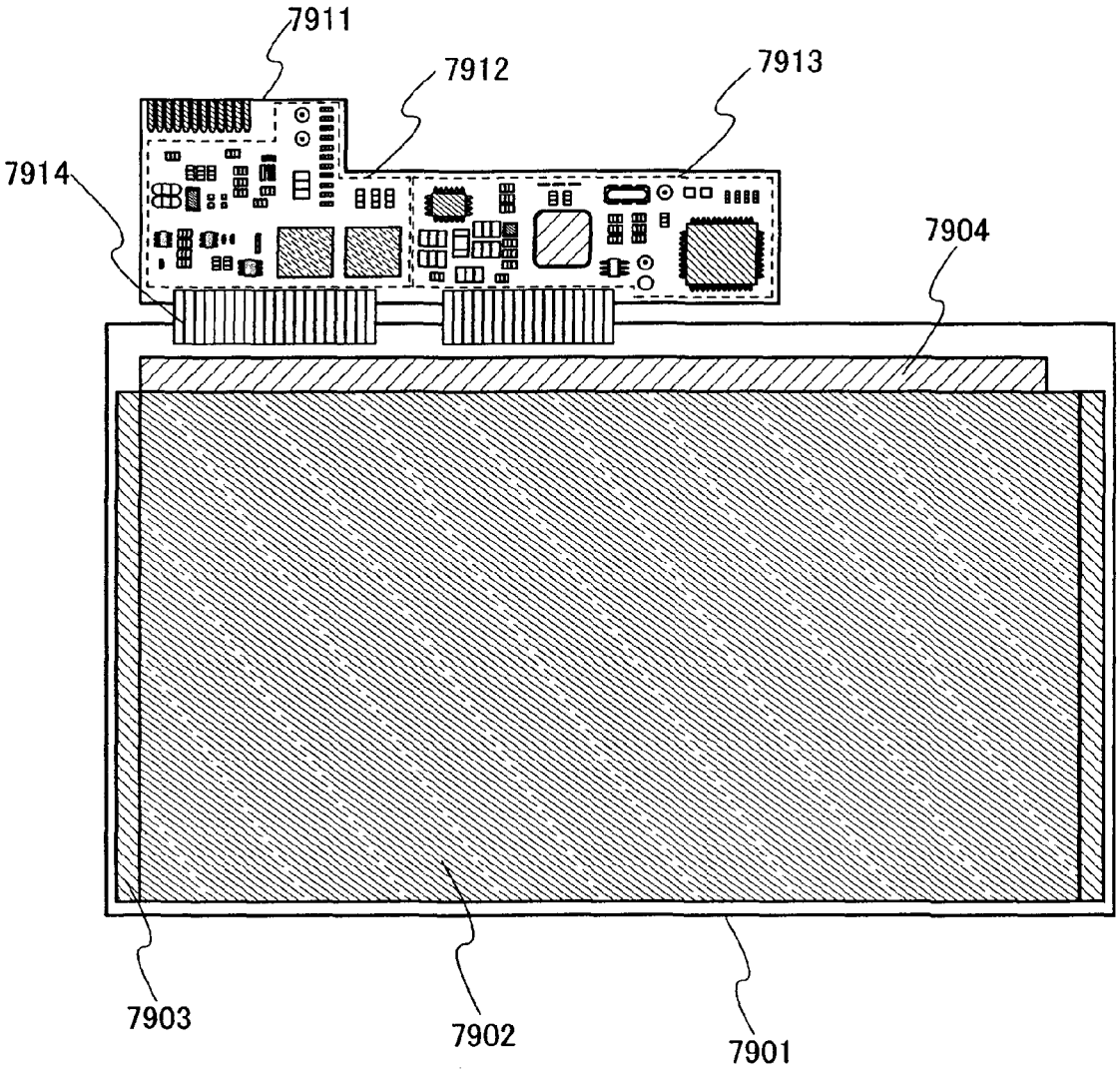
FIG. 45 is a view describing an electronic device to which a display device of the present invention can be applied.

FIG. 45 shows an EL module combining a display panel 7901 and a circuit board 7911. The display panel 7901 includes a pixel portion 7902, a scanning line driver circuit 7903, and a signal line driver circuit 7904. A control circuit 7912, a signal dividing circuit 7913, and the like are formed over the circuit board 7911. The display panel 7901 and the circuit board 7911 are connected to each other by a connecting wire 7914. As the connecting wire, an FPC or the like can be used.

The display panel 7901 may be formed by forming a pixel portion and a part of peripheral driver circuits (a driver circuit whose operation frequency is low among a plurality of driver circuits) using TFTs over the same substrate; forming a part of the peripheral driver circuits (a driver circuit whose operation frequency is high among the plurality of driver circuits) into an IC chip; and mounting the IC chip on the display panel 7901 by COG (Chip On Glass) or the like. The IC chip may be, alternatively, mounted on the display panel 7901 by using TAB (Tape Automated Bonding) or a printed circuit board. It is to be noted that FIG. 28A shows an example of a structure where a part of peripheral driver circuits is formed over the same substrate as a pixel portion and an IC chip provided with the other peripheral driver circuits is mounted by COG or the like.

In the pixel portion, the pixel configurations described in the above embodiment modes can be appropriately applied.

For example, by applying the pixel configuration etc., described in the above embodiment modes, the number of manufacturing steps can be reduced. That is to say, the pixel portion and the peripheral driver circuit formed over the same substrate as the pixel portion are constituted by transistors having the same conductivity type in order to achieve cost reduction.

In addition, in order to further reduce the power consumption, the pixel portion may be formed using TFTs over a glass substrate, all of the peripheral driver circuits may be formed into an IC chip, and the IC chip may be mounted on the display panel by COG (Chip On Glass) or the like.

In addition, by applying the pixel configuration described in the above embodiment modes, pixels can be constituted only by N-channel transistors, so that an amorphous semiconductor (such as amorphous silicon) can be applied to a semiconductor layer of a transistor. That is, a large-sized display device where it is difficult to form a uniform crystalline semiconductor film can be manufactured. Furthermore, by using an amorphous semiconductor film for a semiconductor layer of a transistor constituting a pixel, the number of manufacturing steps can be reduced and reduction in the manufacturing costs can be achieved.

It is preferable that, in the case where an amorphous semiconductor film is applied to a semiconductor layer of a transistor constituting a pixel, the pixel portion be formed using TFTs over a substrate, all of the peripheral driver circuits be formed into an IC chip, and the IC chip be mounted on the display panel by COG (Chip On Glass). It is to be noted that FIG. 29B shows an example of the structure where a pixel portion is formed over a substrate and an IC chip provided with a peripheral driver circuit is mounted on the substrate by COG or the like.

Figure 46:
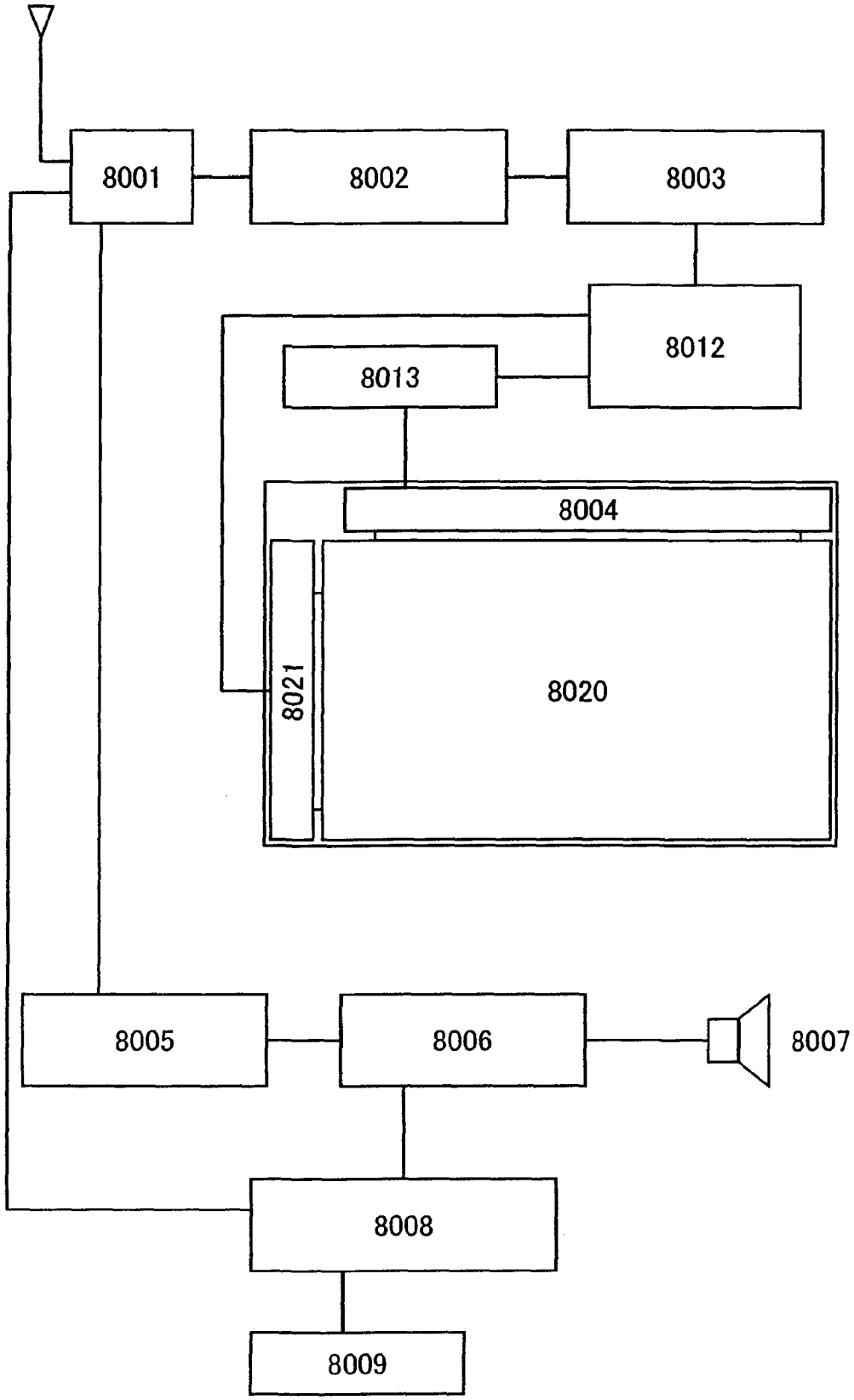
FIG. 46 is a diagram describing an electronic device to which a display device of the present invention can be applied.

An EL television receiver can be completed with this EL module. FIG. 46 is a block diagram showing a main structure of an EL television receiver. A tuner 8001 receives a video signal and an audio signal. The video signals are processed by a video signal amplifier circuit 8002, a video signal processing circuit 8003 for converting a signal output from the video signal amplifier circuit 8002 into a color signal corresponding to each color of red, green and blue, and the control circuit 8012 for converting the video signal into the input specification of a driver circuit.

The control circuit 8012 outputs a signal to each of the scanning line side (a scanning line driver circuit 8021) and the signal line side (a signal line driver circuit 8004). In a case of driving in a digital manner, a structure where the signal dividing circuit 8013 is provided on the signal line side to supply an input digital signal by dividing the input digital signal into m signals may be employed. It is to be noted that signals are input to the display panel 8020 from each of the scanning line driver circuit 8021 and the signal line driver circuit 8004.

An audio signal received by the tuner 8001 is transmitted to an audio signal amplifier circuit 8005, and an output thereof is supplied to a speaker 8007 through an audio signal processing circuit 8006. A control circuit 8008 receives receiving station (received frequency) and volume control data from an input portion 8009, and transmits signals to the tuner 8001 and the audio signal processing circuit 8006.

Figure 47A:
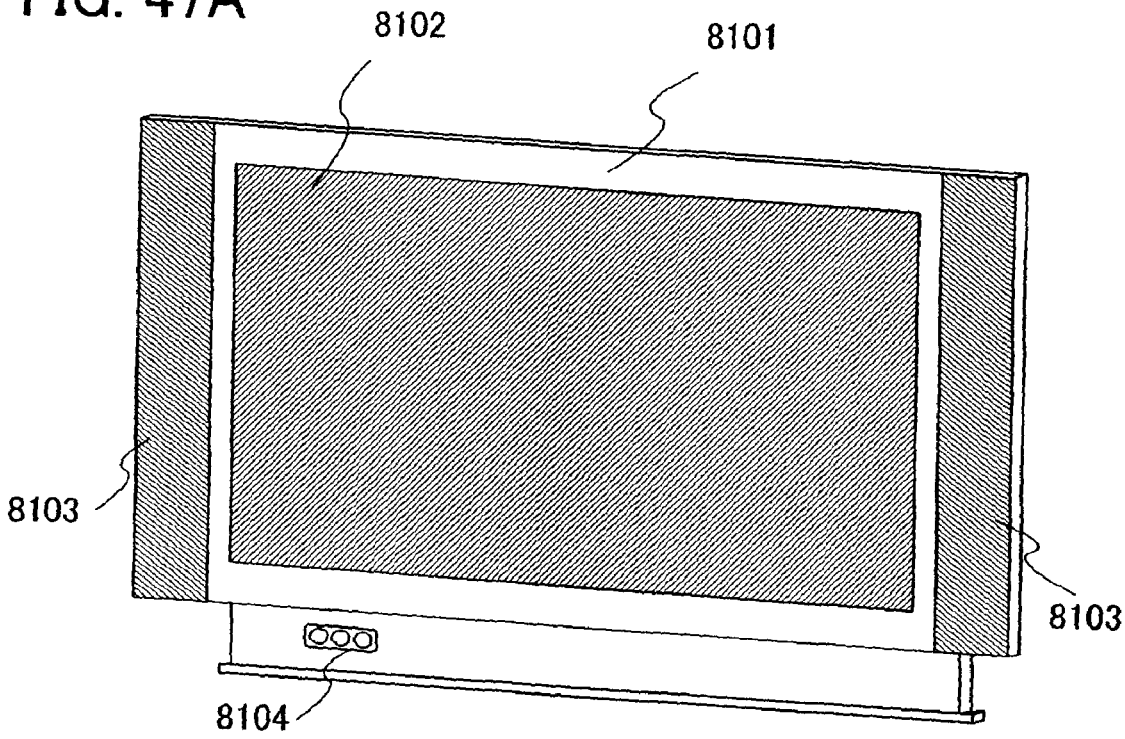
FIGS. 47A and 47B are views each describing an electronic device to which a display device of the present invention can be applied.

FIG. 47A shows a television receiver incorporating an EL module having a different mode from that in FIG. 46. In FIG. 47A, a display screen 8102 is constituted by the EL module. In addition, a speaker 8103, operation switches 8104, and the like are provided in a housing 8101 appropriately.

Figure 47B:
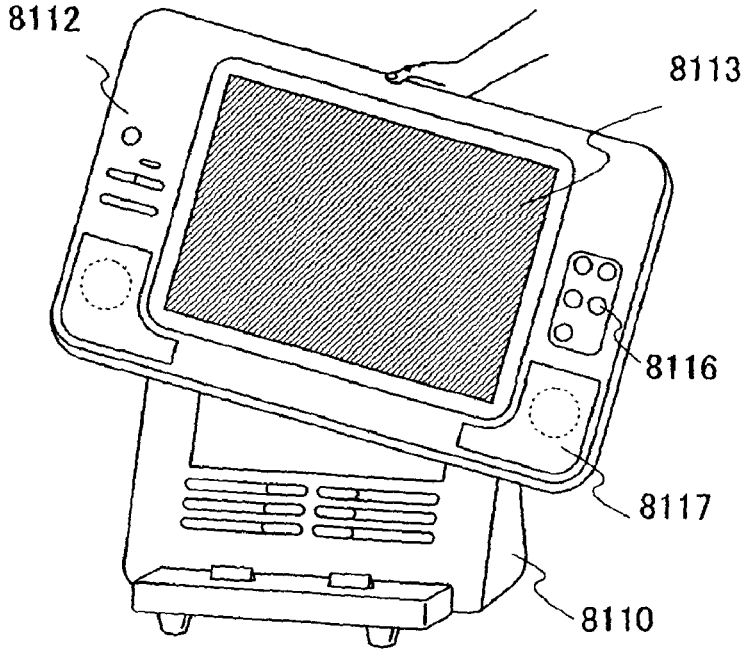

FIG. 47B shows a television receiver having a portable wireless display. A battery and a signal receiver are installed in a housing 8112. The battery drives a display portion 8113 and a speaker portion 8117. The battery can be repeatedly charged by a battery charger 8110. The battery charger 8110 can send and receive a video signal and send the video signal to the signal receiver of the display. The housing 8112 is controlled by operation switches 8116. The device shown in FIG. 47B can be referred to as a video-audio bidirectional communication device since a signal can be sent from the housing 8112 to the battery charger 8110 by operating the operation keys 8116. Furthermore, the device can be referred to as a versatile remote control device since a signal can be sent from the housing 8112 to the battery charger 8110 by operating the operation keys 8116 and another electronic device is made to receive a signal which can be sent by the battery charger 8110, accordingly, communication control of another electronic device is realized. The present invention can be applied to the display portion 8113.

Figure 48A:
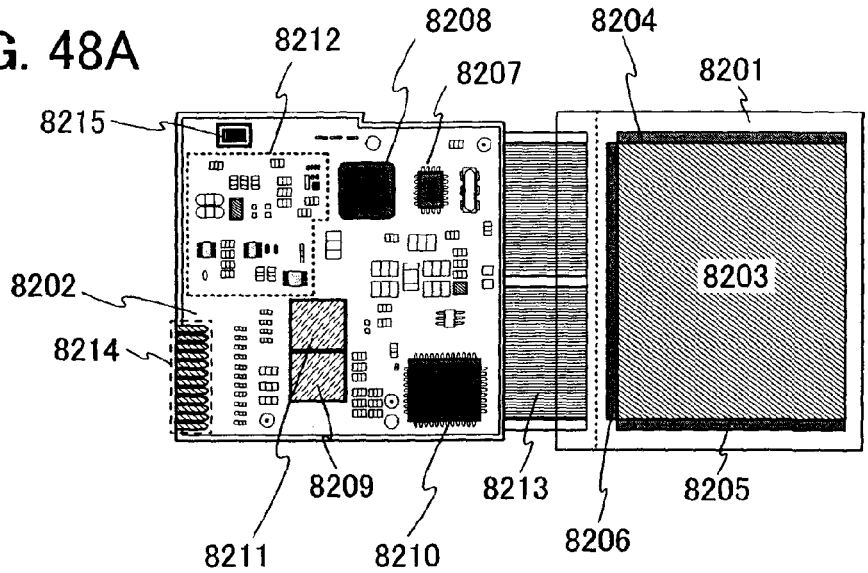
FIGS. 48A and 48B are views each showing an electronic device to which a display device of the present invention can be applied.

FIG. 48A shows a module formed by combining a display panel 8201 and a printed wire board 8202. The display panel 8201 is provided with a pixel portion 8203 with a plurality of pixels, a first scanning line driver circuit 8204, a second scanning line driver circuit 8205, and a signal line driver circuit 8206 for supplying a video signal to a selected pixel.

A printed wire board 8202 is provided with a controller 8207, a central processing unit (CPU) 8208, a memory 8209, a power supply circuit 8210, an audio processing circuit 8211, a sending and receiving circuit 8212 and the like. The printed wire board 8202 is connected to the display panel 8201 via an FPC 8213. The printed wire board 8202 can be formed to have a structure in which a capacitor element, a buffer circuit, and the like are formed to prevent noise from causing in power supply voltage or a signal or the rising of a signal from dulling. The controller 8207, the audio processing circuit 8211, the memory 8209, the CPU 8208, the power supply circuit 8210, and the like can be mounted on the display panel 8201 by using a COG (Chip On Glass) method. By means of the COG method, the size of the printed wire board 8202 can be reduced.

Various control signals are input or output via an interface (I/F) 8214 which is provided on the printed wire board 8202. An antenna port 8215 for sending and receiving to/from an antenna is provided on the printed wire board 8202.

Figure 48B:
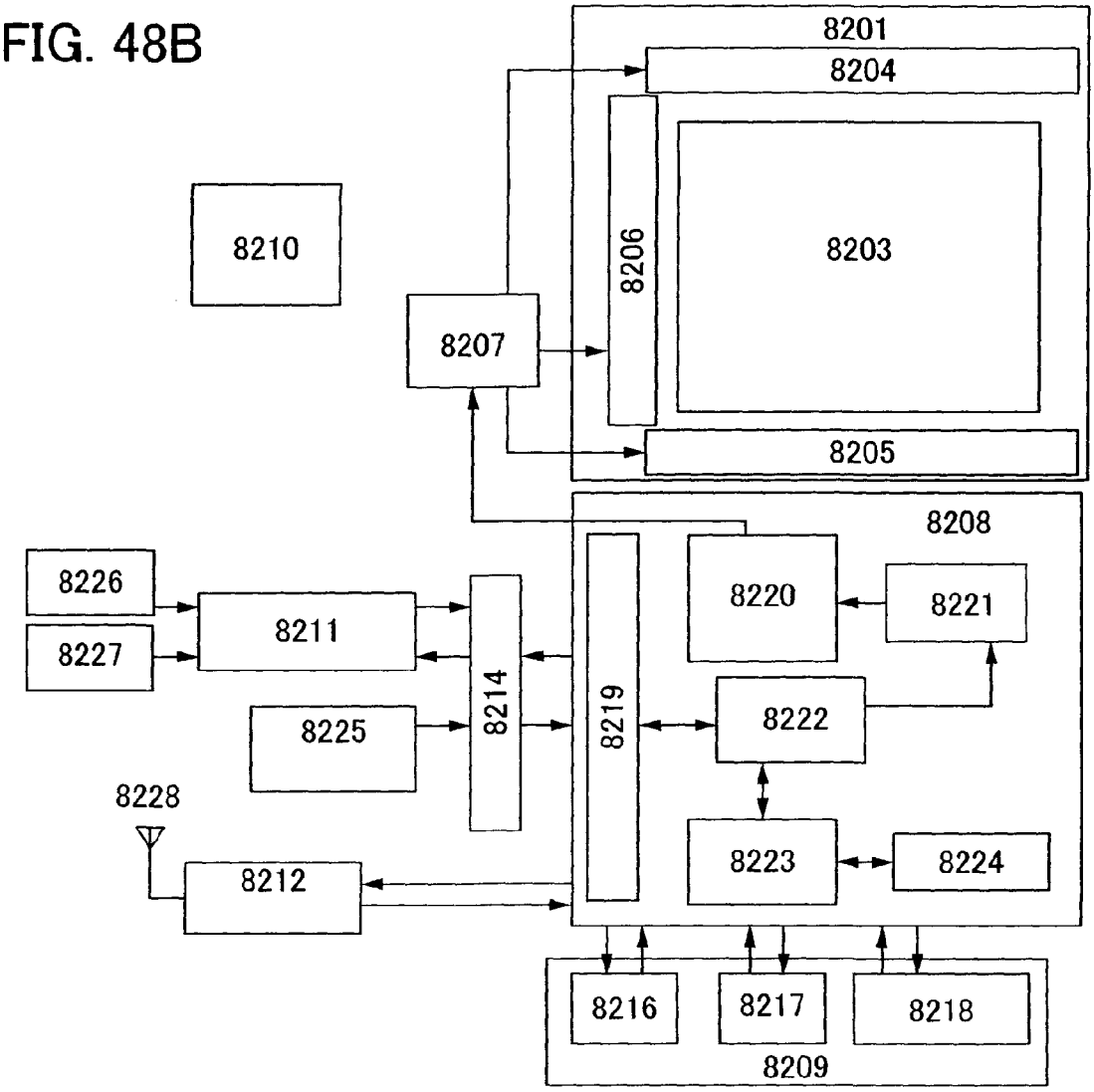

FIG. 48B is a block diagram for showing the module shown in FIG. 48A. The module includes a VRAM 8216, a DRAM 8217, a flash memory 8218, and the like as a memory 8209. The VRAM 8216 stores data of an image displayed on a panel, the DRAM 8217 stores video data or audio data, and the flash memory stores various programs.

The power supply circuit 8210 supplies electricity for operating the display panel 8201, the controller 8207, the CPU 8208, the audio processing circuit 8211, the memory 8209, and the sending and receiving circuit 8212. The power supply circuit 8210 may be provided with a current source, depending on a panel specification.

The CPU 8208 includes a control signal generation circuit 8220, a decoder 8221, a resistor 8222, an arithmetic circuit 8223, a RAM 8224, an interface 8219 for the CPU 8208, and the like. Various signals input to the CPU 8208 via the interface 8219 are once stored in the resister 8222, then input to the arithmetic circuit 8223, the decoder 8221, or the like. The arithmetic circuit 8223 carries out an operation based on the input signal, to designate the location to which various instructions are sent. On the other hand, the signal input to the decoder 8221 is decoded and input to the control signal generation circuit 8220. The control signal generation circuit 8220 produces a signal including various instructions based on the input signal, and sends the signal to the location designated by the arithmetic circuit 8223, specifically, the memory 8209, the sending and receiving circuit 8212, the audio processing circuit 8211, and the controller 8207 etc.

The memory 8209, the sending and receiving circuit 8212, the audio processing circuit 8211, and the controller 8207 operate in accordance with the instruction each of them received. Hereinafter, the operation will be briefly explained.

The signal input from an input means 8225 is sent to the CPU 8208 mounted on the printed wire board 8202 via the I/F 8214. The control signal generation circuit 8220 converts video data stored in the VRAM 8216 into a predetermined format to send the converted data to the controller 8207, depending on the signal sent from the input means 8225 such as a pointing mouse or a key board.

The controller 8207 carries out data processing for the signal including the video data sent from the CPU 8208 in accordance with the panel specification, and supplies the signal to the display panel 8201. Furthermore, the controller 8207 produces a Hsync signal, a Vsync signal, a clock signal CLK, an alternating voltage (AC Cont), and a shift signal L/R based on a power supply voltage input from the power supply circuit 8210 or various signals input from the CPU 8208, and supplies the signals to the display panel 8201.

The sending and receiving circuit 8212 processes a signal which is to be received and sent by an antenna 8228 as an electric wave, specifically, the sending and receiving circuit 8212 includes a high-frequency circuit such as an isolator, a band pass filter, a VCO (Voltage Controlled Oscillator), an LPF (Low Pass Filter), a coupler, or a balun. A signal including audio information among signals received and sent in the sending and receiving circuit 8212 is sent to the audio processing circuit 8211 depending on an instruction from the CPU 8208.

The signal including audio information which is sent depending on an instruction from the CPU 8208 is demodulated into an audio signal in the audio processing circuit 8211 and is sent to a speaker 8227. An audio signal sent from a microphone 8226 is modulated in the audio processing circuit 8211 and is sent to the sending and receiving circuit 8212 depending on an instruction from the CPU 8208.

The controller 8207, the CPU 8208, the power supply circuit 8210, the audio processing circuit 8211, and the memory 8209 can be mounted as a package according to this embodiment.

Needless to say, the present invention is not limited to the television receiver. The present invention can be applied to various usages especially as a large-sized display medium such as an information display board in a railway station or an airport, an advertisement display board on the street, or the like, in addition to a monitor of a personal computer.

As described above, by using the pixel configuration of the present invention for a display device, it is possible to apply a constant current to a light emitting element when a forward light emitting element driving voltage is applied to the light emitting element, and apply a current sufficient enough to insulate a short-circuited point to the short-circuited point when a reverse light emitting element driving voltage is applied to the light emitting element. Furthermore, the life of the light emitting element can be extended. In addition, a circuit configuration can be constituted by transistors having the same conductivity type, so that the manufacturing costs can be low.

In addition, a transistor in the circuit configuration is formed of an N-type transistor, so that a transistor using amorphous silicon can be applied. Therefore, an already established manufacturing technique for a transistor using amorphous silicon can be applied, so that a display device with a favorable and stable operating characteristic can be obtained through a simple and inexpensive manufacturing process.

This embodiment can be carried out in combination with the embodiment modes or the other embodiments in this specification.

This application is based on Japanese Patent Application serial No. 2005-350006 filed in Japan Patent Office on Dec. 2, 2005, the contents of which are hereby incorporated by reference.

What is claimed is:

1. A display device comprising, in a pixel:

a first wiring, a second wiring, a third wiring, and a fourth wiring;

a light emitting element including a pixel electrode and a counter electrode;

a first transistor;

a second transistor; and a third transistor, wherein a gate electrode of the first transistor is electrically connected to the first wiring;

one of a source electrode and a drain electrode of the first transistor is electrically connected to the second wiring in which a video signal is transmitted, and the other one is electrically connected to a gate electrode of the second transistor;

one of a source electrode and a drain electrode of the second transistor is electrically connected to the third wiring, and the other one is electrically connected to the pixel electrode;

one of a source electrode and a drain electrode of the third transistor is electrically connected to the pixel electrode, and the other one is electrically connected to the gate electrode of the second transistor;

a gate electrode of the third transistor is connected to the fourth wiring; and each of the first transistor, the second transistor, and the third transistor is an N-channel transistor.

2. A display device comprising, in a pixel:

a scanning line, a signal line, a power line, and a potential control line;

a light emitting element including a pixel electrode and a counter electrode;

a switching transistor;

a driving transistor; and an AC transistor, wherein a gate electrode of the switching transistor is electrically connected to the scanning line;

one of a source electrode and a drain electrode of the switching transistor is electrically connected to the signal line in which a video signal is transmitted, and the other one is electrically connected to a gate electrode of the driving transistor;

one of a source electrode and a drain electrode of the driving transistor is electrically connected to the power line, and the other one is electrically connected to the pixel electrode;

one of a source electrode and a drain electrode of the AC transistor is electrically connected to the pixel electrode, and the other one is electrically connected to the driving transistor;

a gate electrode of the AC transistor is connected to the potential control line; and each of the switching transistor, the driving transistor, and the AC transistor is an N-channel transistor.

3. A display device comprising, in a pixel:

a first wiring, a second wiring, a third wiring, and a fourth wiring;

a light emitting element including a pixel electrode and a counter electrode;

a first transistor;

a second transistor; and a third transistor, wherein a gate electrode of the first transistor is electrically connected to the first wiring;

one of a source electrode and a drain electrode of the first transistor is electrically connected to the second wiring in which a video signal is transmitted, and the other one is directly connected to a gate electrode of the second transistor;

one of a source electrode and a drain electrode of the second transistor is electrically connected to the third wiring, and the other one is electrically connected to the pixel electrode;

one of a source electrode and a drain electrode of the third transistor is electrically connected to the pixel electrode, and the other one is electrically connected to the gate electrode of the second transistor;

a gate electrode of the third transistor is connected to the fourth wiring; and each of the first transistor, the second transistor, and the third transistor is an N-channel transistor.

4. A display device comprising, in a pixel:

a first wiring, a second wiring, a third wiring, and a fourth wiring;

a light emitting element including a pixel electrode and a counter electrode;

a first transistor;

a second transistor; and a third transistor, wherein a gate electrode of the first transistor is electrically connected to the first wiring;

one of a source electrode and a drain electrode of the first transistor is electrically connected to the second wiring in which a video signal is transmitted, and the other one is electrically connected to a gate electrode of the second transistor;

one of a source electrode and a drain electrode of the second transistor is electrically connected to the third wiring, and the other one is electrically connected to the pixel electrode;

one of a source electrode and a drain electrode of the third transistor is electrically connected to the pixel electrode, and the other one is directly connected to the other one of the source electrode and the drain electrode of the first transistor;

a gate electrode of the third transistor is connected to the fourth wiring; and each of the first transistor, the second transistor, and the third transistor is an N-channel transistor.

* * * * *